US007267890B2

(12) United States Patent
Fujita et al.

(10) Patent No.: US 7,267,890 B2
(45) Date of Patent: Sep. 11, 2007

(54) HIGH-STRENGTH HOT-DIP GALVANIZED STEEL SHEET AND HOT-DIP GALVANNEALED STEEL SHEET HAVING FATIGUE RESISTANCE CORROSION RESISTANCE DUCTILITY AND PLATING ADHESION AFTER SERVERE DEFORMATION AND A METHOD OF PRODUCING THE SAME

(75) Inventors: Nobuhiro Fujita, Futtsu (JP); Masafumi Azuma, Futtsu (JP); Manabu Takahashi, Futtsu (JP); Yasuhide Morimoto, Futtsu (JP); Masao Kurosaki, Kitakyushu (JP); Akihiro Miyasaka, Futtsu (JP)

(73) Assignee: Nippon Steel Corporation, Tokyo (JP)

( * ) Notice: Subject to any disclaimer, the term of this patent is extended or adjusted under 35 U.S.C. 154(b) by 167 days.

(21) Appl. No.: 10/479,916

(22) PCT Filed: Jun. 6, 2002

(86) PCT No.: PCT/JP02/05627

§ 371 (c)(1),
(2), (4) Date: Dec. 5, 2003

(87) PCT Pub. No.: WO02/101112

PCT Pub. Date: Dec. 19, 2002

(65) Prior Publication Data

US 2004/0202889 A1 Oct. 14, 2004

(30) Foreign Application Priority Data

| | | |
|---|---|---|
| Jun. 6, 2001 | (JP) | 2001-170857 |
| Jul. 12, 2001 | (JP) | 2001-211942 |
| Sep. 28, 2001 | (JP) | 2001-304034 |
| Sep. 28, 2001 | (JP) | 2001-304035 |
| Sep. 28, 2001 | (JP) | 2001-304036 |
| Sep. 28, 2001 | (JP) | 2001-304037 |
| May 7, 2002 | (JP) | 2002-131643 |

(51) Int. Cl.
*B32B 15/04* (2006.01)
*B32B 15/18* (2006.01)
*B32B 15/20* (2006.01)

(52) U.S. Cl. ..... 428/659; 428/939; 148/533

(58) Field of Classification Search ..... 428/659, 428/926, 939; 148/522, 533, 534, 540, 546, 148/547, 579
See application file for complete search history.

(56) References Cited

U.S. PATENT DOCUMENTS

| | | | | |
|---|---|---|---|---|
| 5,019,186 | A | 5/1991 | Kato et al. | 205/130 |
| 6,087,019 | A | 7/2000 | Isobe et al. | 428/472 |
| 6,312,536 | B1 * | 11/2001 | Omiya et al. | 148/533 |
| 6,586,117 | B2 * | 7/2003 | Nomura et al. | 428/659 |

FOREIGN PATENT DOCUMENTS

| | | | |
|---|---|---|---|
| EP | 0 434 874 | | 7/1991 |
| EP | 1 002 886 | * | 5/2000 |
| JP | 56-016625 | | 2/1981 |
| JP | 57-104657 | | 6/1982 |
| JP | 03-064441 | | 3/1991 |
| JP | 04-173945 | | 6/1992 |
| JP | 04-301060 | | 10/1992 |
| JP | 05-230608 | * | 9/1993 |
| JP | 07278772 A | | 10/1995 |
| JP | 09-041111 | | 2/1997 |
| JP | 09-087798 | | 3/1997 |
| JP | 10053851 A | | 2/1998 |
| JP | 10204580 A | | 4/1998 |
| JP | 11-189839 | | 7/1999 |
| JP | 2000-290745 | * | 10/2000 |
| JP | 2000290745 A | | 10/2000 |
| KR | 103310 | | 4/1996 |
| WO | WO93/11271 | | 6/1993 |

* cited by examiner

*Primary Examiner*—Michael E. Lavilla
(74) *Attorney, Agent, or Firm*—Kenyon & Kenyon LLP

(57) ABSTRACT

The present invention provides: a high-strength high-ductility hot-dip galvanized steel sheet and hot-dip galvannealed steel sheet having high fatigue resistance and corrosion resistance; a high-strength hot-dip galvanized steel sheet excellent in ductility, which improves non-plating defects and plating adhesion after severe deformation, and a method of producing the same; a high-strength and high-ductility hot-dip galvanized steel sheet having high fatigue resistance and corrosion resistance; a high-strength hot-dip galvanized steel sheet and hot-dip galvannealed steel sheet having superior appearance and workability, which suppresses the generation of non-plating defects, and a method of producing the same; and a high-strength hot-dip galvannealed steel sheet and a high-strength hot-dip galvanized steel sheet, which suppress non-plating defects and surface defects and have both corrosion resistance, in particular corrosion resistance in an environment containing chlorine ion, and high ductility, and a method of producing the same.

32 Claims, No Drawings

HIGH-STRENGTH HOT-DIP GALVANIZED STEEL SHEET AND HOT-DIP GALVANNEALED STEEL SHEET HAVING FATIGUE RESISTANCE CORROSION RESISTANCE DUCTILITY AND PLATING ADHESION AFTER SERVERE DEFORMATION AND A METHOD OF PRODUCING THE SAME

TECHNICAL FIELD

The present invention relates to a high-strength high-ductility hot-dip galvanized steel sheet and hot-dip galvannealed steel sheet, excellent in fatigue resistance and corrosion resistance suitable for building materials, household electric appliances and automobiles, and excellent in corrosion resistance and workability in an environment containing chloride ion, and a method of producing the same.

BACKGROUND ART

Hot-dip galvanizing is applied to steel sheets to provide at corrosion prevention and the hot-dip galvanized steel sheets and hot-dip galvannealed steel sheet are widely used in building materials, household electric appliances, automobiles, etc. As one of the production methods, Sendzimir processing is a method comprising the processes of, in a continuous line in order: degreasing cleaning; heating a steel sheet in a non-oxidizing atmosphere; annealing it in a reducing atmosphere containing $H_2$ and $N_2$; cooling it to a temperature close to the plating bath temperature; dipping it in a molten zinc bath; and cooling it or cooling it after forming an Fe—Zn alloy layer by reheating. The Sendzimir processing method is widely used for the treatment of steel sheets.

As for the annealing before the plating, a fully reducing furnace method is employed sometimes, wherein annealing is applied in a reducing atmosphere containing $H_2$ and $N_2$ immediately after degreasing cleaning, without taking the process of heating a steel sheet in a non-oxidizing atmosphere. Further, employed also is the flux method comprising the processes of: degreasing and pickling a steel sheet; then applying a flux treatment using ammonium chloride or the like; dipping the sheet in a plating bath; and then cooling the sheet.

In a plating bath used in those processing methods, a small amount of Al is added to deoxidize the molten zinc. In the Sendzimir method, a zinc plating bath contains about 0.1% of Al in mass. It is known that, as the Al in the bath has an affinity for Fe stronger than Fe—Zn, when a steel is dipped in the plating bath, an Fe—Al alloy layer, namely an Al concentrated layer, is generated and the reaction of Fe—Zn is suppressed. Due to the existence of an Al concentrated layer, the Al content in a plated layer obtained becomes generally higher than the Al content in a plating bath.

Recently, demands for a high strength plated steel sheet excellent in workability are increasing in view of an improvement in durability and a weight reduction of a car body intended to improve the fuel efficiency of an automobile. Si is added to a steel as an economical strengthening method and, in particular, a high-ductility high-strength steel sheet sometimes contains not less than 1% of Si in mass. Further, a high-strength steel contains various kinds of alloys and has severe restrictions in its heat treatment method from the viewpoint of securing high-strength by microstructure control.

Again, from the viewpoint of a plating operation, if the Si content in a steel exceeds 0.3% in mass, in the case of a conventional Sendzimir method which uses a plating bath containing Al, plating wettability deteriorates markedly and non-plating defects are generated resulting in the deterioration of appearance. It is said that the above drawback is caused by the concentration of Si oxides on a steel sheet surface during the reducing annealing and the poor wettability between the Si oxides and molten zinc.

In case of a high-strength steel sheet, the added elements are abundant as explained above, and therefore the alloying heat treatment after plating is apt to be applied at a higher temperature and for a longer time than in the case of a mild steel. This is one of the obstacles to securing good material quality.

Further, from the viewpoint of an improvement in the durability of a structural member, fatigue resistance, in addition to corrosion resistance, is also important. That is, it is important to develop a high-strength steel sheet having good plating producibility, good fatigue resistance and good corrosion resistance simultaneously.

As a means of solving the problems, Japanese Unexamined Patent Publication Nos. H3-28359 and H3-64437 disclose a method of improving plating performances by applying a specific plating. However, this method has a problem that the method requires either the installation of a new plating apparatus in front of the annealing furnace in a hot-dip plating line or an additional preceding plating treatment in an electroplating line, and this increases the costs. Further, with regard to fatigue resistance and corrosion resistance, though it has recently been disclosed that the addition of Cu is effective, the compatibility with corrosion resistance is not described at all.

Further, Si scale defects generated at the hot-rolling process cause the deterioration of plating appearance at subsequent processes. The reduction of Si content in a steel is essential to suppress the Si scale defects, but, in the case of a retained austenite steel sheet or of a dual phase steel sheet which is a typical high ductility type high-strength steel sheet, Si is an additive element extremely effective in improving the balance between strength and ductility. To cope with this problem, a method of controlling the morphology of generated oxides by controlling the atmosphere of annealing or the like is disclosed. However, the method requires special equipment and thus entails a new equipment cost.

Yet further, when high-strength steel sheets are adopted for the purpose of achieving weight reduction by the reduction of the sheet thickness and the thinning of the steel sheets proceeds, more enhanced corrosion resistance may sometimes be required of even hot-dip galvanized steel sheets or hot-dip galvannealed steel sheets. For instance, an environment where rock salt is sprayed as a snow melting agent is a severe environment because it contains a comparatively large amount of $Cl^-$ ions. In the case where a plated layer exfoliates locally at the portions which are subjected to heavy working or the plated layer itself has insufficient corrosion resistance, a base material with excellent corrosion resistance and the formation of a plated layer with excellent corrosion resistance are required.

A steel sheet, which allows weight and thickness reduction and is prepared taking into consideration strengthening, the problems related to Si and improvement in corrosion resistance, has not been developed.

Yet further, while aiming at improving the producibility in plating a high-strength steel sheet, Japanese Unexamined Patent Publication No. H5-230608 discloses a hot-dip galvanized steel sheet having a Zn—Al—Mn—Fe system plated layer. However, though this invention particularly takes the producibility into consideration, it is not such an invention that takes the plating adhesiveness into consideration when a high-strength high-ductility material is subjected to a heavy working.

Furthermore, aiming at enhancing the collision energy absorbing capability, Japanese Unexamined Patent Publication No. H11-189839 discloses a steel sheet: having the main phase comprising ferrite and the average grain size of the main phase being not more than 10 μm; having the second phase comprising austenite 3 to 50% in volume or martensite 3 to 30% in volume and the average grain size of the second phase being not more than 5 μm; and containing bainite selectively. However, this invention does not take plating wettability into consideration and does not provide the corrosion resistance which allows thickness reduction accompanying increased strength.

DISCLOSURE OF THE INVENTION

The present invention provides a high-strength galvanized and galvannealed steels sheet which solve the above-mentioned problems, is excellent in appearance and workability, improves non-plating defects and plating adhesion after severe deformation, and is excellent in ductility, and a method of producing the same and, further, it provides a high-strength high-ductility hot-dip galvanized steel sheet and a high-strength high-ductility galvannealed steel sheet which are excellent in corrosion resistance and fatigue resistance, and a method of producing the same.

Further, the object of the present invention is to provide a high-strength hot-dip galvanized steel sheet and a high-strength hot-dip galvannealed steel sheet which solve the above-mentioned problems, suppress non-plating defects and surface defects, and have corrosion resistance and high ductility, simultaneously, in an environment particularly containing chlorine ion, and a method of producing the same.

The present inventors, as a result of various studies, have found that it is possible to produce galvanized and galvannealed steel sheets having good workability even when heat treatment conditions were mitigated and simultaneously improving corrosion resistance and fatigue resistance of a high-strength steel sheet, by regulating the microstructure of the interface (hereafter referred to as "plated layer/base layer interface") between a plated layer and a base layer (steel layer). Further, they also found that the wettability of molten zinc plating on a high-strength steel sheet is improved by making the plated layer contain specific elements in an appropriate amount. Yet further, they found that the above effects were heightened by reducing the concentration of Al in a plated layer, and that a very good plated layer could be obtained even in the case of a high-strength steel sheet containing alloying elements in relatively large amount, by controlling Si content: X (in mass %), Mn content: Y (in mass %) and Al content: Z (in mass %) in the steel sheet, and also Al content: A (in mass %) and Mn content: B (in mass %) in the plated layer so as to satisfy the following equation 1:

$$3-(X+Y/10+Z/3)-12.5\times(A-B)\geqq 0 \quad (1)$$

Furthermore, they found that a steel sheet having high ductility could be produced even when the heat treatment conditions were relieved, by adding alloying elements selectively and in an appropriate amount and, in addition, by regulating the microstructure of the steel sheet.

The present inventors, as a result of various studies, found that, in case of a high-strength steel sheet, the wettability in hot-dip galvanizing was improved, and the alloying reaction in alloying plating was accelerated, by making the plated layer contain specific elements in an appropriate amount and by combining them with the components of the steel sheet. The effect can be achieved mainly by controlling the concentration of Al in the plated layer and that of Mn in the steel.

They found that a very good plated layer could be obtained by controlling Mn content: X (in mass %) and Si content: Y (in mass %) in a steel, and Al content: Z (in mass %) in a plated layer so as to satisfy the following equation 2.

$$0.6-(X/18+Y+Z)\geqq 0 \quad (2)$$

The present inventors, as a result of various studies, found that, in case of a high-strength steel sheet, the wettability in hot-dip galvanizing and hot-dip galvannealing was improved, the alloying reaction in alloy plating was accelerated, and also ductility and corrosion resistance were improved, by making the plated layer contain specific elements in an appropriate amount and by combining them with the components of the steel sheet. The effect can be achieved mainly by controlling the concentrations of Al and Mo in the plated layer and that of Mo in the steel.

That is, they found that a high-strength high-ductility hot-dip galvannealed coated steel sheet could be obtained by containing 0.001 to 4% of Al in mass in the plated layer and, in addition, by controlling Al content: A (in mass %) and Mo content: B (in mass %) in the plated layer, and Mo content: C (in mass %) in the steel so as to satisfy the following equation 3:

$$100\geqq(A/3+B/6)/(C/6)\geqq 0.01 \quad (3)$$

The present invention has been accomplished based on the above findings and the gist of the present invention is as follows:

(1) A high-strength high-ductility hot-dip galvanized steel sheet and hot-dip galvannealed steel sheet having high fatigue resistance and corrosion resistance, the hot-dip galvanized or galvannealed steel sheet having a plated layer on the surface of the base layer consisting of a steel sheet, characterized in that the maximum depth of the grain boundary oxidized layer formed at the interface between the plated layer and the base layer is not more than 0.5 μm.

(2) A high-strength high-ductility hot-dip galvanized steel sheet and hot-dip galvannealed steel sheet having high fatigue resistance and corrosion resistance, the hot-dip galvanized or galvannealed steel sheet having a plated layer on the surface of the base layer consisting of a steel sheet, characterized in that the maximum depth of the grain boundary oxidized layer at the interface between the plated layer and the base layer is not more than 1 μm and the average grain size of the main phase in the microstructure of the base layer is not more than 20 μm.

(3) A high-strength high-ductility hot-dip galvanized steel sheet and hot-dip galvannealed steel sheet having high fatigue resistance and corrosion resistance, the hot-dip galvanized or galvannealed steel sheet having a plated layer on the surface of the base layer consisting of a steel sheet, according to the item (1) or (2), characterized in that the value obtained by dividing the maximum depth of the grain boundary oxidized layer formed at the interface between the plated layer and the base layer by the average grain size of the main phase in the microstructure of the base layer is not more than 0.1.

(4) A high-strength high-ductility hot-dip galvanized steel sheet and hot-dip galvannealed steel sheet having high fatigue resistance and corrosion resistance according to any one of the items (1) to (3), characterized in that the steel sheet contains, in its microstructure, ferrite or ferrite and bainite 50 to 97% in volume as the main phase, and either or both of martensite and austenite 3 to 50% in total volume as the second phase.

(5) A high-strength high-ductility hot-dip galvanized steel sheet and hot-dip galvannealed steel sheet having high fatigue resistance and corrosion resistance according to any one of the items (1) to (4), characterized in that: the plated layer contains, in mass, Al: 0.001 to 0.5%, and Mn: 0.001 to 2%, with the balance consisting of Zn and unavoidable impurities; and Si content: X (in mass %), Mn content: Y (in mass %) and Al content: Z (in mass %) in the steel sheet, and Al content: A (in mass %) and Mn content: B (in mass %) in the plated layer satisfy the following equation 1:

$$3-(X+Y/10+Z/3)-12.5\times(A-B)\geqq 0 \quad 1$$

(6) A high-strength high-ductility hot-dip galvannealed steel sheet having high fatigue resistance and corrosion resistance according to the item (5), characterized in that the plated layer contains Fe at 5 to 20% in mass.

(7) A high-strength hot-dip galvanized steel sheet having high plating adhesion after severe deformation and ductility, the hot-dip galvanized steel sheet having a plated layer containing, in mass, Al: 0.001 to 0.5%, and Mn: 0.001 to 2%, with the balance consisting of Zn and unavoidable impurities, on the surface of a steel sheet consisting of, in mass, C: 0.0001 to 0.3%, Si: 0.01 to 2.5%, Mn: 0.01 to 3%, Al: 0.001 to 4%, and the balance consisting of Fe and unavoidable impurities, characterized in that: Si content: X (in mass %), Mn content: Y (in mass %) and Al content: Z (in mass %) in the steel, and Al content: A (in mass %) and Mn content: B (in mass %) in the plated layer satisfy the following equation 1; and the microstructure of the steel sheet has the main phase comprising ferrite at 70 to 97% in volume and the average grain size of a main phase is not more than 20 μm, and a second phase comprising austenite and/or martensite at 3 to 30% in volume and the average grain size of the second phase being not more than 10 μm:

$$3-(X+Y/10+Z/3)-12.5\times(A-B)\geqq 0 \quad 1$$

(8) A high-strength hot-dip galvannealed steel sheet having high plating adhesion after severe deformation and ductility according to the item (7), characterized in that the plated layer further contains Fe at 5 to 20% in mass.

(9) A high-strength hot-dip galvanized steel sheet and hot-dip galvannealed steel sheet having plating adhesion after severe deformation and ductility according to the item (7) or (8), characterized in that the average grain size of austenite and/or martensite which constitute(s) the second phase of the steel sheet is 0.01 to 0.7 times the average grain size of ferrite.

(10) A high-strength hot-dip galvanized steel sheet and hot-dip galvannealed steel sheet having plating adhesion after severe deformation and ductility according to any one of the items (7) to (9), characterized in that the microstructure of the steel sheet: has a main phase comprising ferrite at 50 to 95% in volume and the average grain size of the main phase being not more than 20 μm, and a second phase comprising austenite and/or martensite at 3 to 30% in volume and the average grain size of the second phase being not more than 10 μm; and further contains bainite at 2 to 47% in volume.

(11) A high-strength hot-dip galvanized steel sheet and hot-dip galvannealed steel sheet having plating adhesion after severe deformation and ductility according to any one of the items (7) to (10), characterized in that the steel further contains Mo at 0.001 to 5% in mass.

(12) A high-strength hot-dip galvanized steel sheet and hot-dip galvannealed steel sheet having plating adhesion after severe deformation and ductility according to any one of the items (7) to (11), characterized in that the steel further contains P at 0.0001 to 0.1% and S at 0.0001 to 0.01%, in mass.

(13) A high-strength hot-dip galvanized steel sheet and hot-dip galvannealed steel sheet having high fatigue resistance and corrosion resistance according to any one of the items (7) to (12), characterized in that the Si content in the steel is 0.001 to 2.5%.

(14) A high-strength hot-dip galvannealed steel sheet having superior appearance and workability, the hot-dip galvannealed steel sheet having a plated layer containing, in mass, Mn: 0.001 to 3%, Al: 0.001 to 4%, Mo: 0.0001 to 1%, and Fe: 5 to 20%, with the balance consisting of Zn and unavoidable impurities, on the surface of a steel sheet consisting of, in mass, C: 0.0001 to 0.3%, Si: 0.001 to less than 0.1%, Mn: 0.01 to 3%, Al: 0.001 to 4%, Mo: 0.001 to 1%, P: 0.0001 to 0.3%, S: 0.0001 to 0.1%, and the balance consisting of Fe and unavoidable impurities, characterized in that: Mn content: X (in mass %) and Si content: Y (in mass %) in the steel, and Al content: Z (in mass %) in the plated layer satisfy the following equation 2:

$$0.6-(X/18+Y+Z)\geqq 2 \quad 2$$

(15) A high-strength hot-dip galvanized steel sheet having superior appearance and workability, the hot-dip galvanized steel sheet having a plated layer containing, in mass, Mn: 0.001 to 3%, Al: 0.001 to 4%, Mo: 0.0001 to 1%, and Fe: less than 5%, with the balance consisting of Zn and unavoidable impurities, on the surface of a steel sheet consisting of, in mass, C: 0.0001 to 0.3%, Si: 0.001 to less than 0.1%, Mn: 0.01 to 3%, Al: 0.001 to 4%, Mo: 0.001 to 1%, P: 0.0001 to 0.3%, S: 0.0001 to 0.1%, and the balance consisting of Fe and unavoidable impurities, characterized in that: Mn content: X (in mass %) and Si content: Y (in mass %) in the steel, and Al content: Z (in mass %) in the plated layer satisfy the following equation 2:

$$0.6-(X/18+Y+Z)\geqq 0 \quad (2)$$

(16) A high-strength high-ductility hot-dip galvannealed steel sheet having high corrosion resistance, the hot-dip galvannealed steel sheet having a plated layer containing, in mass, Al: 0.001 to 4%, and Fe: 5 to 20%, with the balance consisting of Zn and unavoidable impurities, on the surface of a steel sheet consisting of, in mass, C: 0.0001 to 0.3%, Si: 0.001 to less than 0.1%, Mn: 0.001 to 3%, Al: 0.001 to 4%, Mo: 0.001 to 1%, P: 0.001 to 0.3%, S: 0.0001 to 0.1%, and the balance consisting of Fe and unavoidable impurities, characterized in that: Al content: A (in mass %) and Mo content: B (in mass %) in the plated layer, and Mo content: C (in mass %) in the steel satisfy the following equation 3; and the microstructure of the steel consists of the main phase comprising ferrite or ferrite and bainite 50 to 97% in volume and the balance consisting of a complex structure containing either or both of martensite and retained austenite 3 to 50% in volume:

$$100\geqq(A/3+B/6)/(C/6)\geqq 0.01 \quad (3)$$

(17) A high-strength high-ductility hot-dip galvanized steel sheet having high corrosion resistance, the hot-dip galvanized steel sheet having a plated layer containing, in mass, Al: 0.001 to 4%, and Fe: less than 5%, with the balance consisting of Zn and unavoidable impurities, on the surface of a steel sheet consisting of, in mass, C: 0.0001 to 0.3%, Si: 0.001 to less than 0.1%, Mn: 0.001 to 3%, Al: 0.001 to 4%, Mo: 0.001 to 1%, P: 0.001 to 0.3%, S: 0.0001 to 0.1%, and the balance consisting of Fe and unavoidable impurities, characterized in that: Al content: A (in mass %) and Mo content: B (in mass %) in the plated layer, and Mo content: C (in mass %) in the steel satisfy the following equation 3; and the microstructure of the steel consists of the main phase comprising ferrite or ferrite and bainite 50 to 97% in volume and the balance consisting of a complex structure containing either or both of martensite and retained austenite at 3 to 50% in volume:

$$100\geqq(A/3+B/6)/(C/6)\geqq 0.01 \quad (3)$$

(18) A high-strength hot-dip galvanized steel sheet and hot-dip galvannealed steel sheet having superior appearance and workability according to any one of the items (14) to (17), characterized in that the microstructure of the steel consists of the main phase comprising ferrite or ferrite and bainite at 50 to 97% in volume and the balance consisting of a complex structure containing either or both of martensite and retained austenite at 3 to 50% in total volume.

(19) A high-strength hot-dip galvanized steel sheet and hot-dip galvannealed steel sheet having superior appearance and workability according to any one of the items (14) to (18), characterized in that the microstructure of the steel sheet has a main phase comprising ferrite at 70 to 97% in volume and the average grain size of the main phase being not more than 20 μm, and a second phase comprising austenite and/or martensite at 3 to 30% in volume and the average grain size of the second phase being not more than 10 μm.

(20) A high-strength hot-dip galvanized steel sheet and hot-dip galvannealed steel sheet having superior appearance and workability according to any one of the items (14) to (19), characterized in that: the second phase of the steel sheet is composed of austenite; and C content: C (in mass %) and Mn content: Mn (in mass %) in the steel, and the volume percentage of austenite: Vγ (in %) and the volume percentage of ferrite and bainite: Vα (in %) satisfy the following equation 4:

$$(V\gamma+V\alpha)/V\gamma\times C+Mn/8\geqq 2.0 \quad (4)$$

(21) A high-strength hot-dip galvanized steel sheet and hot-dip galvannealed steel sheet having superior appearance and workability according to any one of the items (14) to (20), characterized in that the microstructure of the steel sheet: has a main phase comprising ferrite at 50 to 95% in volume and the average grain size of the main phase being not more than 20 μm, and a second phase comprising austenite and/or martensite at 3 to 30% in volume and the average grain size of the second phase being not more than 10 μm; and further contains bainite at 2 to 47% in volume.

(22) A high-strength high-ductility hot-dip galvanized steel sheet and hot-dip galvannealed steel sheet having high corrosion resistance according to any one of the items (14) to (21), characterized in that the average grain size of austenite and/or martensite which constitute(s) the second phase of the steel sheet is 0.01 to 0.6 times the average grain size of ferrite.

(23) A high-strength hot-dip galvanized steel sheet having high plating adhesion after severe deformation and ductility according to any one of the items (1) to (22), characterized in that the plated layer further contains, in mass, one or more of, Ca: 0.001 to 0.1%, Mg: 0.001 to 3%, Si: 0.001 to 0.1%, Mo: 0.001 to 0.1%, W: 0.001 to 0.1%, Zr: 0.001 to 0.1%, Cs: 0.001 to 0.1%, Rb: 0.001 to 0.1%, K: 0.001 to 0.1%, Ag: 0.001 to 5%, Na: 0.001 to 0.05%, Cd: 0.001 to 3%, Cu: 0.001 to 3%, Ni: 0.001 to 0.5%, Co: 0.001 to 1%, La: 0.001 to 0.1%, Tl: 0.001 to 8%, Nd: 0.001 to 0.1%, Y: 0.001 to 0.1%, In: 0.001 to 5%, Be: 0.001 to 0.1%, Cr: 0.001 to 0.05%, Pb: 0.001 to 1%,
Hf: 0.001 to 0.1%,
Tc: 0.001 to 0.1%,
Ti: 0.001 to 0.1%,
Ge: 0.001 to 5%,
Ta: 0.001 to 0.1%,
V: 0.001 to 0.2%, and
B: 0.001 to 0.1%.

(24) A high-strength hot-dip galvanized steel sheet and hot-dip galvannealed steel sheet having superior appearance and workability according to any one of the items (1) to (23), characterized in that the steel further contains, in mass, one or more of, Cr: 0.001 to 25%,
Ni: 0.001 to 10%,
Cu: 0.001 to 5%,
Co: 0.001 to 5%, and
W: 0.001 to 5%.

(25) A high-strength hot-dip galvanized steel sheet and hot-dip galvannealed steel sheet having superior appearance and workability according to any one of the items (1) to (24), characterized in that the steel further contains, in mass, one or more of Nb, Ti, V, Zr, Hf and Ta at 0.001 to 1% in total.

(26) A high-strength hot-dip galvanized steel sheet and hot-dip galvannealed steel sheet having superior appearance and workability according to any one of the items (1) to (25), characterized in that the steel yet further contains B at 0.0001 to 0.1% in mass.

(27) A high-strength hot-dip galvanized steel sheet and hot-dip galvannealed steel sheet having superior appearance and workability according to any one of the items (1) to (26), characterized in that the steel yet further contains one or more of Y, Rem, Ca, Mg and Ce at 0.0001 to 1% in mass.

(28) A high-strength high-ductility hot-dip galvanized steel sheet and hot-dip galvannealed steel sheet having high fatigue resistance and corrosion resistance according to any one of the items (1) to (27), characterized in that: the steel contains one or more of $SiO_2$, MnO and $Al_2O_3$ at 0.1 to 70% in total area percentage in the range from the interface between the plated layer and the steel sheet to the depth of 10 μm; and the following equation 5 is satisfied:

$$\{\text{MnO (in area percentage)}+Al_2O_3\text{ (in area percentage)}\}/SiO_2\text{ (in area percentage)} \geqq 0.1 \quad (5)$$

(29) A high-strength high-ductility hot-dip galvanized steel sheet and hot-dip galvannealed steel sheet having high fatigue resistance and corrosion resistance according to any one of the items (1) to (28), characterized in that the steel contains one or more of $Y_2O_3$, $ZrO_2$, $HfO_2$, $TiO_3$, $La_2O_3$, $Ce_2O_3$, $CeO_2$, CaO and MgO at 0.0001 to 10.0% in total area percentage in the range from the interface between the plated layer and the steel sheet to the depth of 10 μm.

(30) A method of producing a high-strength hot-dip galvanized steel sheet and hot-dip galvannealed steel sheet having high plating adhesion after severe deformation and ductility, characterized by: casting a steel comprising the chemical components according to any one of the items (1) to (29) or once cooling the cast slab after the casting; then heating the cast slab again; thereafter, hot-rolling the cast slab into a hot-rolled steel sheet and coiling it, and then pickling and cold-rolling the hot-rolled steel sheet; thereafter, annealing the cold-rolled steel sheet for 10 seconds to 30 minutes in the temperature range from not less than $0.1\times(Ac_3-Ac_1)+Ac_1$ (° C.) to not more than $Ac_3+50$ (° C.); then cooling the steel sheet to the temperature range from 650 to 700° C. at a cooling rate of 0.1 to 10° C./sec.; thereafter, cooling the steel sheet to the temperature range from the plating bath temperature to the plating bath temperature +100° C. at a cooling rate of 1 to 100° C./sec.; keeping the steel sheet in the temperature range from the zinc plating bath temperature to the zinc plating bath temperature +100° C. for 1 to 3,000 seconds including the subsequent dipping time; dipping the steel sheet in the zinc plating bath; and, after that, cooling the steel sheet to room temperature.

(31) A method of producing a high-strength hot-dip galvanized steel sheet and hot-dip galvannealed steel sheet according to any one of the items (1) to (29), which hot-dip galvanized steel sheet being excellent in appearance and workability, characterized by: casting a steel comprising the chemical components according to any one of the items (1) to (29) or once cooling the cast slab after the casting; then heating the cast slab again to a temperature of 1,180 to 1,250° C.; finishing the hot-rolling at a temperature of 880 to 1,100° C.; then pickling and cold-rolling the coiled hot-rolled steel sheet; thereafter, annealing the cold-rolled steel sheet for 10 seconds to 30 minutes in the temperature range from not less than $0.1\times(Ac_3-Ac_1)+Ac_1$ (° C.) to not more than $Ac_3+50$ (° C.); then cooling the steel sheet to the temperature range from 650 to 700° C. at a cooling rate of 0.1 to 10° C./sec.; thereafter, cooling the steel sheet to the temperature range from the plating bath temperature −50° C. to the plating bath temperature +50° C. at a cooling rate of 0.1 to 100° C./sec.; then dipping the steel sheet in the plating bath; keeping the steel sheet in the temperature range from the plating bath temperature −50° C. to the plating bath temperature +50° C. for 2 to 200 seconds including the dipping time; and, thereafter, cooling the steel sheet to room temperature.

(32) A method of producing a high-strength high-ductility hot-dip galvanized steel sheet and hot-dip galvannealed steel sheet according to any one of the items (1) to (29), the hot-dip galvanized steel sheet being excellent in corrosion resistance, characterized by: casting a steel comprising the chemical components according to any one of the items (1) to (29) or once cooling the cast slab after the casting; then heating the cast slab again to a temperature of 1,200 to 1,300° C.; then rough-rolling the heated slab at the total reduction rate of 60 to 99% and at a temperature of 1,000 to 1,150° C.; then pickling and cold-rolling the finished and coiled hot-rolled steel sheet; thereafter, annealing the cold-rolled steel sheet for 10 seconds to 30 minutes in the temperature range from not less than $0.12\times(Ac_3-Ac_1)+Ac_1$(° C.) to not more than $Ac_3+50$ (° C.); then, after the annealing, cooling the steel sheet, when the highest attained temperature during annealing is defined as Tmax (° C.), to the temperature range from Tmax−200° C. to Tmax−100° C. at a cooling rate of Tmax/1,000 to Tmax/10° C./sec.; thereafter, cooling the steel sheet to the temperature range from the plating bath temperature −30° C. to the plating bath temperature +50° C. at a cooling rate of 0.1 to 100° C./sec.; then dipping the steel sheet in the plating bath; keeping the steel sheet in the temperature range from the plating bath temperature −30° C. to the plating bath temperature +50° C. for 2 to 200 seconds including the dipping time; and, thereafter, cooling the steel sheet to room temperature.

(33) A method of producing a high-strength high-ductility hot-dip galvanized steel sheet and hot-dip galvannealed steel sheet having high fatigue resistance and corrosion resistance, characterized by: casting a steel comprising the chemical components according to any one of the items (1) to (29) or once cooling the cast slab after the casting; then heating the cast slab again; thereafter, hot-rolling the cast slab into a hot-rolled steel sheet and coiling it, and then pickling and cold-rolling the hot-rolled steel sheet; thereafter, annealing the cold-rolled steel sheet controlling the annealing temperature so that the highest temperature during annealing may fall within the range from not less than $0.1\times(Ac_3-Ac_1)+Ac_1$ (° C.) to not more than $Ac_3-30$ (° C.); then cooling the steel sheet to the temperature range from 650 to 710° C. at a cooling rate of 0.1 to 10° C./sec.; thereafter, cooling the steel sheet to the temperature range from the zinc plating bath temperature to the zinc plating bath temperature +100° C. at a cooling rate of 1 to 100° C./sec.; keeping the steel sheet in the temperature range from the zinc plating bath temperature to the zinc plating bath temperature +100° C. for 1 to 3,000 seconds including the subsequent dipping time; dipping the steel sheet in the zinc plating bath; and, after that, cooling the steel sheet to room temperature.

(34) A high-strength hot-dip galvanized steel sheet and hot-dip galvannealed steel sheet having high fatigue resistance, corrosion resistance, and plating adhesion after severe deformation and ductility and a method of producing the same, according to any one of the items (30) to (33), characterized by: after dipping the steel sheet in the zinc plating bath, applying an alloying treatment to the steel sheet at a temperature of 300 to 550° C. and cooling it to room temperature.

BEST MODE FOR CARRYING OUT THE INVENTION

The present invention will be explained in detail hereunder.

Embodiment 1

The present inventors subjected a steel sheet, which consisted of, in mass, 0.0001 to 0.3% of C, 0.001 to 2.5% of Si, 0.01 to 3% of Mn, 0.001 to 4% of Al and the balance consisting of Fe and unavoidable impurities, to the processes of: annealing the steel sheet for 10 seconds to 30 minutes in the temperature range from not less than $0.1\times(Ac_3-Ac1)+Ac_1$ (° C.) to not more than $Ac_3+50$ (° C.); then cooling the steel sheet to the temperature range from 650 to 700° C. at a cooling rate of 0.1 to 10° C./sec.; thereafter, cooling the steel sheet to the temperature range from the plating bath temperature (450 to 470° C.) to the plating bath temperature +100° C. at a cooling rate of 1 to 100° C./sec.; dipping the steel sheet in the zinc plating bath at a temperature of 450 to 470° C. for 3 seconds; and heating the steel sheet at a temperature of 500 to 550° C. for 10 to 60 seconds.

Thereafter, a plating property was evaluated by measuring the area of non-plated portions on the surface of the plated steel sheet. Corrosion resistance was evaluated by applying a repeated salt spray test. Further, mechanical properties were evaluated by a tensile test, and the fatigue property of the plated steel sheet was evaluated by a plane bending fatigue test applying a stress corresponding to 50% of the tensile strength of the steel sheet.

Further, plating adhesion was evaluated by applying 60° bending and bending-back forming to the steel sheet after giving 20% tensile strain, sticking a vinyl tape to the portion where bending forming was applied and peeling it off, and then quantifying the area where the plated layer was peeled off by image analysis.

As a result, Si system oxides, in particular, were observed abundantly at the crystal grain boundaries of the interface between the plated layer and the base layer, and the present inventors found that a high-strength high-ductility hot-dip galvanized steel sheet excellent in fatigue resistance and corrosion resistance could be produced by controlling the maximum depth of the grain boundary oxidized layer and the average grain size of the main phase in the finally obtained microstructure with regard to the relation between the shape of the grain boundary oxidized layer and the fatigue property.

That is, the present inventors found that the fatigue life of a hot-dip galvanized steel sheet could be prolonged by controlling the maximum depth of the grain boundary oxidized layer containing Si to 0.5 μ m or less in the finally obtained microstructure at the interface between the plated layer and the base layer. Furthermore, the fatigue life of a hot-dip galvanized steel sheet can be further prolonged by selecting the steel components and the production conditions which allow the maximum depth of the grain boundary oxidized layer to be 0.5 μm or less, preferably 0.2 μm or less.

Further, the present inventors found that corrosion resistance and fatigue resistance particularly after an alloying treatment could be further improved by restricting the kinds and area percentage of oxides in a steel, which contained grain boundary oxides, in the range from the interface between the plated layer and the steel sheet to the depth of 10 μm. That is, a high-strength high-ductility hot-dip galvanized or galvannealed steel sheet excellent in corrosion resistance and fatigue resistance can be obtained: by making the steel contain one or more of $SiO_2$, MnO and $Al_2O_3$, as oxides, at 0.4 to 70% in total area percentage in the range from the interface between the plated layer and the steel sheet to the depth of 10 μm; and by controlling those area percentages so as to satisfy the following expression:

$$\{\text{MnO (in area percentage)}+Al_2O_3\text{ (in area percentage)}\}/SiO_2\text{ (in area percentage)}\geqq 0.1.$$

The present inventors also found that corrosion resistance and fatigue resistance after an alloying treatment could also be improved by making a steel contain, in addition to $SiO_2$, MnO and $Al_2O_3$, one or more of $Y_2O_3$, $ZrO_2$, $HfO_2$, $TiO_2$, $La_2O_3$, $Ce_2O_3$, $CeO_2$, CaO and MgO by 0.0001 to 10.0% in total area percentage in the range from the interface between the plated layer and the steel sheet to the depth of 10 μm.

Here, the identification, observation and area percentage measurement of oxides existing in a steel in the range from the interface between the plated layer and the steel sheet to the depth of 10 μm as stated above can be carried out by using EPMA, FE-SEM and the like. In the present invention, the area percentage was obtained by measuring the area in more than 50 visual fields under the magnification of 2,000 to 20,000 and then analyzing the data using image analysis. The identification of oxides was carried out by preparing an extracted replica specimen and using TEM or EBSP. MnO, $Al_2O_3$ and $SiO_2$ described above were distinguished by finding the most similar objects using element analysis and structure identification, though sometimes there were cases where objects were complex oxides containing other atoms or had a structure containing many defects. The area percentage can be obtained by the area scanning of each component using EPMA, FE-SEM and the like. In this case, though precise identification of each structure is difficult, the judgement can be done from the shape and the organization together with the above-mentioned structural analysis. Thereafter, each area percentage can be obtained by the image analysis of the data obtained from the area scanning.

The present inventors found that the fatigue life could be prolonged likewise by controlling the average grain size of the main phase in a steel sheet to not more than 20 μm and the maximum depth of the grain boundary oxidized layer at the interface between the plated layer and the base layer to not more than 1 μm into the microstructure. Further, they found that a high-strength high-ductility hot-dip galvanized steel sheet and hot-dip galvannealed steel sheet having high fatigue resistance and corrosion resistance could be obtained by controlling the value obtained by dividing the maximum depth of the grain boundary oxidized layer formed at the interface between the plated layer and the base layer by the average grain size of the main phase to not more than 0.1 in the microstructure of the steel sheet.

Further, with regard to plating property and corrosion resistance, it was found that non-plating defects were not formed and rust formation in a repeated salt spray test was extremely small even in the case of a steel sheet particularly containing abundant Si as long as Si content: X (in mass %), Mn content: Y (in mass %) and Al content: Z (in mass %) in the steel sheet, and Al content: A (in mass %) and Mn content: B (in mass %) in the plated layer satisfy the following equation 1:

$$3-(X+Y/10+Z/3)-12.5\times(A-B)\geqq 0 \quad (1)$$

The equation 1 is newly found from multiple regression analysis of the data showing the influence of the components in a steel sheet and a plated layer on plating wettability.

Here, the components in a plated layer are defined to be a value measured by chemical analysis after the plated layer is dissolved with 5% hydrochloric acid solution containing an inhibitor.

Embodiment 2

The present inventors subjected a steel sheet consisting of, in mass,

C: 0.0001 to 0.3%,
Si: 0.001 to less than 0.1%,
Mn: 0.01 to 3%,
Al: 0.001 to 4%,
Mo: 0.001 to 1%,
P: 0.0001 to 0.3%,
S: 0.0001 to 0.1%, and the balance consisting of Fe and unavoidable impurities, to the processes of: annealing the steel sheet; dipping the steel sheet in the zinc plating bath at a temperature of 450 to 470° C. for 3 seconds; and further heating some of the specimens for 10 to 60 seconds at a temperature of 500 to 530° C. Thereafter, the appearance was evaluated by classifying the incidence of defects on the surface of the plated steel sheet into five ranks. Mechanical properties were also evaluated using a tensile test. As a result, it was found that evaluation rank 5, which meant appearance defects were scarcely observed, could be obtained when Mn content in the steel was defined as X (in mass %), Si content in the steel as Y (in mass %), and Al content in the plated layer as Z (in mass %), and X, Y and Z satisfied the following equation 2:

$$0.6-(X/18+Y+Z)\geqq 0 \quad (2)$$

The appearance of a plated steel sheet was evaluated by visually observing the state of the formation of non-plating defects and the state of the formation of flaws and patterns and classifying them into the evaluation ranks 1 to 5. The criteria of the evaluation are as follows:

Evaluation rank 5: non-plating defects, flaws and patterns are scarcely observed (not more than 1% in area percentage), Evaluation rank 4: non-plating defects, flaws and patterns are trivial (more than 1% to not more than 10% in area percentage), Evaluation rank 3: non-plating defects, flaws and patterns are few (more than 10% to not more than 50% in area percentage), Evaluation rank 2: non-plating defects, flaws and patterns are plentiful (more than 50% in area percentage), Evaluation rank 1: plating does not wet a steel sheet surface.

Embodiment 3

The present inventors subjected a steel sheet consisting of, in mass,

C: 0.0001 to 0.3%,
Si: 0.001 to less than 0.1%,
Mn: 0.01 to 3%,
Al: 0.001 to 4%,
Mo: 0.001 to 1%,
P: 0.0001 to 0.3%,
S: 0.0001 to 0.1%, and the balance consisting of Fe and unavoidable impurities, to the processes of: annealing the steel sheet; dipping the steel sheet in the zinc plating bath at a temperature of 450 to 470° C. for 3 seconds; and further heating some of the specimens for 10 to 60 seconds at a temperature of 500 to 550° C. Thereafter, the steel sheet was subjected to full flat bending (R=1t), and the bent specimen was subjected to a cyclic corrosion test of up to 150 cycles based on the standard (JASO) of the Society of Automotive Engineers of Japan, Inc. (JSAE). The state of corrosion was evaluated by observing the surface appearance and cross-sectional appearance in not less than 20 visual fields using an optical microscope under the magnification of 200 to 1,000, observing the degree of the progress of the corrosion into the inside, and classifying the observation results into five ranks. The criteria of the evaluation are as follows:

Evaluation rank 5: degree of progress of corrosion: only the plated layer corrodes or the depth of corrosion in the base material is less than 50 μm, Evaluation rank 4: degree of progress of corrosion: the depth of corrosion in the base material is 50 μm to less than 100 μm, Evaluation rank 3: degree of progress of corrosion: the depth of corrosion in the base material is less than the half of the sheet thickness, Evaluation rank 2: degree of progress of corrosion: the depth of corrosion in the base material is not less than the half of the sheet thickness, Evaluation rank 1: perforation.

As a result, it was found that good corrosion resistance of evaluation rank 4 or 5 was secured when Al content in the plated layer was in the range from 0.001 to 4% and defined as A (in mass %), Mo content in the plated layer was defined as B (in mass %), and Mo content in the steel as C (in mass %), and A, B and C satisfied the following equation 3:

$$100\geqq(A/3+B/6)/(C/6)\geqq 0.01 \quad (3)$$

The detailed reason why the generation of non-plating defects is suppressed is not always clear, but it is estimated that non-plating defects are generated because the wettability between Al added in a plating bath and $SiO_2$ formed on the surface of a steel sheet is inferior. Therefore, it becomes possible to suppress the generation of non-plating defects by adding elements which remove the adverse effect of Al added in a zinc bath. As a result of the earnest studies by the present inventors, it was found that the above object could be attained by adding Mn in an appropriate concentration range. It is estimated that Mn forms an oxide film more preferentially than Al added in a zinc bath and enhances its reactivity with an Si system oxide film formed on the surface of a steel sheet.

Further, it is estimated that the fact that the generation of flaws caused by Si scales formed during hot-rolling has been suppressed by reducing Si amount in a steel is also effective in improving appearance. Further, with regard to the deterioration of material quality accompanying the reduction of Si content, it was found that ductility could be secured by the adjustment of production conditions and the addition of other components such as Al and Mo and the reduction of Si content and the addition of Al were effective in accelerating alloying.

The detailed reason is not clear, but it is estimated that it is caused by the generation of non-plating defects, the shapes of other defects, and the difference in corrosion resistance between the base material and the plated layer (difference in electric potential).

Here, though the deposited amount of plating is not particularly regulated, it is preferable that the deposited amount on one side is not less than 5 g/mm$^2$ from the viewpoint of corrosion resistance. Though an upper layer plating is applied to a hot-dip galvanized steel sheet of the present invention for the purpose of improving painting property and weldability, and various kinds of treatments such as a chromate treatment, a phosphate treatment, a lubricity improving treatment, a weldability improving treatment, etc. are applied to a hot-dip galvanized steel sheet of the present invention, those cases do not deviate from the present invention.

Preferable Microstructure of Base Steel Sheet

Next, the preferable microstructure of a base steel sheet will be explained hereunder. It is preferable to make the main structure a ferrite phase for sufficiently securing ductility. However, when higher strength is required, a bainite phase may be contained, but, from the viewpoint of securing ductility, it is desirable that the main phase contains a single phase of ferrite or a complex phase of ferrite and bainite (the expression "ferrite or ferrite and bainite" described in this DESCRIPTION means the same, unless otherwise specified) at not less than 50%, preferably 70%, in volume. In the case of a complex phase of ferrite and bainite too, it is desirable that ferrite is contained at not less than 50% in volume for securing ductility. On the other hand, for securing high-strength and high ductility in a well balanced manner, it is preferable to make ferrite or ferrite and bainite be contained at not more than 97% in volume. Further, for securing high-strength and high ductility simultaneously, it is also desirable to make the structure a complex structure containing retained austenite and/or martensite. For securing high-strength and high ductility simultaneously, it is preferable to make retained austenite and/or martensite be contained by not less than 3% in total volume. However, if the total value exceeds 50%, the steel sheet tends to be brittle, and therefore it is desirable to control the value to not more than 30% in total volume.

For securing the high ductility of a steel sheet itself, it is prescribed that the average grain size of ferrite is not more than 20 μm and the average grain size of austenite and/or martensite, which constitute(s) the second phase, is not more than 10 μm. Here, it is desirable to make the second phase composed of austenite and/or martensite and to make the average grain size of austenite and/or martensite not more than 0.7 times the average grain size of ferrite which constitutes the main phase. However, as it is difficult in actual production to make the average grain size of austenite and/or martensite, which constitute(s) the second phase, less than 0.01 time the average grain size of ferrite, it is preferable that the rate is not less than 0.01.

Furthermore, for securing good plating adhesion, and high-strength and high ductility in a well-balanced manner, it is prescribed that, in the case that the second phase of a steel sheet is composed of austenite, C content: C (in mass %) and Mn content: Mn (in mass %) in the steel, and the volume percentage of austenite: Vγ (in %) and the volume percentage of ferrite and bainite: Vα (in %) satisfy the following equation 4:

$$(V\gamma+V\alpha)/V\gamma\times C+Mn/8\geqq 2.0 \qquad 4$$

By satisfying the above expression, a steel sheet particularly excellent in the balance between strength and ductility and having good plating adhesion can be obtained.

The volume percentage and the like in case of containing bainite will be explained hereunder. A bainite phase is useful for enhancing strength by being contained at not less than 2% in volume, and also, when it coexists with an austenite phase, it contributes to stabilizing austenite and, as a result, it is useful for securing a high n-value. Further, the phase is basically fine and contributes to the plating adhesiveness during heavy working too. In particular, in the case where the second phase is composed of austenite, by controlling the volume percentage of bainite to not less than 2%, the balance of plating adhesiveness and ductility improves further. On the other hand, as ductility deteriorates when bainite is excessively formed, the volume percentage of the bainite phase is limited to not more than 47%.

In addition to the above, a steel sheet containing one or more of carbides, nitrides, sulfides and oxides at not more than 1% in volume, as the remainder portion in the microstructure, may be included in a steel sheet used in the present invention. Here, the identification, the observation of the sites, the average grain sizes (average circle-equivalent grain sizes) and volume percentages of each phase, ferrite, bainite, austenite, martensite, interface oxide layers and remainder structures in a microstructure can be quantitatively measured by etching the cross-section of a steel sheet in the rolling direction or in the transverse direction with a niter reagent or the reagent disclosed in Japanese Unexamined Patent Publication No. S59-219473 and observing the cross-section with an optical microscope under the magnification of 500 to 1,000.

Here, there sometimes is a case that the grain size of martensite can hardly be measured by an optical microscope. In that case, the average circle-equivalent grain size is obtained by observing the boundaries of martensite blocks, the boundaries of packets, or the aggregates thereof and measuring the grain sizes using a scanning electron microscope.

Further, the observation of the shape of a grain boundary oxide layer and the identification thereof at the interface between a plated layer and a base layer are carried out using an scanning electron microscope and a transmission electron microscope, and the maximum depth is measured by observing the depth in not less than 20 visual fields under a magnification of not less than 1,000 and identifying the maximum value.

An average grain size is defined as a value obtained by the procedure specified in JIS based on the results obtained by observing the objects in not less than 20 visual fields using above-mentioned method.

Next, a plated layer will be explained hereunder.

It is preferable that the Al content in a plated layer is controlled within the range from 0.001 to 0.5% in mass. This is because, when the Al content is less than 0.001% in mass, dross is formed remarkably and a good appearance cannot be obtained and, when Al is added in excess of 0.5% in mass, the alloying reaction is markedly suppressed and a hot-dip alloyed zinc-coated layer is hardly formed.

The reason why the Mn content in a plated layer is set within the range from 0.001 to 2% in mass is that, in this range, non-plating defects are not generated and a plated layer having good appearance can be obtained. When the Mn content exceeds 2% in mass, Mn—Zn compounds precipitate in a plating bath and are trapped in the plated layer, resulting in deteriorating appearance markedly.

Further, in the case where spot weldability and a painting property are desired in particular, these properties can be improved by applying an alloying treatment. Specifically, by applying an alloying treatment at a temperature of 300 to 550° C. after a steel sheet is dipped in a zinc bath, Fe is taken into a plated layer, and a high-strength hot-dip galvanized steel sheet excellent in a painting property and spot weldability can be obtained. When the Fe content after an alloying treatment is less than 5% in mass, spot weldability is insufficient. On the other hand, when Fe content exceeds 20% in mass, the adhesiveness of the plated layer itself deteriorates and the plated layer is destroyed, falls off, and sticks to dies during working, causing flaws during forming. Therefore, the range of the Fe content in a plated layer when an alloying treatment is applied is set at 5 to 20% by mass.

Further, it was found that non-plating defects could be suppressed by containing one or more of Ca, Mg, Si, Mo, W, Zr, Cs, Rb, K, Ag, Na, Cd, Cu, Ni, Co, La, Tl, Nd, Y, In, Be, Cr, Pb, Hf, Tc, Ti, Ge, Ta, V and B in a plated layer.

Here, though the deposited amount of plating is not particularly regulated, it is preferable that the deposited amount on one side is not less than 5 g/mm$^2$ from the viewpoint of corrosion resistance. Though an upper layer plating is applied to a hot-dip galvanized steel sheet of the present invention for the purpose of improving painting property and weldability, and various kinds of treatments such as a chromate treatment, a phosphate treatment, a lubricity improving treatment, a weldability improving treatment, etc. are applied to a hot-dip galvanized steel sheet of the present invention, those cases do not deviate from the present invention.

As one of the impurities in a plated layer, Mn is on example. When the Mn content in a plated layer increases to exceed the usual level of the impurities, non-plating defects are hardly generated. However, it is difficult to increase the Mn content in a plated layer because of the restrictions related to the current plating equipment. Therefore, the present invention allows Mn content to be less than 0.001% in mass, which is within the level of impurity elements, and is an invention wherein a steel sheet having a least amount of non-plating defects and surface defects can be obtained even though Mn is not intentionally added to a plating bath.

The reason for specifying the following elements to be in the ranges of Ca: 0.001 to 0.1%, Mg: 0.001 to 3%, Si: 0.001 to 0.1%, Mo: 0.001 to 0.1%, W: 0.001 to 0.1%, Zr: 0.001 to 0.1%, Cs: 0.001 to 0.1%, Rb: 0.001 to 0.1%, K: 0.001 to 0.1%, Ag: 0.001 to 5%, Na: 0.001 to 0.05%, Cd: 0.001 to 3%, Cu: 0.001 to 3%, Ni: 0.001 to 0.5%, Co: 0.001 to 1%, La: 0.001 to 0.1%, Tl: 0.001 to 8%, Nd: 0.001 to 0.1%, Y: 0.001 to 0.1%, In: 0.001 to 5%, Be: 0.001 to 0.1%, Cr: 0.001 to 0.05%, Pb: 0.001 to 1%, Hf: 0.001 to 0.1%, Tc: 0.001 to 0.1%, Ti: 0.001 to 0.1%, Ge: 0.001 to 5%, Ta: 0.001 to 0.1%, V: 0.001 to 0.2% and B: 0.001 to 0.1%, in mass, is that, in each of the ranges, non-plating defects are suppressed and a plated layer having good appearance can be obtained. When each element exceeds each upper limit, dross containing each element is formed and therefore the plating appearance deteriorates markedly.

Next, the reasons for restricting the ranges of the components in a steel sheet according to the present invention will be explained hereunder.

C is an element added in order to sufficiently secure the volume percentage of the second phase required for securing strength and ductility in a well balanced manner. In particular, when the second phase is composed of austenite, C contributes to not only the acquisition of the volume percentage but also the stability thereof and improves ductility greatly. The lower limit is set at 0.0001% by mass for securing the strength and the volume percentage of the second phase, and the upper limit is set at 0.3% by mass as the upper limit for preserving weldability.

Si is an element added in order to accelerate the formation of ferrite, which constitutes the main phase, and to suppress the formation of carbides, which deteriorate the balance between strength and ductility, and the lower limit is set at 0.01% in mass. On the other hand, its excessive addition adversely affects weldability and plating wettability. Further, as C accelerates the formation of an internal grain boundary oxidized layer, the C content has to be suppressed to a low level. Therefore, the upper limit is set at 2.5% in mass. In particular, when appearance, such as scale defects and the like, rather than strength, is the problem, it is determined that C may be reduced up to 0.001% in mass, which is in a range not causing operational problems.

Mn is added for the purpose of not only the control of plating wettability and plating adhesion but also the enhancement of strength. Further, it is added for suppressing the precipitation of carbides and the formation of pearlite which cause the deterioration of strength and ductility. For that reason, Mn content is set at not less than 0.001% in mass. On the other hand, since Mn delays bainite transformation which contributes to the improvement of ductility when the second phase is composed of austenite, and deteriorates weldability, the upper limit of Mn is set at 3% in mass.

Al is effective in controlling plating wettability and plating adhesion and also accelerating bainite transformation which contributes to the improvement of ductility, in particular, when the second phase is composed of austenite, and also Al improves the balance between strength and ductility. Further, Al is an element effective in suppressing the formation of Si system internal grain boundary oxides too. Therefore, the Al addition amount is set at not less than 0.0001% in mass. On the other hand, since its excessive addition deteriorates weldability and plating wettability remarkably and suppresses the synthesizing reaction markedly, the upper limit is set at 4% in mass.

Mo is added in order to suppress the generation of carbides and pearlite which deteriorate the balance between strength and ductility, and is an important element for securing good balance between strength and ductility under mitigated heat treatment conditions. Therefore, the lower limit of Mo is set at 0.001% in mass. Further, since its excessive addition generates retained austenite, lowers stability and hardens ferrite, resulting in the deterioration of ductility, the upper limit is set at 5%, preferably 1%.

Mg, Ca, Ti, Y, Ce and Rem are added for the purpose of suppressing the generation of an Si system internal grain boundary oxidized layer which deteriorates plating wettability, fatigue resistance and corrosion resistance. As the elements do not generate grain boundary oxides, as do Si system oxides, but can generate comparatively fine oxides in a dispersed manner, the oxides themselves of those elements do not adversely affect fatigue resistance. Further, as the elements suppress the formation of an Si system internal grain boundary oxidized layer, the depth of the internal grain boundary oxidized layer can be reduced and the elements contribute to the extension of fatigue life. One or more of the elements may be added and the addition amount of the elements is set at not less than 0.0001% in total mass. On the other hand, since their excessive addition deteriorates producibility such as casting properties and hot workability, and the ductility of steel sheet products, the upper limit is set at 1% in mass.

Further, a steel according to the present invention may contain one or more of Cr, Ni, Cu, Co and W aiming at enhancing strength.

Cr is an element added for enhancing strength and suppressing the generation of carbides, and the addition amount is set at not less than 0.001% in mass. However, its addition amount exceeding 25% in mass badly affects workability, and therefore the value is determined to be the upper limit.

Ni content is determined to be not less than 0.001% in mass for improving plating properties and enhancing strength. However, its addition amount exceeding 10% in mass badly affects workability, and therefore the value is determined to be the upper limit.

Cu is added in the amount of not less than 0.001% in mass for enhancing strength. However, its addition amount exceeding 5% in mass badly affects workability, and therefore the value is determined to be the upper limit.

Co is added in the amount of not less than 0.001% in mass for improving the balance between strength and ductility by the control of plating properties and bainite transformation. The upper limit is not specifically determined, but, as Co is an expensive element and an addition in a large amount is not economical, it is desirable to set the addition amount at not more than 5% in mass.

The reason why the W content is determined to be in the range from 0.001 to 5% in mass is that the effect of enhancing strength appears when the amount is not less than 0.001% in mass, and that the addition amount exceeding 5% in mass adversely affects workability.

Furthermore, a steel according to the present invention may contain one or more of Nb, Ti, V, Zr, Hf and Ta, which are strong carbide forming elements, aiming at enhancing the strength yet further.

Those elements form fine carbides, nitrides or carbonitrides and are very effective in strengthening a steel sheet. Therefore, it is determined that one or more of those elements is/are added by not less than 0.001% in mass at need. On the other hand, as those elements deteriorate ductility and hinder the concentration of C into retained austenite, the upper limit of the total addition amount is set at 1% by mass.

B can also be added as needed. B addition in the amount of not less than 0.0001% in mass is effective in strengthening grain boundaries and a steel material. However, when the addition amount exceeds 0.1% in mass, not only the effect is saturated but also the strength of a steel sheet is increased more than necessary, resulting in the deterioration of workability, and therefore the upper limit is set at 0.1% in mass.

The reason why P content is determined to be in the range from 0.0001 to 0.3% in mass is that the effect of enhancing strength appears when the amount is not less than 0.0001% in mass and ultra-low P is economically disadvantageous, and that the addition amount exceeding 0.3% in mass adversely affects weldability and producibility during casting and hot-rolling.

The reason why the S content is determined to be in the range from 0.0001 to 0.1% in mass is that ultra-low S of less than the lower limit of 0.0001% in mass is economically disadvantageous, and that an addition amount exceeding 0.1% in mass adversely affects weldability and producibility during casting and hot-rolling.

P, S, Sn, etc. are unavoidable impurities. It is desirable that P content is not more than 0.05%, S content not more than 0.01% and Sn content not more than 0.01%, in mass. It is well known that the small addition of P, in particular, is effective in improving the balance between strength and ductility.

Methods of producing a high-strength hot-dip galvanized steel sheet having such a structure as mentioned above will be explained hereunder.

When a steel sheet according to the present invention is produced by the processes of hot-rolling, cold-rolling and annealing, a slab adjusted to a prescribed components is cast or once cooled after the casting, and then heated again at a temperature of not less than 1,180° C. and hot-rolled. At this time, it is desirable that the reheating temperature is set at not less than 1,150° C. or at not more than 1,100° C. to suppress the formation of a grain boundary oxidized layer. When the reheating temperature becomes very high, oxidized scales tend to be formed on the whole surface comparatively uniformly and thus the oxidation of grain boundaries tends to be suppressed.

However, as heating to a temperature exceeding 1,250° C. accelerates extraordinary oxidation locally, this temperature is determined to be the upper limit.

Low temperature heating delays the formation of an oxidized layer itself.

Further, for the purpose of suppressing the formation of excessive internal oxidation, it is determined that the hot-rolling is finished at a temperature of not less than 880° C., and it is preferable for the reduction of the grain boundary oxidation depth of a product to remove surface scales by using a high-pressure descaling apparatus or applying heavy pickling after the hot-rolling. Thereafter, a steel sheet is cold-rolled and annealed, and thus a final product is obtained. In this case, it is common that the hot-roll finishing temperature is controlled to a temperature of not less than $Ar_3$ transformation temperature which is determined by the chemical composition of a steel, but the properties of a final steel sheet product are not deteriorated as long as the temperature is up to about 10° C. lower than $Ar_3$.

However, the hot-roll finishing temperature is set at not more than 1,100° C. to avoid the formation of oxidized scales in a large amount.

Further, by controlling the coiling temperature after cooling to not less than the bainite transformation commencement temperature, which is determined by the chemical composition of a steel, increasing the load more than necessary during cold-rolling can be avoided. However, that does not apply to the case where the total reduction rate at cold-rolling is low, and, even though a steel sheet is coiled at a temperature of not more than the bainite transformation temperature of a steel, the properties of the final steel sheet product are not deteriorated. Further, the total reduction rate of cold-rolling is determined from the relation between the final thickness and the cold-rolling load, and as long as the total reduction rate is not less than 40%, preferably 50%, that is effective in the reduction of grain boundary oxidation depth and the properties of the final steel sheet product are not deteriorated.

In the annealing process after cold-rolling, when the annealing temperature is less than the value of $0.1\times(Ac_3-Ac_1)+Ac_1$ (° C.) which is expressed by the $Ac_1$ temperature and $Ac_3$ temperature (for example, refer to "Tekko Zairyo Kagaku": W. C. Leslie, Supervisory Translator: Nariyasu Koda, Maruzen, P273) which are determined by the chemical composition of a steel, the amount of austenite formed during annealing is small, thus a retained austenite phase or a martensite phase cannot remain in the final steel sheet, and therefore the value is determined to be the lower limit of the annealing temperature. Here, the higher the annealing temperature is, the more the formation of a grain boundary oxidized layer is accelerated.

As a high temperature annealing causes the formation of a grain boundary oxidized layer to accelerate and the production costs to increase, the upper limit of the annealing temperature is determined to be $Ac_3-30$ (° C.). In particular, the closer to $Ac_3$ (° C.) the annealing temperature becomes, the more the formation of a grain boundary oxidized layer is accelerated. The annealing time is required to be not less than 10 seconds in this temperature range for equalizing the temperature of a steel sheet and securing austenite. However, when the annealing time exceeds 30 minutes, the formation of a grain boundary oxidized layer is accelerated and costs increase. Therefore, the upper limit is set at 30 minutes.

The primary cooling thereafter is important in accelerating the transformation from an austenite phase to a ferrite phase and stabilizing the austenite by concentrating C in the austenite phase before the transformation.

When the maximum temperature during annealing is defined as Tmax (° C.), a cooling rate of less than Tmax/1,000° C./sec. brings about disadvantages in the production such as to cause a process line to be longer and to cause the production rate to fall remarkably. On the other hand, when the cooling rate exceeds Tmax/10° C./sec., the ferrite transformation occurs insufficiently, the retained austenite in the final steel sheet product is hardly secured, and hard phases such as a martensite phase become abundant.

When the maximum temperature during annealing is defined as Tmax (° C.) and the primary cooling is carried out up to a temperature of less than Tmax−200° C., pearlite is generated and ferrite is not generated sufficiently during the cooling, and therefore the temperature is determined to be the lower limit. However, when the primary cooling terminates at a temperature exceeding Tmax−100° C., then the progress of the ferrite transformation is insufficient, and therefore the temperature is determined to be the upper limit.

A cooling rate of less than 0.1° C./sec. causes the formation of a grain boundary oxidized layer to be accelerated and brings about disadvantages in the production to cause a process line to be longer and to cause the production rate to fall remarkably. Therefore, the lower limit of the cooling rate is set at 0.1° C./sec. On the other hand, when the cooling rate exceeds 10° C./sec., the ferrite transformation occurs insufficiently, the retained austenite in the final steel sheet product is hardly secured, and hard phases such as a martensite phase become abundant, and therefore the upper limit is set at 10° C./sec.

When the primary cooling is carried out up to a temperature of less than 650° C., pearlite is generated during the cooling, C, which is an element stabilizing austenite, is wasted, and a sufficient amount of retained austenite is not obtained finally and, therefore, the lower limit is set at 650° C. However, when the cooling terminates at a temperature exceeding 710° C., the progress of ferrite transformation is insufficient, the growth of a grain boundary oxidized layer is accelerated, and therefore, the upper limit is set at 710° C.

In the rapid cooling of the secondary cooling which is carried out successively, the cooling rate has to be at least not less than 0.1° C./sec., preferably not less than 1° C./sec., so as not to generate a pearlite transformation, the precipitation of iron carbides, and the like, during the cooling.

However, as a cooling rate exceeding 100° C./sec. is hardly implemented from the viewpoint of an equipment capacity, the range of the cooling rate is determined to be from 0.1 to 100° C./sec., preferably from 1.0 to 100° C./sec.

When the cooling termination temperature of the secondary cooling is lower than the plating bath temperature, operational problems arise and, when it exceeds the plating bath temperature +50 to +100° C., carbides precipitate for a short period of time, and therefore the sufficient amount of retained austenite and martensite cannot be secured. For those reasons, the cooling termination temperature of the secondary cooling is set in the range from the zinc plating bath temperature to the zinc plating bath temperature +50 to 100° C. It is preferable to hold a steel sheet thereafter in the temperature range for not less than 1 second including the dipping time in the plating bath for the purpose of securing operational stability in the sheet travelling, accelerating the formation of bainite as much as possible, and sufficiently securing plating wettability. When the holding time becomes long, it badly affects productivity and carbides are generated, and therefore it is preferable to restrict the holding time to not more than 3,000 seconds excluding the time required for an annealing treatment.

For stabilizing an austenite phase retained in a steel sheet at the room temperature, it is essential to increase the carbon concentration in austenite by transforming a part of the austenite phase into a bainite phase. For accelerating the bainite transformation including in an alloying treatment process, it is preferable to hold a steel sheet for 1 to 3,000 seconds, preferably 15 seconds to 20 minutes, in the temperature range from 300 to 550° C. When the temperature is less than 300° C., the bainite transformation is hardly generated. However, when the temperature exceeds 550° C., carbides are formed and it becomes difficult to reserve a retained austenite phase sufficiently, and therefore the upper limit is set at 550° C.

For forming a martensite phase, it is not necessary to make bainite transformation occur, which is different from the case of a retained austenite phase. On the other hand, as the formation of carbides and a pearlite phase must be suppressed as in the case of a retained austenite phase, it is necessary to apply an alloying treatment sufficiently after the secondary cooling, and it is determined that an alloying treatment is carried out at a temperature of 300 to 550° C., preferably 400 to 550° C.

For securing oxides at an interface in a prescribed amount, it is desirable to control the temperature and working history from the hot-rolling stage. Firstly, it is desirable to generate a surface oxidized layer as evenly as possible by controlling: the heating temperature of a slab to 1,150 to 1,230° C.; the reduction rate up to 1,000° C. to not less than 50%; the finishing temperature to not less than 850° C., preferably not less than 880° C.; and the coiling temperature to not more than 650° C., and, at the same time, to leave elements such as Ti, Al, etc. in a solid solution state as much as possible for suppressing the formation of Si oxides during annealing. Further, it is desirable to remove a oxide layer formed during hot-rolling as much as possible by employing a high-pressure descaling or a heavy pickling after the finish rolling. Further, it is desirable to control the cold-rolling reduction rate to not less than 30% using rolls not more than 1,000 mm in diameter for the purpose of breaking the generated oxides. In annealing thereafter, it is desirable to heat a steel sheet at the rate of 5° C./sec. up to the temperature range of not less than 750° C. for the purpose of accelerating the formation of other oxides by suppressing the formation of $SiO_2$. On the other hand, when the annealing temperature is high or the annealing time is long, many oxides are generated and workability and fatigue resistance are deteriorated. Therefore, as determined in the present invention according to the item (33), it is desirable to control the residence time to not more than 60 minutes at an annealing temperature whose highest temperature is in the range from not less than $0.1\times(Ac_3-Ac_1)+Ac_1$ (° C.) to not more than $Ac_3-30$ (° C.).

EXAMPLES

The present invention will hereunder be explained in detail based on the examples.

Example 1 of Embodiment 1

The present invention will hereunder be explained in detail based on Example 1 of Embodiment 1.

Steels having chemical compositions shown in Table 1 were heated to the temperature of 1,200° C.; the hot-rolling of the steels was finished at a temperature of not less than the $Ar_3$ transformation temperature; and the hot-rolled steel sheets were cooled and then coiled at a temperature of not less than the bainite transformation commencement temperature which was determined by the chemical composition of each steel, pickled, and cold-rolled into cold-rolled steel sheets 1.0 mm in thickness.

The steels, M-1, N-1, O-1, P-1 and Q-1, which will be mentioned later, were hot-rolled on the conditions of the reduction rate of 70% up to 1,000° C., the finishing temperature of 900° C. and the coiling temperature of 700° C., and were cold-rolled with the reduction rate of 50% using the rolls 800 mm in diameter. The other steels were hot-rolled on the conditions of the reduction rate of 70% up to 1,000° C., the finishing temperature of 900° C. and the coiling temperature of 600° C., and were cold-rolled with the reduction rate of 50% using the rolls 1,200 mm in diameter.

TABLE 1

| Steel code | Chemical composition | | | | | | | | | | | |
|---|---|---|---|---|---|---|---|---|---|---|---|---|
| | C | Si | Mn | AL | Mo | Mg | Ca | Y | Ce | Rem | Cr | Ni |
| A | 0.16 | 0.2 | 1.05 | 1.41 | | | | | | | | |
| B | 0.13 | 0.5 | 0.97 | 1.09 | 0.16 | | | | | | | |
| C | 0.11 | 0.9 | 1.22 | 0.62 | | 0.0015 | | | | | | |
| D | 0.21 | 0.3 | 1.63 | 1.52 | 0.22 | | 0.0008 | | | | | |
| E | 0.08 | 0.7 | 1.53 | 0.05 | | | | 0.0005 | | 0.001 | | |
| F | 0.18 | 0.5 | 1.23 | 1.52 | 0.13 | | | | 0.003 | | | |
| G | 0.09 | 0.8 | 1.41 | 0.03 | | | | | | | 0.11 | 0.84 |
| H | 0.25 | 0.01 | 1.74 | 1.63 | 0.11 | | | | | | | |
| I | 0.14 | 1.22 | 1.13 | 1.23 | 0.05 | | | | | | | |
| J | 0.13 | 2.32 | 1.25 | 0.96 | 0.07 | | | | | | | |
| K | 0.19 | 0.78 | 1.1 | 0.5 | 0.12 | | | | | 0.005 | | |
| L | 0.17 | 0.19 | 0.98 | 0.7 | 0.07 | | | | 0.007 | | | |
| M | 0.19 | 0.04 | 1.45 | 0.99 | 0.12 | | | | | | | |
| N | 0.21 | 0.08 | 1.62 | 1.2 | 0.11 | | | | | | | |
| O | 0.2 | 0.01 | 1.51 | 1.15 | 0.13 | | | | | 0.008 | | |
| P | 0.09 | 0.45 | 1.42 | 0.46 | 0.11 | | | 0.001 | | | | |
| Q | 0.12 | 0.05 | 1.78 | 0.75 | 0.26 | | | | | | | |
| CA | 0.25 | 4.56 | 1.85 | 0.03 | | | | | | | | |
| CB | 0.28 | 0.75 | 2.56 | 0.03 | 5.32 | | | | | | | |
| CC | 0.02 | 1.98 | 0.52 | 0.63 | | 0.023 | | | | | | |
| CD | 0.06 | 0.52 | 2.98 | 0.05 | 1.31 | | | | | 0.64 | | 0.8 |
| CE | 0.23 | 0.01 | 2.61 | 0.04 | 0.5 | | | | | | 2.3 | 0.3 |

| Steel code | Cu | Co | Ti | Nb | V | B | Zr | Hf | Ta | W | P | S | Remarks |
|---|---|---|---|---|---|---|---|---|---|---|---|---|---|
| A | | | | | | | | | | | 0.02 | 0.005 | Invented steel |
| B | | | | | | | | | | | 0.01 | 0.004 | Invented steel |
| C | | | | | | | | | | | 0.01 | 0.006 | Invented steel |
| D | | | | | | | | | | | 0.015 | 0.002 | Invented steel |
| E | | | | | | 0.0007 | | | | | 0.025 | 0.003 | Invented steel |
| F | | | 0.015 | | | | | | | | 0.01 | 0.005 | Invented steel |
| G | 0.4 | | | | | | | | | | 0.02 | 0.004 | Invented steel |
| H | | 0.15 | | | | | | | | | 0.02 | 0.003 | Invented steel |
| I | | | | 0.022 | 0.03 | | | | | | 0.01 | 0.002 | Invented steel |
| J | | | | | | | | | | | 0.01 | 0.001 | Invented steel |
| K | | | | | | | | 0.005 | | 0.05 | 0.04 | 0.002 | Invented steel |
| L | | | | | | | 0.01 | | 0.01 | 0.25 | 0.02 | 0.002 | Invented steel |
| M | | | | | | | | | | | 0.005 | 0.002 | Invented steel |
| N | | | | | | | | | | | 0.012 | 0.001 | Invented steel |
| O | | | | | | | | | | | 0.007 | 0.002 | Invented steel |
| P | | | | | | | | | | | 0.01 | 0.003 | Invented steel |
| Q | | | | | | | | | | | 0.015 | 0.002 | Invented steel |
| CA | | | | | | | | | | | 0.01 | 0.003 | Comparative steel |

TABLE 1-continued

| Chemical composition | | | | | | |
|---|---|---|---|---|---|---|
| CB | | | | 0.02 | 0.004 | Comparative steel |
| CC | 1.15 | | | 0.01 | 0.004 | Comparative steel |
| CD | | 1.2 | | 0.02 | 0.005 | Comparative steel |
| CE | | | 0.15 | 0.02 | 0.002 | Comparative steel |

(Note)
The underlined numerals are the conditions which are outside the range according to the present invention.

After that, the $Ac_1$ transformation temperature and the $Ac_3$ transformation temperature were calculated from the components (in mass %) of each steel according to the following equations:

$$Ac_1=723-10.7\times Mn\ \%+29.1\times Si\ \%,$$

$$Ac_3=910-203\times(C\ \%)^{1/2}+44.7\times Si\ \%+31.5\times Mo\ \%-30\times Mn\ \%-11\times Cr\ \%+400\times Al\ \%.$$

The steel sheets were plated by: heating them at a rate of 5° C./sec. to the annealing temperature calculated from the $Ac_1$ transformation temperature and the $Ac_3$ transformation temperature and retaining them in the $N_2$ atmosphere containing 10% of $H_2$; thereafter, cooing them up to 600 to 700° C. at a cooling rate of 0.1 to 10° C./sec.; successively cooling them to the plating bath temperature at a cooling rate of 1 to 20° C./sec.; and dipping them in the zinc plating bath of 460° C. for 3 seconds, wherein the compositions of the plating bath were varied.

Further, as the Fe—Zn alloying treatment, some of the steel sheets were retained in the temperature range from 300 to 550° C. for 15 seconds to 20 minutes after they were plated and Fe contents in the plated layers were adjusted so as to be 5 to 20% in mass. The plating properties were evaluated by visually observing the state of dross entanglement on the surface and measuring the area of non-plated portions. The compositions of the plated layers were determined by dissolving the plated layers in a 5% hydrochloric acid solution containing an inhibitor and chemically analyzing the solution.

JIS #5 specimens for tensile test were prepared from the plated steel sheets (rolled at skin-pass line at the reduction rate of 0.5-2.0%) and mechanical properties thereof were measured. Further, the fracture lives were evaluated relatively by imposing a stress corresponding to 50% of the tensile strength in the plane bending fatigue test. Further, the corrosion resistance was evaluated by a repeated salt spray test.

As shown in Table 2, in the steels according to the present invention, the depth of the grain boundary oxidized layers is shallow and the fatigue life under a stress corresponding to 50% of the tensile strength exceeds $10^6$ cycles of bending. Further, the strength and the elongation are well balanced and rust formation is not observed, allowing a good appearance even after the test.

TABLE 2-1

Plating wettability, corrosion resistance, microstructure and fatigue resistance of each steel

| Steel code | Treatment number | Application of alloying heat treatment after plating treatment | Appearance after repeated salt splay test | Depth of grain boundary oxidized layer/μm |
|---|---|---|---|---|
| A | 1 | No | Rust not formed | 0.05 |
| A | 2 | Yes | Rust not formed | 0.07 |
| A | 3 | Yes | Rust not formed | 0.85 |
| B | 1 | No | Rust not formed | 0.09 |
| B | 2 | Yes | Rust not formed | 0.13 |
| B | 3 | No | Rust not formed | 1.05 |
| C | 1 | Yes | Rust not formed | 0.15 |
| C | 2 | Yes | Rust formed | 0.56 |
| D | 1 | Yes | Rust not formed | 0.11 |
| D | 2 | Yes | Rust not formed | 0.08 |
| E | 1 | Yes | Rust not formed | 0.23 |
| E | 1-1 | Yes | Rust not formed | 0.3 |
| E | 1-2 | Yes | Rust not formed | 0.24 |
| E | 1-3 | Yes | Rust not formed | 0.2 |
| E | 1-4 | Yes | Rust not formed | 0.33 |
| E | 1-5 | Yes | Rust not formed | 0.35 |
| E | 2 | Yes | Rust formed | 1.23 |
| F | 1 | No | Rust not formed | 0.09 |
| F | 2 | Yes | Rust not formed | 0.08 |
| G | 1 | Yes | Rust not formed | 0.07 |
| G | 2 | Yes | Rust formed | 1.1 |
| H | 1 | No | Rust not formed | 0.05 |
| I | 1 | Yes | Rust not formed | 0.42 |
| I | 1-1 | Yes | Rust not formed | 0.3 |
| I | 1-2 | Yes | Rust not formed | 0.35 |
| I | 1-3 | Yes | Rust not formed | 0.3 |
| I | 1-4 | Yes | Rust not formed | 0.28 |

TABLE 2-1-continued

| Plating wettability, corrosion resistance, microstructure and fatigue resistance of each steel | | | | |
|---|---|---|---|---|
| I | 1-5 | Yes | Rust not formed | 0.25 |

| Steel code | Kind of main phase | Volume percentage of ferrite, or ferrite and bainite/%* | Average grain size of main phase/μm | Depth of grain boundary oxidized layer divided by average grain size of main phase | Volume percentage of martensite/% |
|---|---|---|---|---|---|
| A | Ferrite | 95 | 11 | 4.55E−03 | 0 |
| A | Ferrite | 95.5 | 9 | 7.78E−03 | 0 |
| A | Ferrite | 100 | 25 | 3.40E−02 | 0 |
| B | Ferrite | 94 | 8 | 1.13E−02 | 0 |
| B | Ferrite | 93.5 | 8 | 1.63E−02 | 1 |
| B | Ferrite | 93 | 23 | 4.57E−02 | 7 |
| C | Ferrite | 96 | 12 | 1.25E−02 | 0 |
| C | Ferrite | 100 | 27 | 2.07E−02 | 0 |
| D | Ferrite | 91 | 6 | 1.83E−02 | 1 |
| D | Ferrite | 91 | 5 | 1.60E−02 | 9 |
| E | Ferrite | 93 | 9 | 2.56E−02 | 7 |
| E | Ferrite | 93 | 10 | 3.00E−02 | 7 |
| E | Ferrite | 92 | 9 | 2.67E−02 | 8 |
| E | Ferrite | 93 | 9 | 2.22E−02 | 7 |
| E | Ferrite | 93 | 11 | 3.00E−02 | 7 |
| E | Ferrite | 92 | 9 | 3.89E−02 | 8 |
| E | Ferrite | 94 | 15 | 8.20E−02 | 6 |
| F | Ferrite | 93 | 10 | 9.00E−03 | 0 |
| F | Ferrite | 93 | 9 | 8.89E−03 | 1 |
| G | Ferrite | 95 | 7 | 1.00E−02 | 1 |
| G | Ferrite | 96 | 10 | 1.10E−01 | 1 |
| H | Ferrite | 89 | 6 | 8.33E−03 | 0 |
| I | Ferrite | 94 | 5 | 8.40E−02 | 0 |
| I | Ferrite | 94 | 6 | 5.00E−02 | 0 |
| I | Ferrite | 93 | 5 | 7.00E−02 | 0 |
| I | Ferrite | 94 | 6 | 5.00E−02 | 0 |
| I | Ferrite | 94 | 6 | 4.67E−02 | 0 |
| I | Ferrite | 94 | 6 | 4.17E−02 | 0 |

| Steel code | Volume percentage of austenite/% | Tensile strength/MPa | Elongation/% | Fatigue life under the stress corresponding to 50% of tensile strength/cycles | |
|---|---|---|---|---|---|
| A | 5 | 565 | 41 | 1.23E+06 | Invented steel |
| A | 4.5 | 560 | 40 | 1.45E+06 | Invented steel |
| A | 0 | 520 | 31 | 3.20E+05 | Comparative steel |
| B | 6 | 595 | 40 | 1.01E+06 | Invented steel |
| B | 5.5 | 590 | 39 | 1.17E+06 | Invented steel |
| B | 0 | 600 | 30 | 1.59E+05 | Comparative steel |
| C | 4 | 555 | 42 | 1.10E+06 | Invented steel |
| C | 0 | 435 | 32 | 3.60E+05 | Comparative steel |
| D | 8 | 795 | 33 | 1.20E+06 | Invented steel |
| D | 0 | 825 | 28 | 1.07E+06 | Invented steel |
| E | 0 | 615 | 33 | 1.90E+06 | Invented steel |
| E | 0 | 610 | 33 | 1.10E+06 | Invented steel |
| E | 0 | 620 | 32 | 1.50E+06 | Invented steel |
| E | 0 | 615 | 32 | 1.40E+06 | Invented steel |
| E | 0 | 615 | 33 | 1.10E+06 | Invented steel |
| E | 0 | 620 | 33 | 1.20E+06 | Invented steel |
| E | 0 | 630 | 31 | 2.70E+05 | Comparative steel |
| F | 7 | 675 | 37 | 2.01E+06 | Invented steel |
| F | 6 | 670 | 36 | 1.70E+06 | Invented steel |
| G | 4 | 635 | 34 | 1.60E+06 | Invented steel |
| G | 3 | 630 | 34 | 1.85E+05 | Comparative steel |
| H | 11 | 815 | 33 | 2.00E+06 | Invented steel |
| I | 6 | 790 | 30 | 1.00E+06 | Invented steel |
| I | 6 | 795 | 30 | 1.20E+06 | Invented steel |
| I | 7 | 825 | 29 | 1.01E+06 | Invented steel |
| I | 6 | 795 | 30 | 1.20E+06 | Invented steel |

TABLE 2-1-continued

| Plating wettability, corrosion resistance, microstructure and fatigue resistance of each steel | | | | | |
|---|---|---|---|---|---|
| I | 6 | 800 | 30 | 1.15E+06 | Invented steel |
| I | 6 | 810 | 29 | 1.03E+06 | Invented steel |

(Note)
The underlined numerals are the conditions which are outside the range according to the present invention.
(Example) "4.55E−03" means $4.55 \times 10^{-3}$.
*The sum of the volume percentage of each phase is 100%, and the phases which are hardly observed and identified by an optical microscope, such as carbides, oxides, sulfides, etc., are included in the volume percentage of the main phase.

TABLE 2-2

Plating wettability, corrosion resistance, microstructure and fatigue resistance of each steel

| Steel code | Treatment number | Application of alloying heat treatment after plating treatment | Appearance after repeated salt splay test | Depth of grain boundary oxidized layer/μm |
|---|---|---|---|---|
| I | 2 | Yes | Rust formed | 1.15 |
| J | 1 | No | Rust not formed | 0.65 |
| J | 2 | Yes | Rust not formed | 0.7 |
| J | 3 | Yes | Rust formed | 1.54 |
| K | 1-1 | No | Rust not formed | 0.05 |
| K | 1-2 | No | Rust not formed | 0.04 |
| K | 1-3 | No | Rust not formed | 0.05 |
| K | 2-1 | Yes | Rust not formed | 0.04 |
| K | 2-2 | Yes | Rust not formed | 0.07 |
| K | 2-3 | Yes | Rust not formed | 0.04 |
| L | 1-1 | Yes | Rust not formed | 0.04 |
| L | 1-2 | Yes | Rust not formed | 0.06 |
| L | 1-3 | Yes | Rust not formed | 0.05 |
| L | 1-4 | Yes | Rust not formed | 0.03 |
| M | 1 | Yes | Rust not formed | 0.03 |
| N | 1 | Yes | Rust not formed | 0.02 |
| O | 1 | Yes | Rust not formed | 0.08 |
| P | 1 | Yes | Rust not formed | 0.25 |
| Q | 1 | Yes | Rust not formed | 0.07 |
| CA | 1 | Yes | Rust formed | 1.26 |
| CB | 1 | Yes | Rust not formed | 0.65 |
| CC | 1 | No | Rust formed | 1.65 |
| CD | 1 | | Many cracks occurred at hot-rolling | |
| CE | 1 | | Many cracks occurred at cold-rolling | |

| Steel code | Kind of main phase | Volume percentage of ferrite, or ferrite and bainite/%* | Average grain size of main phase/μm | Depth of grain boundary oxidized layer divided by average grain size of main phase | Volume percentage of martensite/% |
|---|---|---|---|---|---|
| I | Ferrite | 94 | 5 | 2.30E−01 | 1 |
| J | Ferrite | 95 | 9 | 7.22E−02 | 1 |
| J | Ferrite | 95 | 9 | 7.78E−02 | 1 |
| J | Ferrite | 100 | 15 | 1.03E−01 | 0 |
| K | Ferrite | 90.2 | 11 | 4.55E−03 | 0 |
| K | Ferrite | 91 | 10 | 4.00E−03 | 0 |
| K | Ferrite | 90.5 | 10 | 5.00E−03 | 0 |
| K | Ferrite | 91 | 10 | 4.00E−03 | 0 |
| K | Ferrite | 91 | 9 | 7.78E−03 | 0 |
| K | Ferrite | 90.5 | 9 | 4.44E−03 | 0 |
| L | Ferrite | 91.5 | 11 | 3.64E−03 | 0 |
| L | Ferrite | 92 | 10 | 6.00E−03 | 0 |
| L | Ferrite | 92 | 9 | 5.56E−03 | 0 |
| L | Ferrite | 92.5 | 10 | 3.00E−03 | 0 |
| M | Ferrite | 91.5 | 12 | 2.50E−03 | 0 |
| N | Ferrite | 92 | 9 | 2.22E−03 | 0 |
| O | Ferrite | 91 | 10 | 8.00E−03 | 0 |
| P | Ferrite and bainite | Ferrite: 65%, bainite: 23% | 4 | 6.25E−02 | 0 |

TABLE 2-2-continued

| Plating wettability, corrosion resistance, microstructure and fatigue resistance of each steel | | | | | |
|---|---|---|---|---|---|
| Q | Ferrite and bainite | Ferrite: 55%, bainite: 37% | 3 | 2.33E−02 | 4 |
| CA | Ferrite | 100 | 11 | 1.15E−01 | 0 |
| CB | Bainite | | Immeasurable | Immeasurable | Immeasurable |
| CC | Fearrite | 100 | 5 | 3.30E−01 | 0 |
| CD | | 100 | | | |
| CE | | | | | |

| Steel code | Volume percentage of austenite/% | Tensile strength/MPa | Elongation/% | Fatigue life under the stress corresponding to 50% of tensile strength/cycles | |
|---|---|---|---|---|---|
| I | 5 | 780 | 28 | 3.90E+05 | Comparative steel |
| J | 4 | 675 | 33 | 1.40E+06 | Invented steel |
| J | 4 | 670 | 33 | 1.33E+06 | Invented steel |
| J | 0 | 590 | 25 | 2.50E+05 | Comparative steel |
| K | 9.8 | 720 | 34 | 1.38E+06 | Invented steel |
| K | 9 | 700 | 33 | 1.22E+06 | Invented steel |
| K | 9.5 | 715 | 34 | 1.10E+06 | Invented steel |
| K | 9 | 720 | 33 | 1.40E+06 | Invented steel |
| K | 9 | 695 | 34 | 1.13E+06 | Invented steel |
| K | 9.5 | 700 | 34 | 1.36E+06 | Invented steel |
| L | 8.5 | 620 | 39 | 1.07E+06 | Invented steel |
| L | 8 | 600 | 38 | 1.10E+06 | Invented steel |
| L | 8 | 595 | 38 | 1.07E+06 | Invented steel |
| L | 7.5 | 590 | 38 | 1.37E+06 | Invented steel |
| M | 8.5 | 645 | 36 | 2.23E+06 | Invented steel |
| N | 8 | 675 | 35 | 2.10E+06 | Invented steel |
| O | 9 | 650 | 35 | 2.20E+06 | Invented steel |
| P | 12 | 790 | 30 | 2.70E+06 | Invented steel |
| Q | 4 | 845 | 28 | 2.10E+06 | Invented steel |
| CA | 0 | 620 | 22 | 9.45E+04 | Comparative steel |
| CB | 0 | 840 | 10 | 7.50E+05 | Comparative steel |
| CC | 0 | 645 | 21 | 1.20E+05 | Comparative steel |
| CD | | | | | Comparative steel |
| CE | | | | | Comparative steel |

(Note)
The underlined numerals are the conditions which are outside the range according to the present invention.
(Example) "4.55E−03" means $4.55 \times 10^{-3}$.
*The sum of the volume percentage of each phase is 100%, and the phases which are hardly observed and identified by an optical microscope, such as carbides, oxides, sulfides, etc., are included in the volume percentage of the main phase.
**With, regard to the main phases of the steels P and Q, since bainite can be clearly identified by an optical microscope, the volume percentage thereof is shown in the table. With regard to other steels, since the distribution of bainite is very fine and the volume percentage is as low as less than 20%, the quantitative measurement thereof is unreliable and thus it is not shown in the table.

TABLE 3

| Plating property of each steel | | | | | |
|---|---|---|---|---|---|
| Steel code-Treatment number | Al content in plated layer % | Mn content in plated layer % | Fe content in plated layer % | Value calculated by expression (1) | Other elements in plated layer % |
| C-1 | 1 | 1 | 15 | 1.77 | |
| C-2 | 0.5 | 0.01 | 7 | −4.35 | |
| E-1 | 0.05 | 0.5 | 12 | 7.76 | |
| E-1-1 | 0.17 | 0.04 | 9 | 0.51 | Si: 0.02 |
| E-1-2 | 0.18 | 0.03 | 9 | 0.26 | Y: 0.02, Nd: 0.04 |
| E-1-3 | 0.17 | 0.03 | 9 | 0.38 | La: 0.02 |
| E-1-4 | 0.15 | 0.02 | 9 | 0.51 | B: 0.005 |
| E-1-5 | 0.2 | 0.08 | 9 | 0.63 | Rb: 0.02 |
| E-2 | 0.25 | 0.01 | 8 | −0.87 | |
| G-1 | 0.3 | 0.3 | 11 | 2.05 | |

TABLE 3-continued

| Plating property of each steel | | | | | |
|---|---|---|---|---|---|
| G-2 | 0.2 | 0.01 | 8 | −0.33 | |
| H-1 | 0.5 | 0.5 | 7 | 1.26 | |
| I-1-1 | 0.1 | 0.05 | 7 | 0.63 | Cs: 0.04 |
| I-1-2 | 0.15 | 0.1 | 8 | 0.63 | K: 0.02, Ni: 0.05 |
| I-1-3 | 0.14 | 0.1 | 7 | 0.76 | Ag: 0.01, Co: 0.01 |
| I-1-4 | 0.3 | 0.25 | 8 | 0.63 | Ni: 0.02, Cu: 0.03 |
| I-1-5 | 0.35 | 0.27 | 9 | 0.26 | Na: 0.02, Cr: 0.01 |
| I-2 | 0.5 | 0.1 | | −3.74 | |
| J-1 | 1 | 1 | | 0.24 | |
| J-2 | 1 | 1 | 8 | 0.24 | |
| J-3 | 0.5 | 0 | 4 | −6.02 | |
| K-1-1 | 1 | 0.9 | | 0.69 | Be: 0.005 |
| K-1-2 | 0.8 | 0.7 | | 0.69 | Ti: 0.01, |

TABLE 3-continued

| Plating property of each steel | | | | | | | | |
|---|---|---|---|---|---|---|---|---|
| | | | | | In: 0.01 | No | Rust not formed | Invented steel |
| K-1-3 | 0.9 | 0.8 | | 0.69 | Cd: 0.02 | No | Rust not formed | Invented steel |
| K-2-1 | 0.9 | 0.8 | 9 | 0.69 | Pb: 0.03 | No | Rust not formed | Invented steel |
| K-2-2 | 1 | 0.95 | 8 | 1.32 | To: 0.02 | No | Rust not formed | Invented steel |
| K-2-3 | 1 | 0.9 | 8 | 0.69 | W: 0.02, Hf: 0.02 | No | Rust not formed | Invented steel |
| L-1-1 | 0.3 | 0.15 | 10 | 0.60 | Mo: 0.01 | No | Rust not formed | Invented steel |
| L-1-2 | 0.25 | 0.14 | 10 | 1.10 | Zr: 0.01, Ti: 0.01 | No | Rust not formed | Invented steel |
| L-1-3 | 0.3 | 0.2 | 9 | 1.23 | Ge: 0.01 | No | Rust not formed | Invented steel |
| L-1-4 | 0.3 | 0.15 | 11 | 0.60 | Ta: 0.01, V: 0.01 | No | Rust not formed | Invented steel |
| M-1 | 0.3 | 0.4 | 11 | 3.73 | | No | Rust not formed | Invented steel |
| N-1 | 0.4 | 0.3 | 11 | 1.23 | | No | Rust not formed | Invented steel |
| O-1 | 0.5 | 0.5 | 12 | 2.48 | | No | Rust not formed | Invented steel |
| P-1 | 0.1 | 0.3 | 11 | 4.98 | | No | Rust not formed | Invented steel |
| Q-1 | 0.15 | 0.2 | 10 | 3.10 | | No | Rust not formed | Invented steel |

(Note)
The remainder element in plated layer is zinc.
The underlined numerals are the conditions which are outside the range according to the present invention.

From Table 3, it can be understood that, even in the case of the steel sheets containing relatively large amounts of Si, the steel sheets according to the present invention, wherein the compositions in the plated layers and the steel sheets are regulated, do not form non-plating defects and have good corrosion resistance.

Further, it can be understood that, when the fourth elements ("other elements in plated layer" in Table 3) are contained in a plated layer, the plating properties are good even in the case where the value determined by the left side of the equation 1 is small.

Table 4 shows the influence of the production conditions. In the case of steel sheets whose production conditions do not satisfy the prescribed requirements, even having the compositions within the prescribed range, the depth of the grain boundary oxidized layers is large and their fatigue life is short. Further, it is understood that, conversely, even though the production conditions satisfy the prescribed requirements, in the case where the compositions of the steel sheets deviate from the prescribed range, the fatigue life is also short.

Table 5 shows the influence of the shape of the oxides. In the steel sheets according to the present invention, rust is not formed and also the fatigue strength exceeds $2\times10^6$ cycles of bending, and therefore the steel sheets have good material quality.

TABLE 4

| Production method and each property | | | | | | |
|---|---|---|---|---|---|---|
| Steel code | Treatment number | $AC_3$ (calculated) −30 (° C.)/° C. | $0.1 \times (Ac_3 - Ac_1) + Ac_1$ (calculated) /° C. | Maximum temperature during annealing/° C. | Resident time in the temperature range from $0.1 \times (Ac_3 - Ac_1) + Ac_1$ (° C.) to $Ac_3 - 30$ (° C.) min | Primary cooling rate/° C./S |
| A | 1 | 1340 | 783 | 830 | 1.4 | 3 |
| A | 2 | 1340 | 783 | 830 | 1.4 | 3 |
| A | 3 | 1340 | 783 | 950 | 4.3 | 1 |
| B | 1 | 1241 | 782 | 820 | 2.9 | 0.5 |
| B | 2 | 1241 | 782 | 820 | 2.9 | 0.5 |
| B | 3 | 1241 | 782 | 1000 | 75 | 0.05 |
| C | 1 | 1064 | 772 | 820 | 2 | 1 |
| C | 2 | 1064 | 772 | 1070 | 498 | 0.01 |
| D | 1 | 1366 | 783 | 830 | 2 | 1 |
| D | 2 | 1366 | 783 | 830 | 2 | 1 |
| E | 1 | 836 | 741 | 800 | 1.8 | 8 |
| E | 1-1 | 836 | 741 | 800 | 1.8 | 8 |
| E | 1-2 | 836 | 741 | 800 | 1.8 | 8 |
| E | 1-3 | 836 | 741 | 800 | 1.8 | 8 |

TABLE 4-continued

| Production method and each property | | | | | | |
|---|---|---|---|---|---|---|
| E | 1-4 | 836 | 741 | 800 | 1.8 | 8 |
| E | 1-5 | 836 | 741 | 800 | 1.8 | 8 |
| E | 2 | 836 | 741 | 850 | 184 | 0.01 |
| F | 1 | 1391 | 794 | 850 | 1.5 | 3 |
| F | 2 | 1391 | 794 | 850 | 1.5 | 3 |
| G | 1 | 823 | 743 | 800 | 2.1 | 1 |
| G | 2 | 823 | 743 | 850 | 179 | 0.01 |
| H | 1 | 1382 | 775 | 830 | 2.5 | 1 |
| I | 1 | 1318 | 807 | 850 | 1.9 | 1 |
| I | 1-1 | 1318 | 807 | 850 | 1.9 | 1 |
| I | 1-2 | 1318 | 807 | 850 | 1.9 | 1 |
| I | 1-3 | 1318 | 807 | 850 | 1.9 | 1 |
| I | 1-4 | 1318 | 807 | 850 | 1.9 | 1 |
| I | 1-5 | 1318 | 807 | 850 | 1.9 | 1 |
| I | 2 | 1318 | 807 | 950 | 49 | 0.05 |

| Steel code | Primary cooling halt temperature/° C. | Secondary cooling rate/° C./S | Retaining conditions including zinc plating treatment | Alloying temperature/° C. |
|---|---|---|---|---|
| A | 700 | 7 | For 30 seconds at a temperature of 475 to 460° C. | |
| A | 680 | 10 | For 30 seconds at a temperature of 475 to 460° C. | 510 |
| A | 750 | 1 | For 30 seconds at a temperature of 475 to 460° C. | 550 |
| B | 680 | 5 | For 30 seconds at a temperature of 465 to 460° C. | 510 |
| B | 680 | 5 | For 30 seconds at a temperature of 465 to 460° C. | |
| B | 730 | 120 | For 30 seconds at a temperature of 465 to 460° C. | |
| C | 680 | 10 | For 15 seconds at a temperature of 475 to 460° C. | 510 |
| C | 810 | 1 | For 15 seconds at a temperature of 475 to 460° C. | 510 |
| D | 700 | 5 | For 40 seconds at a temperature of 475 to 460° C. | 515 |
| D | 700 | 5 | For 5 seconds at a temperature of 475 to 460° C. | 515 |
| E | 680 | 15 | For 10 seconds at a temperature of 470 to 460° C. | 505 |
| E | 680 | 15 | For 10 seconds at a temperature of 470 to 460° C. | 505 |
| E | 680 | 15 | For 10 seconds at a temperature of 470 to 460° C. | 505 |
| E | 680 | 15 | For 10 seconds at a temperature of 470 to 460° C. | 505 |
| E | 680 | 15 | For 10 seconds at a temperature of 470 to 460° C. | 505 |
| E | 680 | 15 | For 10 seconds at a temperature of 470 to 460° C. | 505 |
| E | 750 | 15 | For 10 seconds at a temperature of 470 to 460° C. | 505 |
| F | 680 | 7 | For 30 seconds at a temperature of 470 to 460° C. | |
| F | 680 | 7 | For 30 seconds at a temperature of 470 to 460° C. | 500 |
| G | 670 | 6 | For 30 seconds at a temperature of 475 to 460° C. | 500 |
| G | 750 | 6 | For 30 seconds at a temperature of 475 to 460° C. | 500 |
| H | 670 | 10 | For 100 seconds at a temperature of 465 to 460° C. | |
| I | 700 | 10 | For 30 seconds at a temperature of 475 to 460° C. | 520 |
| I | 700 | 10 | For 30 seconds at a temperature of 475 to 460° C. | 520 |
| I | 700 | 10 | For 30 seconds at a temperature of 475 to 460° C. | 520 |
| I | 700 | 10 | For 30 seconds at a temperature of 475 to 460° C. | 520 |
| I | 700 | 10 | For 30 seconds at a temperature of 475 to 460° C. | 520 |
| I | 700 | 10 | For 30 seconds at a temperature of 475 to 460° C. | 520 |
| I | 780 | 10 | For 30 seconds at a temperature | |

TABLE 4-continued

| Production method and each property of 475 to 460° C. | | | | |
|---|---|---|---|---|
| Steel code | Depth of grain boundary oxidized layer/μm | Appearance after repeated salt spray test | Fatigue life under the stress corresponding to 50% of tensile strength/cycles | |
| A | 0.05 | Rust not formed | 1.23E+06 | Invented steel |
| A | 0.07 | Rust not formed | 1.45E+06 | Invented steel |
| A | 0.85 | Rust not formed | 3.20E+05 | Comparative steel |
| B | 0.09 | Rust not formed | 1.01E+06 | Invented steel |
| B | 0.13 | Rust not formed | 1.17E+06 | Invented steel |
| B | 1.05 | Rust not formed | 1.59E+05 | Comparative steel |
| C | 0.15 | Rust not formed | 1.10E+06 | Invented steel |
| C | 0.56 | Rust formed | 3.60E+05 | Comparative steel |
| D | 0.11 | Rust not formed | 1.20E+06 | Invented steel |
| D | 0.08 | Rust not formed | 1.07E+06 | Invented steel |
| E | 0.23 | Rust not formed | 1.90E+06 | Invented steel |
| E | 0.3 | Rust not formed | 1.10E+06 | Invented steel |
| E | 0.24 | Rust not formed | 1.50E+06 | Invented steel |
| E | 0.2 | Rust not formed | 1.40E+06 | Invented steel |
| E | 0.33 | Rust not formed | 1.10E+06 | Invented steel |
| E | 0.35 | Rust not formed | 1.20E+06 | Invented steel |
| E | 1.23 | Rust formed | 2.70E+05 | Comparative steel |
| F | 0.09 | Rust not formed | 2.01E+06 | Invented steel |
| F | 0.08 | Rust not formed | 1.70E+06 | Invented steel |
| G | 0.07 | Rust not formed | 1.60E+06 | Invented steel |
| G | 1.1 | Rust formed | 1.65E+05 | Comparative steel |
| H | 0.05 | Rust not formed | 2.00E+06 | Invented steel |
| I | 0.42 | Rust not formed | 1.00E+06 | Invented steel |
| I | 0.3 | Rust not formed | 1.20E+06 | Invented steel |
| I | 0.35 | Rust not formed | 1.01E+06 | Invented steel |
| I | 0.3 | Rust not formed | 1.20E+06 | Invented steel |
| I | 0.28 | Rust not formed | 1.15E+06 | Invented steel |
| I | 0.25 | Rust not formed | 1.03E+06 | Invented steel |
| I | 1.15 | Rust formed | 4.90E+05 | Comparative steel |

| Steel code | Treatment number | $Ac_3$ (calculated) − 30 (° C.)/° C. | 0.1 × ($Ac_3$ − $Ac_1$) + $Ac_1$ (calculated)/° C. | Maximum temperature during annealing/° C. | Resident time in the temperature range from 0.1 × ($Ac_3$ − $Ac_1$) + $Ac_1$ (° C.) to $Ac_3$ − 30 (° C.) min | Primary cooling rate/° C./S |
|---|---|---|---|---|---|---|
| J | 1 | 1259 | 828 | 850 | 1.4 | 1 |
| J | 2 | 1259 | 828 | 850 | 1.4 | 1 |
| J | 3 | 1259 | 828 | 1000 | 59 | 0.05 |
| K | 1-1 | 997 | 763 | 850 | 3.2 | 1 |
| K | 1-2 | 997 | 763 | 850 | 3.2 | 1 |
| K | 1-3 | 997 | 763 | 850 | 3.2 | 1 |
| K | 2-1 | 997 | 763 | 850 | 3.2 | 1 |
| K | 2-2 | 997 | 763 | 850 | 3.2 | 1 |
| K | 2-3 | 997 | 763 | 850 | 3.2 | 1 |
| L | 1-1 | 1162 | 765 | 830 | 2.1 | 3 |
| L | 1-2 | 1162 | 765 | 830 | 2.1 | 3 |
| L | 1-3 | 1162 | 765 | 830 | 2.1 | 3 |
| L | 1-4 | 1162 | 765 | 830 | 2.1 | 3 |
| M | 1 | 1150 | 756 | 830 | 1.5 | 5 |
| N | 1 | 1225 | 763 | 830 | 1.5 | 5 |
| O | 1 | 1208 | 760 | 830 | 1.5 | 5 |
| P | 1 | 984 | 750 | 830 | 1.5 | 5 |
| Q | 1 | 1067 | 770 | 830 | 1.5 | 5 |
| CA | 1 | 939 | 849 | 880 | 1.6 | 1 |
| CB | 1 | 909 | 740 | 850 | 3.2 | 1 |
| CC | 1 | 1176 | 818 | 900 | 8 | 0.2 |
| CD | 1 | Many cracks occurred at hot-rolling | | | | |
| CE | 1 | Many cracks occurred at cold-rolling | | | | |

| Steel code | Primary cooling halt temperature/° C. | Secondary cooling rate/° C./S | Retaining conditions including zinc plating treatment | Alloying temperature/° C. |
|---|---|---|---|---|
| J | 680 | 10 | For 30 seconds at a temperature of 475 to 460° C. | |
| J | 680 | 10 | For 30 seconds at a temperature of 475 to 460° C. | 520 |

TABLE 4-continued

| Production method and each property | | | | |
|---|---|---|---|---|
| J | 600 | 0.1 | For 30 seconds at a temperature of 465 to 460° C. | 580 |
| K | 680 | 7 | For 30 seconds at a temperature of 475 to 460° C. | Not applied |
| K | 680 | 7 | For 30 seconds at a temperature of 475 to 460° C. | Not applied |
| K | 680 | 7 | For 30 seconds at a temperature of 475 to 460° C. | Not applied |
| K | 680 | 7 | For 30 seconds at a temperature of 475 to 460° C. | 505 |
| K | 680 | 7 | For 30 seconds at a temperature of 475 to 460° C. | 505 |
| K | 680 | 7 | For 30 seconds at a temperature of 475 to 460° C. | 505 |
| L | 680 | 10 | For 30 seconds at a temperature of 465 to 460° C. | 500 |
| L | 680 | 10 | For 30 seconds at a temperature of 465 to 460° C. | 500 |
| L | 680 | 10 | For 30 seconds at a temperature of 465 to 460° C. | 500 |
| L | 680 | 10 | For 30 seconds at a temperature of 465 to 460° C. | 500 |
| M | 680 | 5 | For 30 seconds at a temperature of 460 to 455° C. | 500 |
| N | 680 | 5 | For 30 seconds at a temperature of 460 to 455° C. | 500 |
| O | 680 | 5 | For 30 seconds at a temperature of 460 to 455° C. | 500 |
| P | 680 | 5 | For 60 seconds at a temperature of 460 to 455° C. | 500 |
| Q | 680 | 5 | For 90 seconds at a temperature of 460 to 455° C. | 500 |
| CA | 700 | 1 | For 300 seconds at a temperature of 465 to 460° C. | 550 |
| CB | 700 | 30 | For 5 seconds at a temperature of 475 to 460° C. | 550 |
| CC | 700 | 1 | For 5 seconds at a temperature of 475 to 460° C. | |
| CD | | | | |
| CE | | | | |

| Steel code | Depth of grain boundary oxidized layer/μm | Appearance after repeated salt spray test | Fatigue life under the stress corresponding to 50% of tensile strength/cycles | |
|---|---|---|---|---|
| J | 0.65 | Rust not formed | 1.40E+06 | Invented steel |
| J | 0.7 | Rust not formed | 1.33E+06 | Invented steel |
| J | 1.54 | Rust formed | 2.50E+05 | Comparative steel |
| K | 0.05 | Rust not formed | 1.38E+06 | Invented steel |
| K | 0.04 | Rust not formed | 1.22E+06 | Invented steel |
| K | 0.05 | Rust not formed | 1.10E+06 | Invented steel |
| K | 0.04 | Rust not formed | 1.40E+06 | Invented steel |
| K | 0.07 | Rust not formed | 1.13E+06 | Invented steel |
| K | 0.04 | Rust not formed | 1.36E+06 | Invented steel |
| L | 0.04 | Rust not formed | 1.07E+06 | Invented steel |
| L | 0.06 | Rust not formed | 1.10E+06 | Invented steel |
| L | 0.05 | Rust not formed | 1.07E+06 | Invented steel |
| L | 0.03 | Rust not formed | 1.37E+06 | Invented steel |
| M | 0.03 | Rust not formed | 2.23E+06 | Invented steel |
| N | 0.02 | Rust not formed | 2.10E+06 | Invented steel |
| 0 | 0.08 | Rust not formed | 2.20E+06 | Invented steel |
| P | 0.25 | Rust not formed | 2.70E+06 | Invented steel |
| Q | 0.07 | Rust not formed | 2.10E+06 | Invented steel |
| CA | 1.26 | Rust formed | 9.45E+04 | Comparative steel |
| CB | 0.65 | Rust not formed | 7.50E+05 | Comparative steel |
| CC | 1.65 | Rust formed | 1.20E+05 | Comparative steel |
| CD | | | | Comparative steel |
| CE | | | | Comparative steel |

(Note)
The underlined numerals are the conditions which are outside the range according to the present invention.
(Example) "4.55E−03" means $4.55 \times 10^{-3}$.

TABLE 5-1

| Steel code | Treatment number | Area percentage of oxide in the range from the interface between plated layer and steel sheet 10 μm depth in steel | Ratio of area percentages: $(MnO + Al_2O_3)/SiO_2$ | Type of oxide existing in steel in the range from the interface between plated layer and steel sheet to 10 μm depth in steel |
|---|---|---|---|---|
| M | 1 | 35 | 70 | MnO, $Al_2O_3$, $SiO_2$ |
| N | 1 | 20 | 20 | MnO, $Al_2O_3$, $SiO_2$ |
| O | 1 | 25 | 250 | MnO, $Al_2O_3$, $SiO_2$, $La_2O_3$, $Ce_2O_3$ |
| P | 1 | 45 | 5 | MnO, $Al_2O_3$, $SiO_2$, $Y_2O_3$ |
| Q | 1 | 15 | 50 | MnO, $Al_2O_3$, $SiO_2$ |
| CA | 1 | 8 | 0.01 | $MnSiO_3$, $SiO_2$ |

| Steel code | Appearance after repeated splay test | Fatigue life under the stress corresponding to 50% of tensile strengthz | |
|---|---|---|---|
| M | Rust not formed | 2.23E+06 | Invented steel |
| N | Rust not formed | 2.10E+06 | Invented steel |
| O | Rust not formed | 2.20E+06 | Invented steel |
| P | Rust not formed | 2.70E+06 | Invented steel |
| Q | Rust not formed | 2.10E+06 | Invented steel |
| CA | Rust formed | 9.45E+04 | Comparative steel |

(Note)
The underlined numerals are the conditions which are outside the range according to the present invention.
(Example) "2.23E+6" means $2.23 \times 10^6$.

Example 2 of Embodiment 1

The present invention will hereunder be explained in detail based on Example 2 of Embodiment 1.

Steels having chemical compositions shown in Table 6 were heated to the temperature of 1,200° C.; the hot-rolling of the steels was finished at a temperature of not less than the $Ar_3$ transformation temperature; and the hot-rolled steel sheets were cooled and then coiled at a temperature of not less than the bainite transformation commencement temperature which was determined by the chemical composition of each steel, pickled, and cold-rolled into cold-rolled steel sheets 1.0 mm in thickness.

After that, the $Ac_1$ transformation temperature and the $Ac_3$ transformation temperature were calculated from the components (in mass %) of each steel according to the following equations:

$$Ac_1=723-10.7\times Mn\ \%-16.9\times Ni\ \%+29.1\times Si\ \%+16.9\times Cr\ \%,$$

$$Ac_3=910-203\times(C\ \%)^{1/2}+15.2\times Ni\ \%+44.7\times Si\ \%+104\times V\ \%+31.5\times Mo\ \%-30\times Mn\ \%-11\times Cr\ \%-20\times Cu\ \%+700\times P\ \%+400\times Al\ \%+400\times Ti\ \%.$$

The steel sheets were plated by: heating them to the annealing temperature calculated from the $Ac_1$ transformation temperature and the $Ac_3$ transformation temperature and retaining them in the $N_2$ atmosphere containing 10% of $H_2$; thereafter, cooling them up to 680° C. at a cooling rate of 0.1 to 10° C./sec.; successively cooling them to the plating bath temperature at a cooling rate of 1 to 20° C./sec.; and dipping them in the zinc plating bath at 460° C. for 3 seconds, wherein the compositions of the plating bath were varied.

Further, as the Fe—Zn alloying treatment, some of the steel sheets were retained in the temperature range from 300 to 550° C. for 15 seconds to 20 minutes after they were zinc plated and Fe contents in the plated layers were adjusted so as to be 5 to 20% in mass. The plating properties were evaluated by visually observing the state of dross entanglement on the surface and measuring the area of non-plated portions. The compositions of the plated layers were determined by dissolving the plated layers in 5% hydrochloric acid solution containing an inhibitor and chemically analyzing the solution.

JIS #5 specimens for tensile test were prepared from the zinc plated steel sheets (rolled in the skin-pass line at the reduction rate of 0.5-2.0%) and mechanical properties thereof were measured. Then, the plating adhesion after severe deformation was evaluated by applying 60° bending and bending-back forming to a steel sheet after giving the tensile strain of 20%. The plating adhesiveness was evaluated relatively by sticking a vinyl tape to the bent portion after bending and bending-back forming and peeling it off, and then measuring the rate of the exfoliated length per unit length. The production conditions are shown in Table 8.

As shown in Table 7, in the case of the steels according to the present invention, namely, D1 to D8 (Nos. 1, 2, 5 to 8, 10 to 14), non-plating defects are not observed, the strength and the elongation are well balanced, and the plating exfoliation rate is as low as not more than 1% even when bending and bending-back forming is applied after giving the tensile strain of 20%. On the other hand, in the case of the comparative steels, namely, C1 to C5 (Nos. 17 to 21), cracks were generated abundantly during the hot-rolling for producing the test specimens and the producibility was poor. The hot-rolled steel sheets were cold-rolled and annealed after cracks were removed by grinding the hot-rolled steel sheets obtained, and then used for the material quality tests. However, some of the steel sheets (C2 and C4) were very poor in plating adhesiveness after heavy working or could not withstand the forming of 20%.

As shown in Table 8, in Nos. 3, 9, 19 and 21, which do not satisfy the equation 1, the plating wettability deteriorates and the plating adhesion after revere deformation is inferior. Also, in the case that the regulation on the microstructure of a steel sheet is not satisfied, the plating adhesiveness after heavy working is inferior.

In case of No. 4, since the secondary cooling rate is slow, martensite and austenite are not generated but pearlite is generated instead, and the plating adhesiveness after heavy working is inferior.

TABLE 6

| Chemical composition, producibility and plating wettability | | | | | | | | |
|---|---|---|---|---|---|---|---|---|
| Steel code | C | Si | Mn | Al | Mo | Cr | Ni | Cu |
| D1 | 0.15 | 0.45 | 0.95 | 1.12 | | | | |
| D2 | 0.16 | 0.48 | 0.98 | 0.95 | 0.15 | | | |
| D3 | 0.13 | 1.21 | 1.01 | 0.48 | 0.12 | | | |
| D4 | 0.09 | 0.49 | 1.11 | 1.51 | 0.19 | | | |
| D5 | 0.06 | 0.89 | 1.21 | 0.62 | 0.09 | 0.09 | | |
| D6 | 0.11 | 1.23 | 1.49 | 0.31 | | | 0.74 | 0.42 |
| D7 | 0.22 | 1.31 | 1.09 | 0.75 | 0.23 | | | |
| D8 | 0.07 | 0.91 | 1.56 | 0.03 | | | | |
| D9 | 0.05 | 0.91 | 1.68 | 0.03 | 0.55 | 1.65 | | |
| C1 | 0.42 | 0.32 | 2.81 | 4.56 | | | | |
| C2 | 0.27 | 1.22 | 1.97 | 0.03 | 6.52 | | | |
| C3 | 0.05 | 7.41 | 0.6 | 0.05 | | | | 8.54 |
| C4 | 0.08 | 0.21 | 0.4 | 0.06 | | | | |
| C5 | 0.15 | 3.61 | 1.32 | 0.02 | | | | |

TABLE 6-continued

| Steel code | Co | Nb | Ti | V | B | |
|---|---|---|---|---|---|---|
| D1 | | | | | | Invented steel |
| D2 | | | | | | |
| D3 | | | | | | |
| D4 | | | | | | |
| D5 | | | | | | |
| D6 | | | | 0.005 | | |
| D7 | 0.08 | | | | | |
| D8 | | 0.01 | 0.01 | | | |
| D9 | | | | | 0.0026 | |
| C1 | | | | | | Comparative steel |
| C2 | | | | | | |
| C3 | | | | | | |
| C4 | | 3.22 | | | | |
| C5 | | | | | 0.5 | |

The Shaded numerals in the table are the conditions which are outside the range according to the present invention.

TABLE 7

| Content of Al, Mn and Fe in plated layer and plating property | | | | | | | | | |
|---|---|---|---|---|---|---|---|---|---|
| Steel code | No | Al content in plated layer % | Mn content in plated layer % | Fe content in plated layer %** | Value calculated by expression (1) | Application of alloying treatment | Occurrence of non-plating defect on steel sheet before working | Mechanical property TS/MPa | Mechanical property EL/% |
| D1 | 1 | 0.1 | 0.8 | 10 | 10.1 | Yes | No | 575 | 39 |
| D1 | 2 | 0.1 | 0.8 | | 10.1 | No | No | 585 | 42 |
| D1 | 3 | 0.18 | 0 | | 0.17 | No | Trivial | 580 | 41 |
| D1 | 4 | 0.1 | 0.8 | 11 | 10.1 | Yes | No | 530 | 31 |
| D2 | 5 | 0.03 | 0.1 | 8 | 2.98 | Yes | No | 605 | 36 |
| D2 | 6 | 0.03 | 0.1 | | 2.98 | No | No | 615 | 37 |
| D3 | 7 | 0.04 | 0.2 | 10 | 3.53 | Yes | No | 610 | 36 |
| D3 | 8 | 0.04 | 0.2 | | 3.53 | No | No | 620 | 36 |
| D3 | 9 | 0.3 | 0 | 8 | 2.22 | Yes | Frequent | 615 | 36 |
| D4 | 10 | 0.02 | 0.05 | 9 | 2.27 | Yes | No | 565 | 40 |
| D5 | 11 | 1 | 1 | 15 | 1.78 | Yes | No | 635 | 33 |
| D6 | 12 | 0.15 | 0.1 | 10 | 0.89 | Yes | Trivial | 680 | 33 |
| D7 | 13 | 0.04 | 0.5 | 15 | 6.97 | Yes | Trivial | 810 | 32 |
| D7 | 14 | 0.04 | 0.5 | 15 | 6.97 | No | Trivial | 890 | 18 |
| D8 | 15 | 0.4 | 0.8 | | 6.24 | No | Trivial | 795 | 30 |
| D9 | 16 | 0.5 | 0.8 | | 5.7 | No | Trivial | 645 | 27 |
| C1 | 17 | 0.4 | 0.8 | 10 | 5.81 | Yes | Trivial | 775 | 22 |
| C2 | 18 | 0.04 | 0.5 | | 7.23 | No | Trivial | 995 | 12 |
| C3 | 19 | 0.01 | 0.01 | | 4.48 | No | Poor plating wettability | | |
| C4 | 20 | 0.01 | 0.01 | 12 | 2.75 | Yes | No | 895 | 13 |
| C5 | 21 | 0.01 | 0.01 | | 0.76 | Yes | Poor plating wettability | | |

| Microstructure | | | | | | | | | | | |
|---|---|---|---|---|---|---|---|---|---|---|---|
| Steel code | No | Volume percentage of ferrite/% | Volume percentage of austenite/%*** | Volume percentage of martensite/%*** | Volume percentage of bainite/%*** | Structure of remainder portion/%*** | Average grain size of ferrite/μm | Average grain size of austenite/μm | Average rain size of martensite/μm | Ratio of average grain size of ferrite to that of second phase | Exfoliation rate of plated layer after giving 20% tensile strain and then applying 60° bending and bending-back forming/% | |
| D1 | 1 | 91.6 | 4.9 | 0 | 3.5 | *** | 12.5 | 2.2 | | 0.176 | 0 | Invented steel |
| D1 | 2 | 90.8 | 5.3 | 0 | 3.9 | *** | 12.2 | 2.5 | | 0.205 | 0.1 | Invented steel |
| D1 | 3 | 91.2 | 5.1 | 0 | 3.7 | *** | 11.8 | 2.3 | | 0.195 | 12 | Comparative steel |
| D1 | 4 | 85 | 0 | 0 | 0 | Pearlite | 13.5 | | | | 4 | Comparative steel |

TABLE 7-continued

| Content of Al, Mn and Fe in plated layer and plating property | | | | | | | | | | | |
|---|---|---|---|---|---|---|---|---|---|---|---|
| | | | | | | 15% | | | | | |
| D2 | 5 | 90.5 | 5.6 | 0 | 3.9 | *** | 10.1 | 2.3 | 0.228 | 0 | Invented steel |
| D2 | 6 | 89.5 | 6.2 | 0 | 4.3 | *** | 10.2 | 2.5 | 0.245 | 0.1 | Invented steel |
| D3 | 7 | 89.8 | 6.4 | 0 | 3.8 | *** | 8.9 | 2.6 | 0.292 | 0 | Invented steel |
| D3 | 8 | 88.8 | 6.7 | 0 | 4.5 | *** | 8.7 | 2.7 | 0.310 | 0.2 | Invented steel |
| D3 | 9 | 89.5 | 6.4 | 0 | 4.1 | *** | 8.5 | 2.6 | 0.306 | 46 | Comparative steel |
| D4 | 10 | 93.7 | 3.5 | 0 | 2.8 | *** | 11.5 | 2.3 | 0.200 | 0 | Invented steel |
| D5 | 11 | 88.8 | 0 | 8.1 | 3.1 | *** | 7.5 | 3.4 | 0.453 | 0.3 | Invented steel |
| D6 | 12 | 85.4 | 8.1 | 0 | 6.5 | *** | 5.3 | 1.9 | 0.358 | 0.5 | Invented steel |
| D7 | 13 | 82.5 | 9.7 | 0 | 7.8 | *** | 4.6 | 1.8 | 0.391 | 0.4 | Invented steel |
| D7 | 14 | Main phase is composed of the mixture of ferrite and bainite.* | | | | | | | | | Comparative steel |
| D8 | 15 | 83.5 | 0 | 11.2 | 5.3 | *** | 3.9 | 2 | 0.513 | 0.5 | Invented steel |
| D9 | 16 | 89.5 | 0 | 10.5 | 0 | *** | 3.5 | 1.8 | 0.514 | 0.7 | Invented steel |
| C1 | 17 | 77 | 0 | 0 | 23 | *** | 3.4 | | | 75 | Comparative steel |
| C2 | 18 | Main phase is composed of the mixture of ferrite and bainite.* | | | | | | | | | Comparative steel |
| C3 | 19 | | | | | | | | | | Comparative steel |
| C4 | 20 | Main phase is composed of the mixture of ferrite and bainite.* | | | | | | | | | Comparative steel |
| C5 | 21 | | | | | | | | | | Comparative steel |

The shaded numerals in the table are the conditions which are outside the range according to the present invention.

*Main phase is composed of the mixture of ferrite and bainite and it is difficult to quantitatively identify them. Further, the rupture elongation is not more than 20%, which means low ductility, and therefore it is impossible to evaluate the plating adhesiveness after heavy working.

**In case that an alloying treatment is not applied, Fe is scarcely included in the plated layer.

***The sum of the volume percentage of each phase is 100%, and the phases which are hardly observed and identified by an optical microscope, such as carbides, oxides, sulfides, etc., are included in the volume percentage of the main phase.

TABLE 8

| Production condition and plating adhesiveness after heavy working | | | | | |
|---|---|---|---|---|---|
| Steel code | No | Annealing condition: ° C. × min. | Primary cooling rate: ° C./s | Primary cooling halt temperature: ° C. | Secondary cooling rate: ° C./s |
| D1 | 1 | 800° C. × 3 min. | 1 | 680 | 10 |
| D1 | 2 | 800° C. × 3 min. | 1 | 680 | 10 |
| D1 | 3 | 800° C. × 3 min. | 1 | 680 | 0.5 |
| D1 | 4 | 800° C. × 3 min. | 1 | 680 | 10 |
| D2 | 5 | 800° C. × 3 min. | 1 | 680 | 10 |
| D2 | 6 | 800° C. × 3 min. | 1 | 680 | 10 |
| D3 | 7 | 810° C. × 3 min. | 1 | 680 | 5 |
| D3 | 8 | 810° C. × 3 min. | 1 | 680 | 5 |
| D3 | 9 | 830° C. × 3 min. | 1 | 680 | 5 |
| D4 | 10 | 830° C. × 3 min. | 0.5 | 680 | 3 |
| D5 | 11 | 830° C. × 3 min. | 0.5 | 680 | 7 |
| D6 | 12 | 800° C. × 3 min. | 0.3 | 650 | 8 |
| D7 | 13 | 800° C. × 3 min. | 1 | 680 | 10 |
| D7 | 14 | 1200° C. × 0.5 min. | 70 | 680 | 70 |
| D8 | 15 | 860° C. × 3 min. | 1 | 680 | 10 |
| D9 | 16 | 860° C. × 3 min. | 0.5 | 650 | 3 |
| C1 | 17 | 850° C. × 3 min. | 5 | 680 | 30 |
| C2 | 18 | 850° C. × 3 min. | 1 | 690 | 10 |
| C3 | 19 | 1000° C. × 3 min. | 5 | 680 | 10 |
| C4 | 20 | 850° C. × 3 min. | 5 | 680 | 30 |
| C5 | 21 | 950° C. × 3 min. | 1 | 680 | 30 |

| Steel code | No | Secondary cooling halt temperature: ° C. | Retaining conditions including zinc plating treatment | Alloying processing temperature: ° C. |
|---|---|---|---|---|
| D1 | 1 | 465 | For 18 seconds at a temperature of 465 to 460° C. | 515 |
| D1 | 2 | 465 | For 23 seconds at a temperature of 465 to 460° C. | No |
| D1 | 3 | 465 | For 23 seconds at a temperature of 465 to 460° C. | No |
| D1 | 4 | 465 | For 18 seconds at a temperature of 465 to 460° C. | 600 |
| D2 | 5 | 470 | For 15 seconds at a temperature of 470 to 460° C. | 520 |
| D2 | 6 | 470 | For 25 seconds at a temperature | No |

TABLE 8-continued

| Production condition and plating adhesiveness after heavy working | | | | |
|---|---|---|---|---|
| | | | of 470 to 460° C. | |
| D3 | 7 | 470 | For 18 seconds at a temperature of 470 to 460° C. | 510 |
| D3 | 8 | 470 | For 33 seconds at a temperature of 470 to 460° C. | No |
| D3 | 9 | 470 | For 25 seconds at a temperature of 470 to 460° C. | 510 |
| D4 | 10 | 475 | For 20 seconds at a temperature of 475 to 460° C. | 515 |
| D5 | 11 | 475 | For 5 seconds at a temperature of 475 to 460° C. | 520 |
| D6 | 12 | 480 | For 20 seconds at a temperature of 480 to 460° C. | 520 |
| D7 | 13 | 470 | For 25 seconds at a temperature of 470 to 460° C. | 520 |
| D7 | 14 | 470 | For 25 seconds at a temperature of 470 to 460oC | No |
| D8 | 15 | 480 | For 5 seconds at a temperature of 480 to 460° C. | No |
| D9 | 16 | 480 | For 5 seconds at a temperature of 470 to 460° C. | No |
| C1 | 17 | 470 | For 15 seconds at a temperature of 470 to 460° C. | 510 |
| C2 | 18 | 470 | For 5 seconds at a temperature of 470 to 460° C. | No |
| C3 | 19 | 470 | For 15 seconds at a temperature of 470 to 460° C. | No |
| C4 | 20 | 470 | For 15 seconds at a temperature of 470 to 460° C. | 510 |
| C5 | 21 | 470 | For 15 seconds at a temperature of 470 to 460° C. | 510 |

| Steel code | No | Alloying processing time: | Exfoliation rate of plated layer after giving 20% tensile strain and then applying 60° bending and bending-back forming | |
|---|---|---|---|---|
| D1 | 1 | 25 | 0 | Invented steel |
| D1 | 2 | No | 0.1 | Invented steel |
| D1 | 3 | No | 12 | Comparative steel |
| D1 | 4 | 25 | 4 | Comparative steel |
| D2 | 5 | 25 | 0 | Invented steel |
| D2 | 6 | No | 0.1 | Invented steel |
| D3 | 7 | 25 | 0 | Invented steel |
| D3 | 8 | No | 0.2 | Invented steel |
| D3 | 9 | 25 | 46 | Comparative steel |
| D4 | 10 | 25 | 0 | Invented steel |
| D5 | 11 | 25 | 0.3 | Invented steel |
| D6 | 12 | 25 | 0.5 | Invented steel |
| D7 | 13 | 25 | 0.4 | Invented steel |
| D7 | 14 | No | Unbearable to 20% tensile stress | Comparative steel |
| D8 | 15 | No | 0.5 | Invented steel |
| D9 | 16 | No | 0.7 | Invented steel |
| C1 | 17 | 25 | Unbearable to 20% tensile stress | Comparative steel |
| C2 | 18 | No | Unbearable to 20% tensile stress | Comparative steel |
| C3 | 19 | No | Non-plating defects generated prior to tensile test | Comparative steel |
| C4 | 20 | 25 | Unbearable to 20% tensile stress | Comparative steel |
| C5 | 21 | 25 | Non-plating defects generated prior to tensile test | Comparative steel |

The shaded portions in the table are the conditions which are outside the range according to the present invention. (refer to Table 7 with regard to Nos. 9 and 17 to 21)
Primary cooling rage: cooling rate in the temperature range from after annealing up to 650 to 700° C.
Secondary cooling rate: cooling rate in the temperature range from 650 to 700° C. to plating bath Example 3 of Embodiment 1

The present invention will hereunder be explained in detail based on Example 3 of Embodiment 1.

Steels having chemical compositions shown in Table 9 were heated to the temperature of 1,200° C.; the hot-rolling of the steels was finished at a temperature of not less than the $Ar_3$ transformation temperature; and the hot-rolled steel sheets were cooled and then coiled at a temperature of not less than the bainite transformation commencement temperature which was determined by the chemical composition of each steel, pickled, and cold-rolled into cold-rolled steel sheets 1.0 mm in thickness.

After that, the $Ac_1$ transformation temperature and the $Ac_3$ transformation temperature were calculated from the components (in mass %) of each steel according to the following equations:

$$Ac_1=723-10.7\times Mn\ \%+29.1\times Si\ \%,$$

$$Ac_3=910-203\times(C\ \%)^{1/2}+44.7\times Si\ \%+31.5\times Mo\ \%-30\times Mn\ \%-11\times Cr\ \%+400\times Al\ \%.$$

The steel sheets were plated by: heating them to the annealing temperature calculated from the $Ac_1$ transformation temperature and the $Ac_3$ transformation temperature and retaining them in the $N_2$ atmosphere containing 10% of $H_2$; thereafter, cooling them up to 680° C. at a cooling rate of 0.1 to 10° C./sec.; successively cooling them to the plating bath temperature at a cooling rate of 1 to 20° C./sec.; and dipping them in the zinc plating bath of 460° C. for 3 seconds, wherein the compositions of the plating bath were varied.

Further, as the Fe—Zn alloying treatment, some of the steel sheets were retained in the temperature range from 300 to 550° C. for 15 seconds to 20 minutes after they were zinc plated and Fe contents in the plated layers were adjusted so as to be 5 to 20% in mass. The plating properties were evaluated by visually observing the state of dross entanglement on the surface and measuring the area of non-plated portions. The compositions of the plated layers were determined by dissolving the plated layers in 5% hydrochloric acid solution containing an inhibitor and chemically analyzing the solution.

JIS #5 specimens for tensile test were prepared from the zinc plated steel sheets (rolled in the skin-pass line at the reduction rate of 0.5-2.0%) and mechanical properties thereof were measured. Then, the plating adhesion after severe deformation was evaluated by applying 60° bending and bending-back forming to a steel sheet after giving the tensile strain of 20%. The plating adhesiveness was evaluated relatively by sticking a vinyl tape to the bent portion after bending and bending-back forming and peeling it off, and then measuring the rate of the exfoliated length per unit length. The production conditions are shown in Table 11.

As shown in Table 10, in the case of the steels according to the present invention, namely, D1 to D12 (Nos. 1, 2, 5, 12, 13, 20, 22 to 24, 32, 34 to 36, 39 and 42), non-plating defects are not observed, the strength and the elongation are well balanced, and the plating exfoliation rate is as low as not more than 1% even when bending and bending-back forming is applied after giving the tensile strain of 20%. Further, it is understood that, when the other elements in plated layer as shown in Table 10 are contained in a plated layer, the plating properties are good even in the case where the value determined by left side of the equation 1 is relatively small.

On the other hand, in the case of the comparative steels, namely, C1 to C5 (Nos. 44 to 48), cracks were generated abundantly during the hot-rolling for producing the test specimens and the producibility was poor. The hot-rolled steel sheets were cold-rolled and annealed after cracks were removed by grinding the hot-rolled steel sheets obtained, and then used for the material quality tests. However, some of the steel sheets (C2 and C4) were very poor in plating adhesiveness after heavy working or could not withstand the forming of 20%.

As shown in Table 10, in Nos. 3, 21, 46 and 48, which do not satisfy the equation 1, the plating wettability deteriorates and the plating adhesiveness after heavy working is inferior. Also, in the case that the regulation on the microstructure of a steel sheet is not satisfied, the plating adhesion after revere deformation is inferior.

In case of No. 3, as the secondary cooling rate is slow, martensite and austenite are not generated but pearlite is generated instead, and the plating adhesion after severe deformation is inferior.

TABLE 9

Chemical composition, producibility and plating wettability

| Steel code | C | Si | Mn | Al | Mo | Cr | Ni | Cu | Co | Nb | Ti | V | B |
|---|---|---|---|---|---|---|---|---|---|---|---|---|---|
| D1 | 0.15 | 0.45 | 0.95 | 1.12 | | | | | | | | | |
| D2 | 0.16 | 0.48 | 0.98 | 0.95 | 0.15 | | | | | | | | |
| D3 | 0.13 | 1.21 | 1.01 | 0.48 | 0.12 | | | | | | | | |
| D4 | 0.03 | 0.49 | 1.11 | 1.51 | 0.19 | | | | | | | | |
| D5 | 0.03 | 0.69 | 1.21 | 0.62 | 0.09 | 0.09 | | | | | | | |
| D6 | 0.11 | 1.23 | 1.49 | 0.31 | | | 0.74 | 0.42 | | | | 0.005 | |
| D7 | 0.22 | 1.31 | 1.09 | 0.75 | 0.23 | | | | 0.08 | | | | |
| D8 | 0.07 | 0.91 | 1.56 | 0.03 | | | | | | 0.01 | 0.01 | | |
| D9 | 0.05 | 0.91 | 1.68 | 0.03 | 0.55 | 1.65 | | | | | | | 0.0026 |
| D10 | 0.18 | 0.11 | 1.1 | 0.67 | 0.08 | | | | | | | | |
| D11 | 0.17 | 0.21 | 0.9 | 1.2 | 0.38 | 0.1 | | | | | | | |
| D12 | 0.21 | 0.11 | 1.05 | 0.78 | | | | | | | | | |
| C1 | 0.12 | 0.32 | 2.81 | 4.56 | | | | | | | | | |
| C2 | 0.27 | 1.22 | 1.97 | 0.03 | 6.52 | | | | | | | | |
| C3 | 0.05 | 7.41 | 0.6 | 0.05 | | | | 0.54 | | | | | |
| C4 | 0.08 | 0.21 | 0.4 | 0.06 | | | | | | 3.22 | | | |
| C5 | 0.15 | 3.61 | 1.32 | 0.02 | | | | | | | | | 0.5 |

| Steel code | Zr | Hf | Ta | W | P | S | Y | REM |
|---|---|---|---|---|---|---|---|---|

TABLE 9-continued

| Chemical composition, producibility and plating wettability | | | | | | | | | |
|---|---|---|---|---|---|---|---|---|---|
| D1 | | | | | 0.02 | 0.005 | | | Invented steel |
| D2 | | | | | 0.01 | 0.008 | | | |
| D3 | | | | | 0.01 | 0.007 | | | |
| D4 | | | | | 0.02 | 0.001 | | | |
| D5 | | | | | 0.03 | 0.004 | | | |
| D6 | | | | | 0.01 | 0.003 | | | |
| D7 | | | | | 0.01 | 0.004 | | | |
| D8 | | | | | 0.02 | 0.004 | | | |
| D9 | | | | | 0.01 | 0.002 | | | |
| D10 | 0.01 | | | 0.05 | 0.02 | 0.03 | | 0.0007 | |
| D11 | | 0.01 | 0.02 | | 0.03 | 0.02 | | | |
| D12 | | | | 0.025 | 0.01 | 0.03 | 0.009 | | |
| C1 | | | | | | | | | Comparative steel |
| C2 | | | | | | | | | |
| C3 | | | | | | | | | |
| C4 | | | | | | | | | |
| C5 | | | | | | | | | |

The underlined numerals in the table are the conditions which are outside the range according to the present invention.

TABLE 10

Content of Al, Mn and Fe in plated layer and plating property

| Steel code | No | Al content in plated layer % | Mn content in plated layer % | Fe content in plated layer % ** | Value calculated by expression (1) | Other elements in plated layer | Application of alloying treatment | Occurrence of non-plating defect on steel sheet before working | Mechanical property TS/MPa | Mechanical property EL/% |
|---|---|---|---|---|---|---|---|---|---|---|
| D1 | 1 | 0.1 | 0.8 | 10 | 10.1 | | Yes | No | 575 | 39 |
| D1 | 2 | 0.1 | 0.8 | | 10.1 | | No | No | 585 | 42 |
| D1 | 3 | 0.18 | 0 | | 0.17 | | No | Trivial | 580 | 41 |
| D1 | 4 | 0.1 | 0.8 | 11 | 10.1 | | Yes | No | 530 | 31 |
| D2 | 5 | 0.03 | 0.1 | 8 | 2.98 | | Yes | No | 605 | 36 |
| D2 | 6 | 0.04 | 0.02 | 10 | 1.855 | Mo: 0.01 | Yes | No | 605 | 36 |
| D2 | 7 | 0.04 | 0.01 | 9 | 1.73 | Ca: 0.9, Mg: 0.005 | Yes | No | 605 | 36 |
| D2 | 8 | 0.04 | 0.01 | 9 | 1.73 | Ag: 0.5, Ni: 0.1 | Yes | No | 605 | 36 |
| D2 | 9 | 0.03 | 0.01 | 9 | 1.855 | Na 0.01, Ca: 0.01 | Yes | No | 605 | 36 |
| D2 | 10 | 0.04 | 0.01 | 9 | 1.73 | Pb: 0.4 | Yes | No | 605 | 35 |
| D2 | 11 | 0.03 | 0.05 | 8 | 2.355 | Ta: 0.02 | Yes | No | 605 | 36 |
| D2 | 12 | 0.03 | 0.1 | | 2.98 | | No | No | 615 | 37 |
| D3 | 13 | 0.01 | 0.2 | 10 | 3.53 | | Yes | No | 610 | 36 |
| D3 | 14 | 0.3 | 0.4 | 8 | 2.779 | Si: 0.01 | Yes | No | 610 | 36 |
| D3 | 15 | 0.3 | 0.2 | 10 | 0.279 | Ti: 0.08 | Yes | Trivial | 610 | 36 |
| D3 | 16 | 0.1 | 0.2 | 9 | 2.779 | Nd: 0.04 | Yes | No | 610 | 36 |
| D3 | 17 | 0.15 | 0.2 | 9 | 2.154 | Ba: 0.01 | Yes | No | 610 | 36 |
| D3 | 18 | 0.2 | 0.2 | 10 | 1.529 | In: 0.7 | Yes | No | 610 | 36 |
| D3 | 19 | 0.4 | 0.3 | 10 | 0.279 | K: 0.04 | Yes | No | 610 | 36 |
| D3 | 20 | 0.04 | 0.2 | | 3.53 | | No | No | 620 | 36 |
| D3 | 21 | 0.3 | 0 | 8 | 2.22 | | Yes | Frequent | 615 | 36 |
| D4 | 22 | 0.02 | 0.05 | 9 | 2.27 | | Yes | No | 665 | 40 |
| D6 | 23 | 1 | 1 | 15 | 1.78 | | Yes | No | 635 | 33 |
| D8 | 24 | 0.15 | 0.1 | 10 | 0.89 | | Yes | Trivial | 680 | 33 |
| D8 | 25 | 0.15 | 0.2 | 10 | 2.143 | Ca: 0.07 | Yes | No | 680 | 33 |
| D8 | 26 | 0.15 | 0.25 | 10 | 2.788 | Rb: 0.01 | Yes | No | 680 | 33 |
| D8 | 27 | 0.2 | 0.1 | 10 | 0.288 | Cd: 0.01 | Yes | Trivial | 680 | 33 |
| D8 | 28 | 0.2 | 0.1 | 10 | 0.288 | Cr: 0.03 | Yes | Trivial | 680 | 33 |
| D8 | 29 | 0.65 | 0.05 | 10 | 0.288 | Cu: 0.5, Ni: 0.2 | Yes | No | 680 | 33 |
| D8 | 30 | 0.25 | 0.16 | 9 | 0.288 | Ti: 0.05 | Yes | No | 680 | 33 |

| Steel code | No | Microstructure: Volume percent- | Volume percent- | Volume percent- | Volume percent- | Structure of | Average grain | Average grain | Average grain | Ratio of average grain size of ferrite | Exfoliation rate of plated layer after giving 20% tensile strain and then applying |
|---|---|---|---|---|---|---|---|---|---|---|---|

TABLE 10-continued

Content of Al, Mn and Fe in plated layer and plating property

| Steel code | No | age of ferrite/ % | auste-nite/% *** | marten-site/% *** | age of bainite/% *** | remainder portion/% *** | size of ferrite/ μm | size of auste-nite/μm | size of marten-site/μm | to that of second phase | 60° bending and bending-back forming/% | |
|---|---|---|---|---|---|---|---|---|---|---|---|---|
| D1 | 1 | 91.6 | 4.9 | 0 | 3.5 | *** | 12.5 | 2.2 | | 0.176 | 0 | Invented steel |
| D1 | 2 | 90.8 | 6.3 | 0 | 3.9 | *** | 12.2 | 2.5 | | 0.205 | 0.1 | Invented steel |
| D1 | 3 | 91.2 | 5.1 | 0 | 3.7 | *** | 11.8 | 2.3 | | 0.195 | 12 | Comparative steel |
| D1 | 4 | 85 | 0 | 0 | 0 | Pearlite 15% | 13.5 | | | | 4 | Comparative steel |
| D2 | 5 | 90.5 | 5.8 | 0 | 3.9 | *** | 10.1 | 2.3 | | 0.228 | 0 | Invented steel |
| D2 | 6 | 90.5 | 5.6 | 0 | 3.9 | *** | 10.1 | 2.5 | | 0.228 | 0 | Invented steel |
| D2 | 7 | 90.5 | 5.6 | 0 | 3.9 | *** | 10.1 | 2.3 | | 0.228 | 0 | Invented steel |
| D2 | 8 | 90.5 | 5.6 | 0 | 3.9 | *** | 10.1 | 2.3 | | 0.228 | 0 | Invented steel |
| D2 | 9 | 90.5 | 5.6 | 0 | 3.8 | *** | 10.1 | 2.3 | | 0.228 | 0 | Invented steel |
| D2 | 10 | 90.5 | 5.6 | 0 | 3.9 | *** | 10.1 | 2.3 | | 0.228 | 0 | Invented steel |
| D2 | 11 | 90.5 | 5.6 | 0 | 3.9 | *** | 10.1 | 2.3 | | 0.228 | 0 | Invented steel |
| D2 | 12 | 89.5 | 6.2 | 0 | 4.3 | *** | 10.2 | 2.5 | | 0.245 | 0.1 | Invented steel |
| D3 | 13 | 89.8 | 6.4 | 0 | 3.8 | *** | 8.9 | 2.6 | | 0.292 | 0 | Invented steel |
| D3 | 14 | 89.8 | 6.4 | 0 | 3.8 | *** | 8.9 | 2.6 | | 0.292 | 0 | Invented steel |
| D3 | 15 | 89.8 | 6.4 | 0 | 3.8 | *** | 8.9 | 2.6 | | 0.292 | 0.1 | Invented steel |
| D3 | 16 | 89.8 | 6.4 | 0 | 3.8 | *** | 8.9 | 2.6 | | 0.292 | 0 | Invented steel |
| D3 | 17 | 89.8 | 6.4 | 0 | 3.8 | *** | 8.9 | 2.6 | | 0.292 | 0 | Invented steel |
| D3 | 18 | 89.6 | 6.4 | 0 | 3.8 | *** | 8.9 | 2.6 | | 0.292 | 0 | Invented steel |
| D3 | 19 | 89.8 | 6.4 | 0 | 3.8 | *** | 8.9 | 2.6 | | 0.292 | 0 | Invented steel |
| D3 | 20 | 88.8 | 5.7 | 0 | 4.5 | *** | 9.7 | 2.7 | | 0.310 | 0.2 | Invented steel |
| D3 | 21 | 89.5 | 6.4 | 0 | 4.1 | *** | 8.5 | 2.8 | | 0.306 | 46 | Comparative steel |
| D4 | 22 | 93.7 | 3.5 | 0 | 2.8 | *** | 11.5 | 2.3 | | 0.200 | 0 | Invented steel |
| D6 | 23 | 88.8 | 0 | 6.1 | 3.1 | *** | 7.5 | | 3.4 | 0.453 | 0.3 | Invented steel |
| D8 | 24 | 85.4 | 8.1 | 0 | 6.5 | *** | 5.3 | 1.9 | | 0.358 | 0.5 | Invented steel |
| D8 | 25 | 85.4 | 8.1 | 0 | 6.5 | *** | 5.3 | 1.9 | | 0.358 | 0 | Invented steel |
| D8 | 26 | 85.4 | 8.1 | 0 | 6.5 | *** | 6.3 | 1.9 | | 0.358 | 0 | Invented steel |
| D8 | 27 | 85.4 | 8.1 | 0 | 6.5 | *** | 5.3 | 1.9 | | 0.358 | 0.1 | Invented steel |
| D8 | 28 | 85.4 | 8.1 | 0 | 6.5 | *** | 6.3 | 1.9 | | 0.358 | 0.1 | Invented steel |
| D8 | 29 | 85.4 | 8.1 | 0 | 6.5 | *** | 5.3 | 1.9 | | 0.358 | 0 | Invented steel |
| D8 | 30 | 85.4 | 8.1 | 0 | 6.5 | *** | 6.3 | 1.9 | | 0.358 | 0 | Invented steel |

| Steel code | No | Al content in plated layer % | Mn content in plated layer % | Fe content in plated layer % ** | Value calculated by expression (1) | Other elements in plated layer | Application of alloying treatment | Occurrence of non-plating defect on steel sheet before working | Mechanical property TS/MPa | Mechanical property EL/% |
|---|---|---|---|---|---|---|---|---|---|---|
| D6 | 31 | 0.1 | 0.1 | 10 | 1.518 | V: 0.05 | Yes | No | 880 | 33 |
| D7 | 32 | 0.04 | 0.5 | 15 | 6.97 | | Yes | Trivial | 810 | 32 |
| D7 | 33 | 0.04 | 0.5 | 15 | 6.97 | | No | Trivial | 890 | 18 |
| D8 | 34 | 0.4 | 0.8 | | 6.24 | | No | Trivial | 795 | 30 |
| D9 | 35 | 0.5 | 0.8 | | 5.7 | | No | Trivial | 845 | 27 |
| D10 | 36 | 0.5 | 0.7 | 11 | 4.99 | La: 0.005 | Yes | No | 620 | 33 |
| D10 | 37 | 0.5 | 0.4 | 10 | 1.24 | Zr: 0.01, W: 0.01 | Yes | Trivial | 620 | 33 |
| D10 | 38 | 0.4 | 0.25 | 9 | 0.615 | K: 0.04 | Yes | No | 620 | 33 |
| D11 | 39 | 0.3 | 0.2 | | 1.05 | Hf: 0.01 | No | No | 670 | 31 |
| D11 | 40 | 0.3 | 0.15 | | 0.425 | Mo: 0.01, Ta: 0.02 | No | No | 670 | 31 |
| D11 | 41 | 0.25 | 0.1 | | 0.425 | Co: 0.2, B: 0.005 | No | Trivial | 670 | 31 |
| D12 | 42 | 0.05 | 0.02 | 11 | 2.167 | Y: 0.01 | Yes | No | 620 | 37 |
| D12 | 43 | 0.1 | 0.01 | 11 | 1.417 | Mo: 0.02, K: 0.02 | Yes | No | 620 | 37 |
| C1 | 44 | 0.4 | 0.8 | 10 | 5.81 | | Yes | Trivial | 775 | 22 |
| C2 | 45 | 0.04 | 0.5 | | 7.23 | | No | Trivial | 995 | 12 |
| C3 | 46 | 0.01 | 0.01 | | 4.46 | | No | Poor plating wettability | | |
| C4 | 47 | 0.01 | 0.01 | 12 | 2.75 | | Yes | No | 895 | 13 |
| C5 | 48 | 0.01 | 0.01 | | 0.75 | | Yes | Poor plating wettability | | |

| Steel | Microstructure: Volume percentage of ferrite/ | Volume percentage of auste-nite/% | Volume percentage of marten-site/% | Volume percentage of bainite/% | Structure of remainder portion/% | Average grain size of ferrite/ | Average grain size of auste- | Average grain size of marten- | Ratio of average grain size of ferrite to that of second | Exfoliation rate of plated layer after giving 20% tensile strain and then applying 60° bending and bending-back |
|---|---|---|---|---|---|---|---|---|---|---|

TABLE 10-continued

| Content of Al, Mn and Fe in plated layer and plating property | | | | | | | | | | | | |
|---|---|---|---|---|---|---|---|---|---|---|---|---|
| code | No | % | *** | *** | *** | *** | μm | nite/μm | site/μm | phase | forming/% | |
| D6 | 31 | 85.4 | 8.1 | 0 | 6.5 | *** | 6.3 | 1.9 | | 0.358 | 0 | Invented steel |
| D7 | 32 | 82.5 | 9.7 | 0 | 7.8 | *** | 4.6 | 1.8 | | 0.391 | 0.4 | Invented steel |
| D7 | 33 | Main phase is composed of the mixture of ferrite and bainite.* | | | | | | | | | | Comparative steel |
| D8 | 34 | 83.5 | 0 | 11.2 | 5.3 | *** | 3.9 | | 2 | 0.513 | 0.5 | Invented steel |
| D9 | 35 | 89.5 | 0 | 10.5 | 0 | *** | 3.5 | | 1.8 | 0.514 | 0.7 | Invented steel |
| D10 | 36 | 92.5 | 4 | 0 | 3.5 | *** | 11 | 2.8 | | 0.255 | 0 | Invented steel |
| D10 | 37 | 92.5 | 4 | 0 | 3.5 | *** | 11 | 2.8 | | 0.255 | 0 | Invented steel |
| D10 | 38 | 92.5 | 4 | 0 | 3.5 | *** | 11 | 2.8 | | 0.255 | 0 | Invented steel |
| D11 | 39 | 89.3 | 0 | 9.2 | 1.5 | | 7 | | 2.2 | 0.314 | 0 | Invented steel |
| D11 | 40 | 89.3 | 0 | 9.2 | 1.5 | | 7 | | 2.2 | 0.314 | 0 | Invented steel |
| D11 | 41 | 89.3 | 0 | 9.2 | 1.5 | | 7 | | 2.2 | 0.314 | 0.1 | Invented steel |
| D12 | 42 | 88.5 | 7.5 | 0 | 4 | | 8.5 | 2.5 | | 0.294 | 0 | Invented steel |
| D12 | 43 | 88.5 | 7.5 | 0 | 4 | | 8.5 | 2.5 | | 0.294 | 0 | Invented steel |
| C1 | 44 | 77 | 0 | 0 | 23 | *** | 3.4 | | | | 75 | Comparative steel |
| C2 | 45 | Main phase is composed of the mixture of ferrite and bainite.* | | | | | | | | | | Comparative steel |
| C3 | 46 | | | | | | | | | | | Comparative steel |
| C4 | 47 | Main phase is composed of the mixture of ferrite and bainite.* | | | | | | | | | | Comparative steel |
| C5 | 48 | | | | | | | | | | | Comparative steel |

The underlined numerals in the table are the conditions which are outside the range according to the present invention.

*Main phase is composed of the mixture of ferrite and bainite and it is difficult to quantitatively identify them. Further, the rupture elongation is not more than 20%, which means low ductility, and therefore it is impossible to evaluate the plating adhesiveness after heavy working.

**In case that an alloying treatment is not applied, Fe is scarcely included in the plated layer.

***The sum of the volume percentage of each phase is 100%, and the phases which are hardly observed and identified by an optical microscope, such as carbides, oxides, sulfides, etc., are included in the volume percentage of the main phase.

TABLE 11

| Production condition and plating adhesiveness after heavy working | | | | | | |
|---|---|---|---|---|---|---|
| Steel code | No | Annealing condition: ° C. × min. | Primary cooling rate: ° C./s | Primary cooling halt temperature: ° C. | Secondary cooling rate: ° C./s | Secondary cooling halt temperature: ° C. |
| D1 | 1 | 800° C. × 3 min. | 1 | 680 | 10 | 465 |
| D1 | 2 | 800° C. × 3 min. | 1 | 680 | 10 | 465 |
| D1 | 3 | 800° C. × 3 min. | 1 | 680 | 0.5 | 465 |
| D1 | 4 | 800° C. × 3 min. | 1 | 680 | 10 | 465 |
| D2 | 5 | 800° C. × 3 min. | 1 | 680 | 10 | 470 |
| D2 | 12 | 800° C. × 3 min. | 1 | 680 | 10 | 470 |
| D3 | 13 | 810° C. × 3 min. | 1 | 680 | 5 | 470 |
| D3 | 20 | 810° C. × 3 min. | 1 | 680 | 5 | 470 |
| D3 | 21 | 810° C. × 3 min. | 1 | 680 | 5 | 470 |
| D4 | 22 | 830° C. × 3 min. | 0.5 | 680 | 3 | 475 |
| D5 | 23 | 830° C. × 3 min. | 0.5 | 680 | 7 | 475 |
| D6 | 24 | 830° C. × 3 min. | 0.3 | 650 | 8 | 480 |
| D7 | 32 | 800° C. × 3 min. | 1 | 680 | 10 | 470 |
| D7 | 33 | 1200° C. × 0.5 min. | 70 | 680 | 70 | 470 |
| D8 | 34 | 860° C. × 3 min. | 1 | 680 | 10 | 480 |
| D9 | 35 | 860° C. × 3 min. | 0.5 | 650 | 3 | 480 |
| D10 | 36 | 840° C. × 3 min. | 1 | 680 | 10 | 460 |
| D11 | 39 | 850° C. × 3 min. | 1 | 680 | 30 | 460 |
| D12 | 42 | 830° C. × 3 min. | 1 | 680 | 10 | 460 |
| C1 | 44 | 850° C. × 3 min. | 5 | 680 | 30 | 470 |
| C2 | 45 | 850° C. × 3 min. | 1 | 690 | 10 | 470 |
| C3 | 46 | 1000° C. × 3 min. | 5 | 680 | 10 | 470 |
| C4 | 47 | 850° C. × 3 min. | 5 | 680 | 30 | 470 |
| C5 | 48 | 950° C. × 3 min. | 1 | 680 | 30 | 470 |

| Steel code | No | Retaining conditions including zinc plating treatment | Alloying processing temperature: ° C. | Alloying processing time: |
|---|---|---|---|---|
| D1 | 1 | For 18 seconds at a temperature of 465 to 460° C. | 515 | 25 |
| D1 | 2 | For 23 seconds at a temperature of 465 to 460° C. | No | No |
| D1 | 3 | For 23 seconds at a temperature of 465 to 460° C. | No | No |

TABLE 11-continued

| Production condition and plating adhesiveness after heavy working | | | | |
|---|---|---|---|---|
| D1 | 4 | For 18 seconds at a temperature of 465 to 460° C. | 600 | 25 |
| D2 | 5 | For 15 seconds at a temperature of 470 to 460° C. | 520 | 25 |
| D2 | 12 | For 25 seconds at a temperature of 470 to 460° C. | No | No |
| D3 | 13 | For 18 seconds at a temperature of 470 to 460° C. | 510 | 25 |
| D3 | 20 | For 33 seconds at a temperature of 470 to 460° C. | No | No |
| D3 | 21 | For 25 seconds at a temperature of 470 to 460° C. | 510 | 25 |
| D4 | 22 | For 20 seconds at a temperature of 475 to 460° C. | 515 | 25 |
| D5 | 23 | For 5 seconds at a temperature of 475 to 460° C. | 520 | 25 |
| D6 | 24 | For 20 seconds at a temperature of 480 to 460° C. | 520 | 25 |
| D7 | 32 | For 25 seconds at a temperature of 470 to 460° C. | 520 | 25 |
| D7 | 33 | For 25 seconds at a temperature of 470 to 460° C. | No | No |
| D8 | 34 | For 5 seconds at a temperature of 480 to 460° C. | No | No |
| D9 | 35 | For 5 seconds at a temperature of 480 to 460° C. | No | No |
| D10 | 36 | For 20 seconds at the temperature of 460° C. | 510 | 25 |
| D11 | 39 | For 5 seconds at the temperature of 460° C. | No | No |
| D12 | 42 | For 20 seconds at the temperature of 460° C. | 510 | 25 |
| C1 | 44 | For 15 seconds at a temperature of 470 to 460° C. | 510 | 25 |
| C2 | 45 | For 5 seconds at a temperature of 470 to 460° C. | No | No |
| C3 | 46 | For 15 seconds at a temperature of 470 to 460° C. | No | No |
| C4 | 47 | For 15 seconds at a temperature of 470 to 460° C. | 510 | 25 |
| C5 | 48 | For 15 seconds at a temperature of 470 to 460° C. | 510 | 25 |

| Steel code | No | Exfoliation rate of plated layer after giving 20% tensile strain and then applying 60° bending and bending-back forming | |
|---|---|---|---|
| D1 | 1 | 0 | Invented steel |
| D1 | 2 | 0.1 | Invented steel |
| D1 | 3 | 12 | Comparative steel |
| D1 | 4 | 4 | Comparative steel |
| D2 | 5 | 0 | Invented steel |
| D2 | 12 | 0.1 | Invented steel |
| D3 | 13 | 0–0.1 | Invented steel |
| D3 | 20 | 0.2 | Invented steel |
| D3 | 21 | 46 | Comparative steel |
| D4 | 22 | 0 | Invented steel |
| D5 | 23 | 0.3 | Invented steel |
| D6 | 24 | 0–0.5 | Invented steel |
| D7 | 32 | 0.4 | Invented steel |
| D7 | 33 | Unbearable to 20% tensile stress | Comparative steel |
| D8 | 34 | 0.5 | Invented steel |
| D9 | 35 | 0.7 | Invented steel |
| D10 | 36 | 0 | Invented steel |
| D11 | 39 | 0 | Invented steel |
| D12 | 42 | 0–0.1 | Invented steel |
| C1 | 44 | Unbearable to 20% tensile stress | Comparative steel |
| C2 | 45 | Unbearable to 20% tensile stress | Comparative steel |
| C3 | 46 | Non-plating defects generated prior to tensile test | Comparative steel |

TABLE 11-continued

| Production condition and plating adhesiveness after heavy working | | | |
|---|---|---|---|
| C4 | 47 | Unbearable to 20% tensile stress | Comparative steel |
| C5 | 48 | Non-plating defects generated prior to tensile test | Comparative steel |

The underlined numerals in the table are the conditions which are outside the range according to the present invention.
Primary cooling rate: cooling rate in the temperature range from after annealing up to 650 to 700° C.
Secondary cooling rate: cooling rate in the temperature range from 650 to 700° C. to plating bath temperature to plating bath temperature +100° C.

Example of Embodiment 2

The present invention will hereunder be explained in detail based on Example of Embodiment 2.

Steels having chemical compositions shown in Table 12 were heated to the temperature of 1,180 to 1,250° C.; the hot-rolling of the steels was finished at a temperature of 880 to 1,100° C.; and the hot-rolled steel sheets were cooled and then coiled at a temperature of not less than the bainite transformation commencement temperature which was determined by the chemical composition of each steel, pickled, and cold-rolled into cold-rolled steel sheets 1.0 mm in thickness.

After that, the $Ac_1$ transformation temperature and the $Ac_3$ transformation temperature were calculated from the components (in mass %) of each steel according to the following equations:

$$Ac_1=723-10.7\times Mn\ \%+29.1\times Si\ \%,$$

$$Ac_3=910-203\times(C\ \%)^{1/2}+44.7\times Si\ \%+31.5\times Mo\ \%-30\times Mn\ \%-11\times Cr\ \%+400\times Al\ \%.$$

The steel sheets were plated by: heating them to the annealing temperature calculated from the $Ac_1$ transformation temperature and the $Ac_3$ transformation temperature and retaining them in the $N_2$ atmosphere containing 10% of $H_2$; thereafter, cooing them in the temperature range from 650 to 700° C. at a cooling rate of 0.1 to 10° C./sec.; successively cooling them to the plating bath temperature at a cooling rate of 0.1 to 20° C./sec.; and dipping them in the zinc plating bath of 460 to 470° C. for 3 seconds, wherein the compositions of the plating bath were varied, rolled in the skin-pass line at the reduction rate of 0.5-2.0%.

Further, as the Fe—Zn alloying treatment, some of the steel sheets were retained in the temperature range from 400 to 550° C. for 15 seconds to 20 minutes after they were plated and Fe contents in the plated layers were adjusted so as to be 5 to 20% in mass. The plating appearance was evaluated by visually observing the state of dross entanglement on the surface and measuring the area of non-plated portions. The compositions of the plated layers were determined by dissolving the plated layers in 5% hydrochloric acid solution containing an inhibitor and chemically analyzing the solution, and the results are shown in Table 13.

From Tables 13 and 14, in the steels according to the present invention, which satisfy the expression (2), the all appearance evaluation ranks are 5, and the strength and the elongation are well balanced. On the other hand, in the comparative steels which do not satisfy the ranges specified in the present invention, the appearance evaluation ranks are low without exception, and the strength and the elongation are badly balanced. Further, in the steels produced within the ranges specified in the claims of the present invention, the microstructures are composed of the aforementioned structures, and the steels are excellent in appearance and the balance between strength and elongation.

TABLE 12

| Chemical composition | | | | | | | | | | | | | | | |
|---|---|---|---|---|---|---|---|---|---|---|---|---|---|---|---|
| Steel code | C | Si | Mn | AL | Mo | P | S | Cr | Ni | Cu | Co | W | Nb | Ti | V |
| A | 0.19 | 0.009 | 1.1 | 0.95 | 0.13 | 0.02 | 0.005 | | | | | | | | |
| B | 0.15 | 0.09 | 1.25 | 1.1 | 0.21 | 0.01 | 0.004 | | | | | | | | |
| C | 0.18 | 0.005 | 0.9 | 1.05 | 0.14 | 0.01 | 0.006 | | | | | | | | |
| D | 0.17 | 0.005 | 0.8 | 0.65 | 0.05 | 0.01 | 0.006 | 0.05 | | | | 0.11 | | | |
| E | 0.15 | 0.05 | 0.81 | 1.52 | 0.22 | 0.015 | 0.002 | | 0.42 | 0.25 | 0.01 | | | | |
| F | 0.22 | 0.008 | 1.73 | 0.67 | 0.22 | 0.025 | 0.003 | | | | | | 0.01 | 0.01 | |
| G | 0.08 | 0.007 | 1.23 | 1.34 | 0.13 | 0.01 | 0.005 | | | | | | | | 0.01 |
| H | 0.09 | 0.007 | 1.41 | 1.8 | 0.05 | 0.02 | 0.004 | | | | | | | | |
| I | 0.24 | 0.01 | 0.87 | 1.63 | 0.21 | 0.02 | 0.003 | | | | | | | | |
| J | 0.14 | 0.08 | 1.12 | 0.52 | 0.05 | 0.01 | 0.002 | | | | 0.15 | 0.05 | | | |
| CA | 0.12 | 9.52 | 1.85 | 0.03 | 0.1 | 0.01 | 0.003 | | | | | | | | |
| CB | 0.19 | 0.08 | 2.56 | 0.03 | 4.5 | 0.02 | 0.004 | | | | | | | | |
| CC | 0.13 | 0.15 | 1.68 | 0.03 | 0.78 | 0.01 | 0.004 | | | | | | 0.18 | 0.57 | |
| CD | 0.06 | 0.52 | 2.98 | 0.05 | 0.95 | 0.02 | 0.005 | | 0.6 | 5.8 | | | | | |
| CE | 0.23 | 0.01 | 2.61 | 0.04 | 0.5 | 0.02 | 0.002 | 2.3 | 0.3 | | | | | | |

| Steel code | Zr | Hf | Ta | B | Mg | Ca | Y | Ce | Rem | Remarks |
|---|---|---|---|---|---|---|---|---|---|---|
| A | | | | | | | | | | Invented steel |

TABLE 12-continued

| Chemical composition | | | | | | | | | | |
|---|---|---|---|---|---|---|---|---|---|---|
| B | | | | | | | | | | Invented steel |
| C | | | | | | | | | | Invented steel |
| D | | | | | | | | | | Invented steel |
| E | | | | | | 0.0008 | | | 0.0003 | Invented steel |
| F | | | | | 0.0005 | | | | | Invented steel |
| G | 0.01 | 0.005 | 0.005 | | | | | 0.0006 | 0.0005 | Invented steel |
| H | | | | 0.001 | | | 0.0003 | | | Invented steel |
| I | | | | | | | | | | Invented steel |
| J | | | | | | | | | | Invented steel |
| CA | | | | | | | | | | Comparative steel |
| CB | | | | | | | | | | Comparative steel |
| CC | | | | | 0.02 | | | | | Comparative steel |
| CD | | | | | | | | | 0.64 | Comparative steel |
| CE | | | | 0.15 | | | | | | Comparative steel |

(Note)
The underlined numerals are the conditions which are outside the range according to the present invention.

TABLE 13

| Plating wettability, corrosion resistance, microstructure and fatigue life of each steel | | | | | | | | |
|---|---|---|---|---|---|---|---|---|
| Steel code | Treatment number | Mn content in plated layer % | Al content in plated layer % | Mo content in plated layer % | Fe content in plated layer % | Value calculated by expression (1) | Other elements in plated layer % | Application of alloying heat treatment after plating treatment | Appearance evaluation rank | |
| A | 1 | 0.01 | 0.1 | 0.0001 | | 0.43 | | No | 5 | Invented steel |
| A | 2 | 0.05 | 0.15 | 0.001 | 12 | 0.38 | | Yes | 5 | Invented steel |
| A | 3 | 0.04 | 0.6 | 0.001 | 11 | −0.07 | | Yes | 3 | Comparative steel |
| B | 4 | 0.03 | 0.3 | 0.001 | | 0.141 | | | | |
| B | 5 | 0.11 | 0.4 | 0.002 | 10 | 0.041 | | | | |
| B | 6 | 0.04 | 0.4 | <0.0001 | | 0.041 | | | | |
| C | 7 | 0.1 | 0.3 | 0.002 | 12 | 0.245 | | | | |
| C | 8 | 0.04 | 0.8 | 0.003 | 11 | −0.26 | | | | |
| D | 9 | 0.7 | 0.5 | <0.0001 | | 0.051 | | | | |
| D | 10 | 0.6 | 0.4 | 0.002 | 10 | 0.151 | | | | |
| E | 11 | 0.2 | 0.3 | 0.005 | 11 | 0.205 | | | | |
| E | 12 | 0.15 | 0.4 | 0.002 | 10 | 0.105 | | | | |
| E | 13 | 0.3 | 0.3 | 0.005 | 10 | 0.205 | | | | |
| F | 14 | 0.5 | 0.45 | 0.001 | | 0.046 | | | | |
| F | 15 | 0.1 | 0.05 | 0.003 | 9 | 0.446 | | | | |
| G | 16 | 1 | 0.5 | 0.002 | 10 | 0.025 | | | | |
| G | 17 | 1 | 0.4 | 0.002 | 10 | 0.125 | | | | |
| H | 18 | 0.5 | 0.7 | 0.0003 | | −0.19 | | | | |
| H | 19 | 0.4 | 0.35 | 0.0002 | 10 | 0.165 | | | | |
| H | 20 | 0.5 | 0.45 | 0.0002 | 9 | 0.065 | | | | |
| I | 21 | 0.7 | 0.1 | 0.001 | 11 | 0.442 | | | | |
| I | 22 | 0.7 | 0.5 | 0.003 | 12 | 0.042 | | | | |
| I | 23 | 1 | 0.4 | 0.002 | 12 | 0.142 | | | | |
| I | 24 | 0.05 | 0.45 | 0.004 | 11 | 0.092 | | | | |
| I | 25 | 0.5 | 0.3 | 0.007 | 12 | 0.242 | | | | |
| I | 26 | 0.5 | 0.35 | 0.001 | | 0.192 | | | | |
| I | 27 | 0.6 | 0.13 | <0.0001 | | 0.412 | | | | |
| J | 28 | 0.05 | 0.34 | 0.0002 | 11 | 0.118 | | | | |
| J | 29 | 0.06 | 0.2 | <0.0001 | 10 | 0.258 | | | | |
| J | 30 | 0.06 | 0.45 | 0.0001 | | 0.008 | | | | |
| CA | 31 | 0.1 | 0.2 | 0.007 | 9 | −3.22 | | | | |
| CB | 32 | 1.5 | 0.3 | 0.08 | 8 | 0.078 | | | | |
| CC | 33 | 0.5 | 0.4 | 0.007 | | −0.04 | | | | |
| CD | 34 | Many cracks occurred during hot-rolling | | | | | | | | |
| CE | 35 | Many cracks occurred during hot-rolling | | | | | | | | |

TABLE 13-continued

| Plating wettability, corrosion resistance, microstructure and fatigue life of each steel | | | |
|---|---|---|---|
| | No | 5 | Invented steel |
| Si: 0.001 | Yes | 5 | Invented steel |
| | No | 3 | Comparative steel |
| | Yes | 5 | Invented steel |
| | Yes | 2 | Comparative steel |
| Cr: 0.004, W: 0.005 | No | 3 | Comparative steel |
| Cr: 0.005, W: 0.007 | Yes | 5 | Invented steel |
| K: 0.01 | Yes | 5 | Invented steel |
| Ag: 0.004 | Yes | 5 | Invented steel |
| Ni: 0.01, Cu: 0.01, Co: 0.002 | Yes | 5 | Invented steel |
| Ti: 0.002, Cs: 0.003 | No | 5 | Invented steel |
| Rb: 0.002 | Yes | 5 | Invented steel |
| V: 0.003, Zr: 0.003, Hf: 0.002, Ta: 0.002 | Yes | 5 | Invented steel |
| V: 0.002, Zr: 0.002, Nd: 0.007 | Yes | 5 | Invented steel |
| B: 0.002, Y: 0.003 | No | 3 | Comparative steel |
| B: 0.003, Y: 0.002 | Yes | 5 | Invented steel |
| Na: 0.007 | Yes | 5 | Invented steel |
| Cd: 0.01 | Yes | 5 | Invented steel |
| La: 0.02 | Yes | 5 | Invented steel |
| Tl: 0.02 | Yes | 5 | Invented steel |
| In: 0.005 | Yes | 5 | Invented steel |
| Be: 0.01 | Yes | 5 | Invented steel |
| Pb: 0.02 | No | 5 | Invented steel |
| | No | 4 | Comparative steel |
| | No | 5 | Invented steel |
| W: 0.005, Co: 0.02 | Yes | 4 | Comparative steel |
| W: 0.01, Co: 0.03, Tc: 0.002, Ge: 0.008 | Yes | 5 | Invented steel |
| | Yes | 2 | Comparative steel |
| Ag: 0.01 | Yes | 5 | Comparative steel |
| | No | 3 | Comparative steel |
| | | | Comparative steel |
| | | | Comparative steel |

| Steel code | Treatment number | Kind of main phase | Volume percentage of ferrite/% * | Average grain size of main phase /μm | Volume percentage of marten-site/% |
|---|---|---|---|---|---|
| A | 1 | Ferrite | 88 | 11 | 0 |
| A | 2 | Ferrite | 88.5 | 9 | 0 |
| A | 3 | Ferrite | Pearlite generated | 21 | 0 |
| B | 4 | Ferrite | 90.5 | 12 | 0 |
| B | 5 | Ferrite | 91.5 | 14 | 0 |
| B | 6 | Ferrite | 35 | 11 | 65 |
| C | 7 | Ferrite | 90.5 | 12 | 0 |
| C | 8 | Ferrite | 91 | 10 | 0 |
| D | 9 | Ferrite | Pearlite generated | 11 | 0 |
| D | 10 | Ferrite | 89 | 11 | 0 |
| E | 11 | Ferrite | 88 | 6 | 0 |
| E | 12 | Ferrite | 85.5 | 7 | 0 |
| E | 13 | Ferrite | 88.5 | 6 | 0 |
| F | 14 | Ferrite | 86 | 5 | 0 |
| F | 15 | Ferrite | 84.5 | 6 | 0 |
| G | 16 | Ferrite | 88 | 5 | 10 |
| G | 17 | Ferrite | 88 | 5 | 11 |
| H | 18 | Ferrite | 87 | 6 | 10 |
| H | 19 | Ferrite | 88 | 5 | 9 |
| H | 20 | Ferrite | 89 | 5 | 9 |

TABLE 13-continued

Plating wettability, corrosion resistance, microstructure and fatigue life of each steel

| | | | | | |
|---|---|---|---|---|---|
| I | 21 | Ferrite | 83 | 7 | 0 |
| I | 22 | Ferrite | 84 | 6 | 0 |
| I | 23 | Ferrite | 82 | 7 | 0 |
| I | 24 | Ferrite | 83 | 7 | 0 |
| I | 25 | Ferrite | 85.5 | 7 | 0 |
| I | 26 | Ferrite | 79 | 8 | 0 |
| I | 27 | Ferrite | 82 | 8 | 0 |
| J | 28 | Ferrite | 90.5 | 10 | 0 |
| J | 29 | Ferrite | 84.5 | 15 | 0 |
| J | 30 | Ferrite | 90.5 | 11 | 0 |
| CA | 31 | Ferrite | 100 | 10 | 0 |
| CB | 32 | Bainite | Immeasurable | Immeasurable | Immeasurable |
| CC | 33 | Bainite | Immeasurable | Immeasurable | Immeasurable |
| CD | 34 | Many cracks occurring bat-rolling | | | |
| CE | 35 | Many cracks occurring bat-rolling | | | |

| Steel code | Treatment number | Volume percentage of austenite/% | Volume percentage of bainite/% * | Average grain size of martensite or austenite | Value calculated by expression (2) |
|---|---|---|---|---|---|
| A | 1 | 8 | 4 | 2.5 | 2.3225 |
| A | 2 | 7.5 | 4 | 2 | 2.48083 |
| A | 3 | 0 | 0 | | |
| B | 4 | 6 | 3.5 | 3 | 3.11417 |
| B | 5 | 5.5 | 3 | 3 | 3.40205 |
| B | 6 | 0 | 0 | | |
| C | 7 | 6.5 | 3 | 2 | 2.87058 |
| C | 8 | 6 | 3 | 1.9 | 3.11417 |
| D | 9 | 0 | 0 | | |
| D | 10 | 6 | 5 | 2.2 | 3.11417 |
| E | 11 | 7 | 5 | 1.8 | 2.66179 |
| E | 12 | 7.5 | 6 | 1.5 | 2.48083 |
| E | 13 | 6.5 | 5 | 2 | 2.87058 |
| F | 14 | 8 | 6 | 1.8 | 2.3225 |
| F | 15 | 9 | 6.5 | 1.9 | 2.05861 |
| G | 16 | 0 | 2 | 0.75 | |
| G | 17 | 0 | 1 | 0.8 | |
| H | 18 | 0 | 3 | 1.2 | |
| H | 19 | 0 | 3 | 0.8 | |
| H | 20 | 0 | 2 | 0.75 | |
| I | 21 | 12 | 5 | 1.5 | 1.53083 |
| I | 22 | 11 | 5 | 1.3 | 1.67477 |
| I | 23 | 12 | 6 | 1.5 | 1.53083 |
| I | 24 | 12 | 5 | 1.4 | 1.53083 |
| I | 25 | 10 | 4.5 | 1.3 | 1.8475 |
| I | 26 | 14 | 7 | 1.2 | 1.30464 |
| I | 27 | 12 | 6 | 1.2 | 1.53083 |
| J | 28 | 6.5 | 3 | 2 | 2.87058 |
| J | 29 | 9.5 | 6 | 2 | 1.9475 |
| J | 30 | 6 | 3.5 | 1.8 | 3.11417 |
| CA | 31 | 0 | 0 | | |
| CB | 32 | Immeasurable | Immeasurable | | |
| CC | 33 | Immeasurable | Immeasurable | | |
| CD | 34 | | | | |
| CE | 35 | | | | |

| Steel code | Treatment number | Tensile strength/MPa | Elongation/% | Tensile strength (MPa) × elongation (%) | |
|---|---|---|---|---|---|
| A | 1 | 635 | 39 | 24765 | Invented steel |
| A | 2 | 630 | 38 | 23940 | Invented steel |
| A | 3 | 530 | 36 | 19080 | Comparative steel |
| B | 4 | 550 | 42 | 23100 | Invented steel |
| B | 5 | 540 | 43 | 23220 | Invented steel |
| B | 6 | 825 | 15 | 12375 | Comparative steel |
| C | 7 | 595 | 40 | 23800 | Invented steel |
| C | 8 | 590 | 40 | 23600 | Comparative steel |
| D | 9 | 540 | 33 | 17820 | Comparative steel |
| D | 10 | 590 | 39 | 23010 | Invented steel |
| E | 11 | 700 | 33 | 23100 | Invented steel |
| E | 12 | 700 | 33 | 23100 | Invented steel |
| E | 13 | 680 | 34 | 23120 | Invented steel |

TABLE 13-continued

| Plating wettability, corrosion resistance, microstructure and fatigue life of each steel | | | | | |
|---|---|---|---|---|---|
| F | 14 | 795 | 32 | 25440 | Invented steel |
| F | 15 | 780 | 31 | 24180 | Invented steel |
| G | 16 | 805 | 24 | 19320 | Invented steel |
| G | 17 | 820 | 23 | 18860 | Invented steel |
| H | 18 | 815 | 23 | 18745 | Comparative steel |
| H | 19 | 790 | 24 | 18960 | Invented steel |
| H | 20 | 785 | 24 | 18840 | Invented steel |
| I | 21 | 780 | 29 | 22620 | Invented steel |
| I | 22 | 785 | 29 | 22765 | Invented steel |
| I | 23 | 790 | 28 | 22120 | Invented steel |
| I | 24 | 780 | 29 | 22620 | Invented steel |
| I | 25 | 780 | 29 | 22620 | Invented steel |
| I | 26 | 805 | 28 | 22540 | Invented steel |
| I | 27 | 790 | 29 | 22910 | Comparative steel |
| J | 28 | 605 | 39 | 23595 | Invented steel |
| J | 29 | 580 | 36 | 20880 | Comparative steel |
| J | 30 | 595 | 39 | 23205 | Invented steel |
| CA | 31 | 620 | 22 | | Comparative steel |
| CB | 32 | 1155 | 4 | | Comparative steel |
| CC | 33 | 965 | 7 | | Comparative steel |
| CD | 34 | | | | Comparative steel |
| CE | 35 | | | | Comparative steel |

(Note)
The underlined bold type numerals are the conditions which are outside the range according to the present invention.
*The sum of the volume percentage of each phase is 100%, and the phases which are hardly observed and identified by an optical microscope, such as carbides, oxides, sulfides, etc., are included in the volume percentage of the main phase. In case that the main phase is composed of bainite, since the structure is very fine, it is difficult to quantitatively measure each grain size and the volume percentage of each phase.

TABLE 14

| Production method and each property | | | | | | | | |
|---|---|---|---|---|---|---|---|---|
| Steel code | Treatment number | Heating temperature prior to hot-rolling/° C. | Finishing temperature of hot-rolling/° C. | $Ac_3$ (calculated + 50 (° C.)/° C. | 0.1 × ($Ac_3$ − $Ac_1$) + $Ac_1$ (calculated) | Maximum temperature during annealing/° C. | Primary cooling rate/° C. /S | Primary cooling halt temperature/° C. |
| A | 1 | 1200 | 900 | 1223 | 758 | 830 | 3 | 700 |
| A | 2 | 1200 | 900 | 1223 | 758 | 830 | 3 | 680 |
| A | 3 | 1200 | 900 | 1223 | 758 | 830 | 3 | 600 |
| B | 4 | 1220 | 910 | 1295 | 765 | 820 | 1 | 680 |
| B | 5 | 1220 | 910 | 1295 | 765 | 820 | 1 | 680 |
| B | 6 | 1120 | 820 | 1295 | 765 | 1300 | 50 | 680 |
| C | 7 | 1200 | 890 | 1272 | 763 | 820 | 1 | 680 |
| C | 8 | 1200 | 890 | 1272 | 763 | 820 | 1 | 680 |
| D | 9 | 1200 | 910 | 1114 | 749 | 830 | 1 | 700 |
| D | 10 | 1200 | 910 | 1114 | 749 | 830 | 1 | 700 |
| E | 11 | 1200 | 895 | 1474 | 787 | 850 | 0.5 | 680 |
| E | 12 | 1200 | 895 | 1474 | 787 | 850 | 0.5 | 680 |
| E | 13 | 1200 | 895 | 1474 | 787 | 850 | 0.5 | 690 |
| F | 14 | 1230 | 920 | 1088 | 738 | 850 | 2 | 690 |
| F | 15 | 1230 | 920 | 1088 | 738 | 850 | 2 | 660 |
| G | 16 | 1200 | 900 | 1406 | 775 | 810 | 8 | 660 |
| G | 17 | 1200 | 900 | 1406 | 775 | 810 | 10 | 700 |
| H | 18 | 1210 | 890 | 1579 | 790 | 850 | 10 | 680 |
| H | 19 | 1210 | 890 | 1579 | 790 | 850 | 10 | 680 |
| H | 20 | 1210 | 890 | 1579 | 790 | 850 | 10 | 670 |
| I | 21 | 1190 | 890 | 1494 | 787 | 850 | 1 | 690 |
| I | 22 | 1190 | 890 | 1494 | 787 | 840 | 1 | 680 |
| I | 23 | 1190 | 890 | 1494 | 787 | 830 | 1 | 670 |
| I | 24 | 1190 | 890 | 1494 | 787 | 820 | 1 | 670 |
| I | 25 | 1190 | 890 | 1494 | 787 | 810 | 1 | 670 |
| I | 26 | 1190 | 890 | 1494 | 787 | 850 | 1 | 690 |
| I | 27 | 1190 | 890 | 1494 | 787 | 1050 | 0.01 | 690 |
| J | 28 | 1230 | 920 | 1064 | 743 | 850 | 1 | 700 |
| J | 29 | 1300 | 970 | 1064 | 743 | 950 | 0.02 | 710 |
| J | 30 | 1230 | 920 | 1064 | 743 | 850 | 1 | 680 |
| CA | 31 | 1200 | 900 | 1007 | 821 | 820 | 1 | 700 |
| CB | 32 | 1200 | 890 | 952 | 718 | 820 | 5 | 700 |
| CC | 33 | 1200 | 910 | 880 | 721 | 820 | 5 | 700 |

TABLE 14-continued

| Production method and each property | | | | | | |
|---|---|---|---|---|---|---|
| CD | 34 | 1200 | Many cracks occurred during hot-rolling and cold-rolling disfavor | | | |
| CE | 35 | 1200 | Many cracks occurred during hot-rolling and cold-rolling disfavor | | | |
| Steel code | Treatment number | Secondary cooling rate/° C./S | Retaining conditions including zinc plating treatment | Alloying temperature/ ° C. | Mn content in plated layer % | Al content in plated layer % |
| A | 1 | 7 | For 15 seconds at a temperature of 465 to 455° C. | | 0.01 | 0.1 |
| A | 2 | 10 | For 15 seconds at a temperature of 465 to 455° C. | 510 | 0.05 | 0.15 |
| A | 3 | 0.03 | For 15 seconds at a temperature of 465 to 455° C. | 580 | 0.04 | 0.6 |
| B | 4 | 5 | For 30 seconds at a temperature of 465 to 460° C. | | 0.03 | 0.3 |
| B | 5 | 5 | For 30 seconds at a temperature of 465 to 460° C. | 510 | 0.11 | 0.4 |
| B | 6 | 150 | For 3 seconds at a temperature of 465 to 460° C. | | 0.04 | 0.4 |
| C | 7 | 10 | For 15 seconds at a temperature of 475 to 460° C. | 510 | 0.1 | 0.3 |
| C | 8 | 10 | For 15 seconds at a temperature of 475 to 460° C. | 510 | 0.04 | 0.8 |
| D | 9 | 5 | For 300 seconds at a temperature of 540 to 460° C. | | 0.7 | 0.5 |
| D | 10 | 7 | For 5 seconds at a temperature of 475 to 460° C. | 500 | 0.8 | 0.4 |
| E | 11 | 5 | For 30 seconds at a temperature of 465 to 460° C. | 505 | 0.2 | 0.3 |
| E | 12 | 5 | For 30 seconds at a temperature of 465 to 460° C. | 505 | 0.15 | 0.4 |
| E | 13 | 5 | For 30 seconds at a temperature of 465 to 460° C. | 505 | 0.3 | 0.3 |
| F | 14 | 15 | For 60 seconds at a temperature of 470 to 460° C. | | 0.5 | 0.45 |
| F | 15 | 15 | For 30 seconds at a temperature of 470 to 460° C. | 505 | 0.1 | 0.05 |
| G | 16 | 20 | For 3 seconds at a temperature of 470 to 460° C. | 505 | 1 | 0.5 |
| G | 17 | 20 | For 3 seconds at a temperature of 470 to 460° C. | 505 | 1 | 0.4 |
| H | 18 | 15 | For 5 seconds at a temperature of 470 to 460° C. | | 0.5 | 0.7 |
| H | 19 | 20 | For 3 seconds at a temperature of 470 to 460° C. | 500 | 0.4 | 0.35 |
| H | 20 | 15 | For 3 seconds at a temperature of 475 to 460° C. | 500 | 0.5 | 0.45 |
| I | 21 | 10 | For 100 seconds at a temperature of 465 to 460° C. | 510 | 0.7 | 0.1 |
| I | 22 | 10 | For 60 seconds at a temperature of 465 to 460° C. | 510 | 0.7 | 0.5 |
| I | 23 | 10 | For 30 seconds at a temperature of 465 to 460° C. | 520 | 1 | 0.4 |
| I | 24 | 10 | For 15 seconds at a temperature of 465 to 460° C. | 520 | 0.05 | 0.45 |
| I | 25 | 10 | For 15 seconds at a temperature of 465 to 460° C. | 520 | 0.5 | 0.3 |
| I | 26 | 10 | For 100 seconds at a temperature of 465 to 460° C. | | 0.5 | 0.35 |
| I | 27 | 10 | For 15 seconds at a temperature of 465 to 460° C. | | 0.5 | 0.13 |
| J | 28 | 10 | For 30 seconds at a temperature of 475 to 460° C. | | 0.05 | 0.34 |
| J | 29 | 7 | For 50 seconds at a temperature of 475 to 460° C. | 515 | 0.06 | 0.2 |
| J | 30 | 10 | For 30 seconds at a temperature of 475 to 460° C. | 515 | 0.06 | 0.45 |
| CA | 31 | 1 | For 30 seconds at a temperature of 475 to 460° C. | 520 | 0.1 | 0.2 |
| CB | 32 | 30 | For 30 seconds at a temperature of 465 to 460° C. | 520 | 1.5 | 0.3 |

TABLE 14-continued

| Production method and each property | | | | | | | | | |
|---|---|---|---|---|---|---|---|---|---|
| CC | 33 | 30 | For 30 seconds at a temperature of 475 to 460° C. | | | | | 0.5 | 0.4 |
| CD | 34 | | | | | | | | |
| CE | 35 | | | | | | | | |

| Steel code | Treatment number | Mo content in plated layer % | Fe content in plated layer % | Value calculated by expression (1) | Appearance evaluation rank | Tensile strength/ MPa | Elongation /% | Steel code | |
|---|---|---|---|---|---|---|---|---|---|
| A | 1 | 0.0001 | | 0.4299 | 5 | 635 | 39 | A | Invented steel |
| A | 2 | 0.001 | 12 | 0.3799 | 5 | 630 | 38 | A | Invented steel |
| A | 3 | 0.001 | 11 | **−0.07** | **3** | 530 | 36 | A | Comparative steel |
| B | 4 | 0.001 | | 0.1406 | 5 | 550 | 42 | B | Invented steel |
| B | 5 | 0.002 | 10 | 0.0406 | 5 | 540 | 43 | B | Invented steel |
| B | 6 | **<0.0001** | | 0.0406 | **3** | 825 | 15 | B | Comparative steel |
| C | 7 | 0.002 | 12 | 0.245 | 5 | 595 | 40 | C | Invented steel |
| C | 8 | 0.003 | 11 | **−0.26** | **2** | 590 | 40 | C | Comparative steel |
| D | 9 | **<0.0001** | | 0.0506 | **3** | 540 | 33 | D | Comparative steel |
| D | 10 | 0.002 | 10 | 0.1506 | 5 | 590 | 39 | D | Invented steel |
| E | 11 | 0.005 | 11 | 0.205 | 5 | 700 | 33 | E | Invented steel |
| E | 12 | 0.002 | 10 | 0.105 | 5 | 700 | 33 | E | Invented steel |
| E | 13 | 0.005 | 10 | 0.205 | 5 | 680 | 34 | E | Invented steel |
| F | 14 | 0.001 | | 0.0459 | 5 | 795 | 32 | F | Invented steel |
| F | 15 | 0.003 | 9 | 0.4459 | 5 | 780 | 31 | F | Invented steel |
| G | 16 | 0.002 | 10 | 0.0247 | 5 | 805 | 24 | G | Invented steel |
| G | 17 | 0.002 | 10 | 0.1247 | 5 | 820 | 23 | G | Invented steel |
| H | 18 | 0.0003 | | **−0.19** | **3** | 815 | 23 | H | Comparative steel |
| H | 19 | 0.0002 | 10 | 0.1647 | 5 | 790 | 24 | H | Invented steel |
| H | 20 | 0.0002 | 9 | 0.0647 | 5 | 785 | 24 | H | Invented steel |
| I | 21 | 0.001 | 11 | 0.4417 | 5 | 780 | 29 | I | Invented steel |
| I | 22 | 0.003 | 12 | 0.0417 | 5 | 785 | 29 | I | Invented steel |
| I | 23 | 0.002 | 12 | 0.1417 | 5 | 780 | 28 | I | Invented steel |
| I | 24 | 0.004 | 11 | 0.0917 | 5 | 780 | 29 | I | Invented steel |
| I | 25 | 0.007 | 12 | 0.2417 | 5 | 780 | 29 | I | Invented steel |
| I | 26 | 0.001 | | 0.1917 | 5 | 805 | 28 | I | Invented steel |
| I | 27 | **<0.0001** | | 0.4117 | **4** | 790 | 29 | I | Comparative steel |
| J | 28 | 0.0002 | 11 | 0.1178 | 5 | 605 | 39 | J | Invented steel |
| J | 29 | **<0.0001** | 10 | 0.2578 | **4** | 580 | 38 | J | Comparative steel |
| J | 30 | 0.0001 | | 0.0078 | 6 | 595 | 39 | J | Invented steel |
| CA | 31 | 0.007 | 9 | −3.223 | **2** | 620 | 22 | CA | Comparative steel |
| CB | 32 | 0.08 | 8 | 0.0778 | 5 | 1155 | 4 | CB | Comparative steel |
| CC | 33 | 0.007 | | −0.043 | **3** | 985 | 7 | CC | Comparative steel |
| CD | 34 | | | | | | | CD | Comparative steel |
| CE | 35 | | | | | | | CE | Comparative steel |

(Note)
The underlined bold type numerals are the conditions which are outside the range according to the present invention.

Example of Embodiment 3

The present invention will hereunder be explained in detail based on Example of Embodiment 3.

Steels having chemical compositions shown in Table 15 were heated to the temperature of 1,200 to 1,250° C.; the heated steels were rough-rolled at a total reduction rate of not less than 60% and at a temperature of not less than 1,000° C.; then the hot-rolling of the steels was finished; and the hot-rolled steel sheets were cooled and then coiled at a temperature of not less than the bainite transformation commencement temperature which was determined by the chemical composition of each steel, pickled, and cold-rolled into cold-rolled steel sheets 1.0 mm in thickness.

After that, the $Ac_1$ transformation temperature and the $Ac_3$ transformation temperature were calculated from the components (in mass %) of each steel according to the following equations:

$$Ac_1=723-10.7\times Mn\ \%+29.1\times Si\ \%,$$

$$Ac_3=910-203\times(C\ \%)^{1/2}+44.7\times Si\ \%+31.5\times Mo\ \%-30\times Mn\ \%-11\times Cr\ \%+400\times Al\ \%.$$

The steel sheets were: heated to the annealing temperature calculated from the $Ac_1$ transformation temperature and the $Ac_3$ transformation temperature and retained in the $N_2$ atmosphere containing 10% of $H_2$; after the annealing, cooled, when the highest attained temperature during annealing is defined as Tmax (° C.), in the temperature range from Tmax−200° C. to Tmax−100° C. at a cooling rate of Tmax/1,000 to Tmax/10° C./sec.; successively, cooled in the temperature range from the plating bath temperature −30° C. to the plating bath temperature +500° C. at a cooling rate of 0.1 to 100° C./sec.; then dipped in the plating bath; and retained in the temperature range from the plating bath temperature −300° C. to the plating bath temperature +500° C. for 2 to 200 seconds including the dipping time. Thereafter, as the Fe—Zn alloying treatment, some of the steel sheets were retained in the temperature range from 400 to 550° C. for 15 seconds to 20 minutes after they were plated and Fe contents in the plated layers were adjusted so as to be 5 to 20% in mass, further, rolled in the skin-pass line at the reduction rate of 0.5-2.0%. The steel sheets were subjected to full flat bending (R=1t) and to a JASO cyclic corrosion test up to 150 cycles as a means of evaluating the corrosion resistance in an environment containing chlorine, and the progress of corrosion was evaluated. The compositions of the plated layers were determined by dissolving the plated layers in 5% hydrochloric acid solution containing an inhibitor and chemically analyzing the solution, and the results are shown in Table 16.

From Tables 16 and 17, in the steels according to the present invention, which satisfy the expression (3), all the corrosion evaluation ranks are 4 or 5, and the strength and the elongation are well balanced.

On the other hand, in the comparative steels which do not satisfy the ranges specified in the present invention, since they do not satisfy the regulations on a microstructure or the regulations on production conditions, the strength and the elongation are badly balanced without exception. In the steels of Nos. 3, 13 and 20, which are the comparative steels, the corrosion evaluation ranks are 4 or 5. However, in case of Nos. 13 and 20, the balance between the strength and the elongation is inferior, and in case of No. 3, the tensile strength is low. Further, in the steels produced within the ranges specified in the claims of the present invention, the microstructures are composed of the aforementioned structures, and the steels are excellent in appearance and the balance between strength and elongation.

TABLE 15

| Chemical composition | | | | | | | | | | | | | |
|---|---|---|---|---|---|---|---|---|---|---|---|---|---|
| Steel code | C | Si | Mn | AL | Mo | P | S | Cr | Ni | Cu | Co | W | Nb |
| A | 0.18 | 0.005 | 1.12 | 0.69 | 0.17 | 0.01 | 0.005 | | | | | | |
| B | 0.15 | 0.009 | 0.91 | 1.33 | 0.22 | 0.01 | 0.004 | | | | | | |
| C | 0.13 | 0.08 | 0.98 | 0.36 | 0.09 | 0.01 | 0.006 | 0.12 | | | 0.37 | 0.05 | |
| D | 0.1 | 0.09 | 1.32 | 0.55 | 0.05 | 0.02 | 0.004 | | 0.83 | 0.44 | | | |
| E | 0.12 | 0.05 | 1.75 | 0.03 | 0.02 | 0.015 | 0.002 | | | | | | 0.01 |
| F | 0.07 | 0.008 | 2.33 | 0.03 | 0.04 | 0.025 | 0.003 | | | | | | |
| G | 0.21 | 0.012 | 1.16 | 1.67 | 0.18 | 0.01 | 0.005 | | | | | | |
| H | 0.24 | 0.005 | 0.78 | 0.85 | 0.17 | 0.02 | 0.004 | | | | | | |
| O | 0.002 | 0.008 | 0.08 | 0.05 | 2.5 | 0.008 | 0.004 | | | | | | |
| JJ | 0.08 | 0.15 | 1.31 | 0.03 | 0.01 | 0.01 | 0.004 | | | | | | 0.15 |
| KK | 0.08 | 0.33 | 2.98 | 0.05 | 0.9 | 0.02 | 0.005 | | 3.5 | 8.8 | | | |
| LL | 0.11 | 0.01 | 1.05 | 0.04 | 0.8 | 0.02 | 0.002 | 2.98 | 1.5 | | | | |
| M | 0.19 | 0.01 | 1.21 | 1.51 | 0.13 | 0.01 | 0.005 | | | | | | |
| N | 0.23 | 0.008 | 1.43 | 1.45 | 0.18 | 0.01 | 0.006 | | | | | | |
| O | 0.18 | 0.02 | 1.31 | 1.52 | 0.11 | 0.01 | 0.004 | | | | | | |

| Steel code | Ti | V | Zr | Hf | Ta | B | Mg | Ca | Y | Ca | Rem | Remarks |
|---|---|---|---|---|---|---|---|---|---|---|---|---|
| A | | | | | | | | | | | | Invented steel |
| B | | | | | | | | | | | | Invented steel |
| C | | | | | | | 0.0003 | 0.001 | | | | Invented steel |
| D | | | | | | 0.0003 | | | | 0.0005 | | Invented steel |
| E | 0.01 | | 0.005 | | | | | | 0.0004 | | 0.0003 | Invented steel |
| F | | 0.05 | | 0.01 | 0.01 | | | | | | | Invented steel |
| G | | | | | | | | | | | | Invented steel |
| H | | | | | | | | | | | | Invented steel |
| O | 0.05 | | | | | | | | | | | Comparative steel |
| JJ | | 0.88 | | | | | | | | | | Comparative steel |
| KK | | | | | | 0.15 | 0.015 | | | | | Comparative steel |
| LL | | | | | | | | | | | 0.55 | Comparative steel |
| M | | | | | | | | | | | | Invented steel |
| N | | | | | | | | | | | | Invented steel |
| O | | | | | | | | | | | | Invented steel |

(Note)
The underlined numerals are the conditions which are outside the range according to the present invention.

TABLE 16

| Plating wettability, corrosion resistance, microstructure and fatigue life of each steel | | | | | | | | | |
|---|---|---|---|---|---|---|---|---|---|
| Steel code | Treatment number | Al content in plated layer % | Mo content in plated layer %* | Mo content in steel % | Value calculated by expression (1) # | Application of alloying heat treatment after plating treatment | Fe content in plated layer % | Corrosion resistance evaluation rank after JASO 150 cycle test | |
| A | 1 | 0.012 | 0.0002 | 0.17 | 1.42E−01 | No | | 5 | Invented steel |
| A | 2 | 0.34 | 0.001 | 0.17 | 4.01E+00 | Yes | 9 | 5 | Invented steel |

TABLE 16-continued

Plating wettability, corrosion resistance, microstructure and fatigue life of each steel

| | | | | | | | | | |
|---|---|---|---|---|---|---|---|---|---|
| A | 3 | 0.37 | 0.001 | 0.17 | 4.36E+00 | Yes | 10 | 5 | Comparative steel |
| B | 4 | 0.46 | 0.003 | 0.22 | 4.20E+00 | Yes | 9.5 | 5 | Invented steel |
| B | 5 | 0.03 | 0.0001 | 0.22 | 2.73E−01 | No | | 4 | invented steel |
| B | 6 | 0.001 | 0 | 0.22 | 9.09E−03 | No | | 2 | Comparative steel |
| C | 7 | 0.015 | 0.0001 | 0.09 | 3.34E−01 | No | | 4 | Invented steel |
| C | 8 | 0.044 | 0.003 | 0.09 | 1.01E+00 | Yes | 11 | 5 | Invented steel |
| D | 9 | 0.6 | 0.0001 | 0.05 | 2.40E+01 | No | | 4 | Invented steel |
| D | 10 | 0.55 | 0.001 | 0.05 | 2.20E+01 | Yes | 10.5 | 4 | Invented steel |
| E | 11 | 0.013 | 0.0004 | 0.02 | 1.32E+00 | No | | 5 | Invented steel |
| E | 12 | 0.05 | 0.003 | 0.02 | 5.15E+00 | Yes | 12 | 4 | Invented steel |
| F | 13 | 0.3 | 0.005 | 0.02 | 3.03E+01 | No | | 4 | Comparative steel |
| F | 14 | 0.009 | 0.0001 | 0.04 | 4.53E−01 | No | | 5 | Invented steel |
| F | 15 | 0.074 | 0.003 | 0.04 | 3.78E+00 | Yes | 8.5 | 4 | Invented steel |
| G | 16 | 0.018 | 0.0001 | 0.18 | 2.01E−01 | No | | 4 | Invented steel |
| G | 17 | 0.51 | 0.002 | 0.18 | 5.68E+00 | Yes | 10 | 5 | Invented steel |
| H | 18 | 0.051 | 0.0002 | 0.17 | 6.01E−01 | No | | 5 | Invented steel |
| H | 19 | 0.42 | 0.001 | 0.17 | 4.95E+00 | Yes | 10 | 5 | Invented steel |
| H | 20 | 0.55 | 0.002 | 0.17 | 6.48E+00 | Yes | 9 | 5 | Comparative steel |
| II | 21 | 0.011 | 0 | 2.5 | 8.80E−03 | No | | 2 | Comparative steel |
| JJ | 22 | 0.56 | 0.007 | 0.005 | 2.25E+02 | Yes | 11 | 3 | Comparative steel |
| KK | 23 | Many cracks occurred during hot-rolling | | | | | | | Comparative steel |
| LL | 24 | Many cracks occurred during hot-rolling | | | | | | | Comparative steel |
| M1 | 25 | 0.015 | 0.0005 | 0.13 | 2.35E−01 | Yes | 10 | 5 | Invented steel |
| M2 | 26 | 0.005 | 0.0003 | 0.13 | 7.92E−02 | No | | 5 | Invented steel |
| N | 27 | 0.013 | 0.0010 | 0.18 | 1.5E−01 | Yes | 9 | 5 | Invented steel |
| O | 28 | 0.011 | 0.0006 | 0.11 | 2.05E−01 | Yes | 10 | 5 | Invented steel |

| Steel code | Treatment number | Kind of main phase | Volume percentage of ferrite | Average grain size of main phase/μm | Volume percentage of martensite/% |
|---|---|---|---|---|---|
| A | 1 | Ferrite | 86.5 | 13 | 0 |
| A | 2 | Ferrite | 88 | 14 | 0 |
| A | 3 | Ferrite and pearlite | Pearlite generated | 22 | 0 |
| B | 4 | Ferrite | 89 | 15 | 0 |
| B | 5 | Ferrite | 90 | 16 | 0 |
| B | 6 | Ferrite | 95.7 | 9 | 1 |
| C | 1 | Ferrite | 91.5 | 11 | 0 |
| C | 8 | Ferrite | 91 | 13 | 0 |
| D | 9 | Ferrite | 80 | 8 | 0 |
| D | 10 | Ferrite | 81.5 | 7.5 | 0 |
| E | 11 | Ferrite | 86 | 5 | 9 |
| E | 12 | Ferrite | 85.5 | 5.5 | 8.5 |
| F | 13 | Ferrite and bainite | 15 | 4 | 34 |
| F | 14 | Ferrite | 77 | 4 | 17 |
| F | 15 | Ferrite | 79 | 5 | 16 |
| G | 16 | Ferrite | 87 | 12 | 0 |
| G | 17 | Ferrite | 87.5 | 10 | 0 |
| H | 18 | Ferrite | 81.5 | 8 | 0 |
| H | 19 | Ferrite | 83 | 7 | 0 |
| H | 20 | Ferrite and pearlite | Pearlite generated | 7 | 0 |
| II | 21 | Ferrite | 100 | 18 | 0 |
| JJ | 22 | Ferrite | 199 | 8 | 0 |
| KK | 23 | | | | |
| LL | 24 | | | | |
| M1 | 25 | Ferrite | 85 | 12 | 1 |
| M2 | 26 | Ferrite | 85 | 12 | 0 |
| N | 27 | Ferrite | 77 | 9 | 1 |
| O | 28 | Ferrite | 87 | 11 | 0 |

| Steel code | Treatment number | Volume percentage of austenite/% | Volume percentage of bainite | Average grain size of martensite or austenite/μ | Value calculated by expression (2) | Ratio f grain size of main phase to that of second phase |
|---|---|---|---|---|---|---|

TABLE 16-continued

Plating wettability, corrosion resistance, microstructure and fatigue life of each steel

| | | | | | | |
|---|---|---|---|---|---|---|
| A | 1 | 8.5 | 5 | 2.5 | 2.15176 | 0.19231 |
| A | 2 | 7.5 | 4.5 | 2 | 2.432 | 0.14286 |
| A | 3 | 0 | 0 | | | 0 |
| B | 4 | 7 | 4 | 3.2 | 2.17089 | 0.21333 |
| B | 5 | 6.5 | 3.5 | 2.8 | 2.34067 | 0.175 |
| B | 6 | 1.5 | 1.8 | 1.2 | 9.83376 | 0.13333 |
| C | 7 | 5.5 | 3 | 2.2 | 2.415523 | 0.2 |
| C | 8 | 8 | 3 | 1.9 | 2.22417 | 0.14615 |
| D | 9 | 111 | 9 | 1.5 | 1.15773 | 0.1875 |
| D | 10 | 10.5 | 8 | 1.7 | 1.21643 | 0.22667 |
| E | 11 | 0 | 5 | 1.2 | | 0.24 |
| E | 12 | 0 | 6 | 0.9 | | 0.16364 |
| F | 13 | 0 | 51 | 2.5 | | 0.625 |
| F | 14 | 0 | 6 | 0.7 | | 0.175 |
| F | 15 | 0 | 5 | 0.6 | | 0.12 |
| G | 16 | 9 | 4 | 1.9 | 2.385 | 0.15833 |
| G | 17 | 8.5 | 4 | 1.8 | 2.51676 | 0.18 |
| H | 18 | 15.5 | 3 | 1.2 | 1.6082 | 0.15 |
| H | 19 | 14 | 3 | 0.8 | 1.7691 | 0.11429 |
| H | 20 | 0 | 0 | | | 0 |
| II | 21 | 0 | 0 | | | 0 |
| JJ | 22 | 0 | 0 | | | 0 |
| KK | 23 | | | | | |
| LL | 24 | | | | | |
| M1 | 25 | 9.5 | 4.5 | 2.0 | 2.13125 | 0.1667 |
| M2 | 26 | 10.5 | 4.5 | 2.0 | 1.9608 | 0.1667 |
| N | 27 | 15.0 | 7.0 | 1.9 | 1.8194 | 0.2111 |
| O | 28 | 9.5 | 3.5 | 1.8 | 2.0584 | 0.1636 |

| Steel code | Treatment number | Tensile strength/MPa | Elongation | Tensile strength (MPA) × elongation (%) | |
|---|---|---|---|---|---|
| A | 1 | 645 | 37 | 23865 | Invented steel |
| A | 2 | 640 | 38 | 24320 | Invented steel |
| A | 3 | 540 | 34 | 18360 | Comparative steel |
| B | 4 | 580 | 39 | 22620 | Invented steel |
| B | 5 | 585 | 38 | 22230 | Invented steel |
| B | 6 | 600 | 27 | 16200 | Comparative steel |
| C | 7 | 575 | 40 | 23000 | Invented steel |
| C | 8 | 570 | 40 | 22800 | Invented steel |
| D | 9 | 785 | 28 | 21980 | Invented steel |
| D | 10 | 780 | 28 | 21840 | Invented steel |
| E | 11 | 880 | 23 | 20240 | Invented steel |
| E | 12 | 885 | 23 | 20355 | Invented steel |
| F | 13 | 945 | 10 | 9450 | Comparative steel |
| F | 14 | 910 | 22 | 20020 | Invented steel |
| F | 15 | 890 | 23 | 20470 | Invented steel |
| G | 16 | 625 | 37 | 23125 | Invented steel |
| G | 17 | 615 | 37 | 22755 | Invented steel |
| H | 18 | 815 | 23 | 18745 | Invented steel |
| H | 19 | 790 | 24 | 18960 | Invented steel |
| H | 20 | 565 | 30 | 16950 | Comparative steel |
| II | 21 | 305 | 51 | 15555 | Comparative steel |
| JJ | 22 | 570 | 25 | 14250 | Comparative steel |
| KK | 23 | | | | Comparative steel |
| LL | 24 | | | | Comparative steel |
| M1 | 25 | 620 | 36 | 22320 | Invented steel |
| M2 | 26 | 615 | 37 | 22755 | Invented steel |
| N | 27 | 790 | 27 | 21330 | Invented steel |
| O | 28 | 595 | 38 | 22610 | Invented steel |

(Note)

The underlined bold type numerals are the conditions which are outside the range according to the present invention.

*The value is regarded as 0 when Mo content is less than 0.0001% .

**The sum of the volume percentage of each phase is 100%, and the phases which are hardly observed and identified by an optical microscope, such as carbides, oxides, sulfides, etc., are included in the volume percentage of the main phase. In the case that the main phase is composed of bainite, since the structure is very fine, it is difficult to quantitatively measured each grain size and the volume percentage of each phase.

"1.42E−01" means $1.42 \times 10^{-1}$.

TABLE 17

Production method and each property

| Steel code | Treatment number | Heating temperature prior to hot-rolling/° C. | Total reduction rate in rough hot-rolling/% | Finishing temperature of rough hot-rolling/° C. | $Ac_3$ (calculated + 50 (° C.)/° C. | $0.12 \times (Ac_3 - Ac_1) + Ac_1$ (calculated)/° C. |
|---|---|---|---|---|---|---|
| A | 1 | 1230 | 90 | 1020 | 1122 | 769 |
| A | 2 | 1230 | 90 | 1020 | 1122 | 769 |
| A | 3 | 1230 | 90 | 1020 | 1122 | 769 |
| B | 4 | 1220 | 88 | 1020 | 1393 | 803 |
| B | 5 | 1220 | 88 | 1020 | 1393 | 803 |
| B | 6 | 1120 | 50 | 930 | 1393 | 803 |
| C | 7 | 1250 | 85 | 1095 | 1006 | 758 |
| C | 8 | 1210 | 92 | 1050 | 1006 | 758 |
| D | 9 | 1220 | 91 | 1030 | 1082 | 764 |
| D | 10 | 1220 | 91 | 1030 | 1082 | 764 |
| E | 11 | 1245 | 85 | 1070 | 852 | 731 |
| E | 12 | 1245 | 85 | 1070 | 852 | 731 |

| Steel code | Treatment number | Maximum temperature during annealing: Tmax (° C.)/° C. | Primary cooling rate/° C. /S | Primary cooling halt temperature/° C. | Secondary cooling rate/° C./S | Retaining conditions including zinc plating treatment |
|---|---|---|---|---|---|---|
| A | 1 | 830 | 1 | 680 | 7 | For 35 seconds at a temperature of 465 to 455° C. |
| A | 2 | 830 | 1 | 680 | 10 | For 15 seconds at a temperature of 465 to 455° C. |
| A | 3 | 830 | 1 | 580 | 0.01 | For 15 seconds at a temperature of 465 to 455° C. |
| B | 4 | 820 | 1 | 680 | 5 | For 30 seconds at a temperature of 465 to 460° C. |
| B | 5 | 820 | 1 | 680 | 5 | For 30 seconds at a temperature of 465 to 460° C. |
| B | 6 | 770 | 120 | 680 | 150 | For 3 seconds at a temperature of 465 to 450° C. |
| C | 7 | 850 | 3 | 670 | 10 | For 60 seconds at a temperature of 475 to 460° C. |
| C | 8 | 820 | 0.1 | 690 | 5 | For 45 seconds at a temperature of 475 to 460° C. |
| D | 9 | 835 | 2 | 700 | 5 | For 300 seconds at a temperature of 455 to 460° C. |
| D | 10 | 835 | 5 | 675 | 7 | For 50 seconds at a temperature of 475 to 460° C. |
| E | 11 | 825 | 5 | 690 | 10 | For 10 seconds at a temperature of 465 to 460° C. |
| E | 12 | 825 | 3 | 690 | 30 | For 3 seconds at a temperature of 465 to 460° C. |

| Steel code | Treatment number | Alloying temperature /° C. | Value calculated by expression (1)# | Corrosion resistance evaluation rank after JASO 150 cycle test | Tensile strength/ MPa | Elongation/% | Steel code | |
|---|---|---|---|---|---|---|---|---|
| A | 1 | | 1.42E−01 | 5 | 645 | 37 | A | Invented steel |
| A | 2 | 500 | 4.01E+00 | 5 | 640 | 38 | A | Invented steel |
| A | 3 | 575 | 4.36E+00 | 5 | 540 | 34 | A | Comparative steel |
| B | 4 | | 4.20E+00 | 5 | 580 | 39 | B | Invented steel |
| B | 5 | 510 | 2.73E+00 | 4 | 590 | 38 | B | Invented steel |
| B | 6 | | 9.09E−03 | 2 | 595 | 30 | B | Comparative steel |
| C | 7 | | 3.34E−01 | 4 | 575 | 40 | C | Invented steel |
| C | 8 | 500 | 1.01E+00 | 5 | 570 | 40 | C | Invented steel |
| D | 9 | | 2.40E+01 | 4 | 795 | 33 | D | Invented steel |
| D | 10 | 500 | 2.20E+01 | 4 | 800 | 32 | D | Invented steel |
| E | 11 | | 1.32E+00 | 5 | 880 | 23 | E | Invented steel |
| E | 12 | 500 | 5.15E+00 | 4 | 885 | 23 | E | Invented steel |

| Steel code | Treatment number | Heating temperature prior to hot-rolling/° C. | Total reduction rate in rough hot-rolling/% | Finishing temperature of rough hot-rolling/° C. | $Ac_3$ (calculated + 50 (° C.)/° C. |
|---|---|---|---|---|---|
| F | 13 | 1240 | 88 | 1030 | 854 |
| F | 14 | 1240 | 88 | 1030 | 854 |

TABLE 17-continued

| Production method and each property | | | | | |
|---|---|---|---|---|---|
| F | 15 | 1240 | 88 | 1030 | 854 |
| G | 16 | 1200 | 90 | 1010 | 1506 |
| G | 17 | 1200 | 90 | 1010 | 1506 |
| H | 18 | 1210 | 92 | 1025 | 1183 |
| H | 19 | 1210 | 92 | 1025 | 1183 |
| H | 20 | 1210 | 92 | 1025 | 1183 |
| II | 21 | 1200 | 93 | 1030 | 1049 |
| JJ | 22 | 1250 | 95 | 1000 | 882 |
| M1 | 23 | 1200 | 90 | 1050 | 1444 |
| M2 | 24 | 1200 | 90 | 1050 | 1444 |
| N | 25 | 1200 | 90 | 1050 | 1406 |
| O | 26 | 1200 | 90 | 1050 | 1447 |

| Steel code | Treatment number | $0.12 \times (Ac_3 - Ac_1) + Ac_1$ (calculated)/° C. | Maximum temperature during annealing: Tmax (° C.)/° C. | Primary cooling rate/° C./S | Primary cooling halt temperature/ ° C. | Secondary cooling rate/° C./S |
|---|---|---|---|---|---|---|
| F | 13 | 725 | 980 | 10 | 730 | 50 |
| F | 14 | 725 | 820 | 2 | 660 | 3 |
| F | 15 | 725 | 820 | 2 | 665 | 7 |
| G | 16 | 815 | 850 | 5 | 680 | 8 |
| G | 17 | 815 | 850 | 3 | 700 | 20 |
| H | 18 | 779 | 830 | 10 | 680 | 15 |
| H | 19 | 779 | 830 | 10 | 680 | 20 |
| H | 20 | 779 | 770 | 0.03 | 710 | 0.05 |
| II | 21 | 770 | 800 | 0.1 | 650 | 10 |
| JJ | 22 | 742 | 830 | 0.05 | 680 | 0.3 |
| M1 | 23 | 792 | 800 | 2 | 670 | 5 |
| M2 | 24 | 792 | 800 | 2 | 670 | 5 |
| N | 25 | 786 | 800 | 2 | 670 | 5 |
| O | 26 | 792 | 800 | 2 | 670 | 5 |

| Steel code | Treatment number | Retaining conditions including zinc plating treatment | Alloying temperature/° C. | Value calculated by expression (1)# |
|---|---|---|---|---|
| F | 13 | For 100 seconds at a temperature of 450 to 460° C. | | 3.03E+01 |
| F | 14 | For 160 seconds at a temperature of 450 to 460° C. | | 4.53E−01 |
| F | 15 | For 15 seconds at a temperature of 470 to 460° C. | 505 | 3.78E+00 |
| G | 16 | For 20 seconds at a temperature of 470 to 460° C. | | 2.01E−01 |
| G | 17 | For 10 seconds at a temperature of 470 to 460° C. | 510 | 5.68E+00 |
| H | 18 | For 5 seconds at a temperature of 470 to 460° C. | | 6.01E−01 |
| H | 19 | For 3 seconds at a temperature of 470 to 460° C. | 500 | 4.95E+00 |
| H | 20 | For 3 seconds at a temperature of 475 to 460° C. | 540 | 6.48E+00 |
| II | 21 | For 5 seconds at a temperature of 465 to 460° C. | 510 | 8.80E−03 |
| JJ | 22 | For 60 seconds at a temperature of 465 to 460° C. | 545 | 2.25E+02 |
| Ml | 23 | For 30 seconds at a temperature of 460 to 450° C. | 525 | 2.35E−01 |
| M2 | 24 | For 60 seconds at a temperature of 460 to 450° C. | — | 7.92E−02 |
| N | 25 | For 60 seconds at a temperature of 460 to 450° C. | 500 | 1.50E−01 |
| o | 26 | For 60 seconds at a temperature of 460 to 450° C. | 500 | 2.05E−01 |

| Steel code | Treatment number | Corrosion resistance evaluation rank after JASO 150 cycle test | Tensile strength/MPa | Elongation/% | Steel code | |
|---|---|---|---|---|---|---|
| F | 13 | 4 | 945 | 10 | E | Comparative steel |
| F | 14 | 5 | 910 | 22 | F | Invented steel |
| F | 15 | 4 | 890 | 23 | F | Invented steel |
| G | 16 | 4 | 625 | 37 | G | Invented steel |
| G | 17 | 5 | 615 | 37 | G | Invented steel |
| H | 18 | 5 | 615 | 23 | H | Invented steel |
| H | 19 | 5 | 790 | 24 | H | Invented steel |
| H | 20 | 5 | 565 | 30 | H | Comparative steel |
| II | 21 | 2 | 305 | 51 | II | Comparative steel |
| JJ | 22 | 3 | 570 | 25 | JJ | Comparative steel |
| M1 | 23 | 5 | 620 | 36 | M1 | Invented steel |
| M2 | 24 | 5 | 615 | 37 | M2 | Invented steel |
| N | 25 | 5 | 790 | 27 | N | Invented steel |
| O | 26 | 5 | 595 | 38 | O | Invented steel |

(Note)
The underlined bold type numerals are the conditions which are outside the range according to the present invention.
"1.42E−01" means $1.42 \times 10^{-1}$.

INDUSTRIAL APPLICABILITY

The present invention provides: a high-strength high-ductility hot-dip galvanized steel sheet and hot-dip galvannealed steel sheet having high fatigue resistance and corrosion resistance; a high-strength hot-dip galvanized steel sheet excellent in ductility, which improves non-plating defects and plating adhesion after severe deformation, and a method of producing the same; a high-strength high-ductility hot-dip galvanized steel sheet having high fatigue resistance and corrosion resistance; a high-strength hot-dip galvanized steel sheet excellent in appearance and workability, which suppresses the generation of non-plating defects, and a method of producing the same; and a high-strength hot-dip galvannealed steel sheet and a high-strength hot-dip galvanized steel sheet, which suppress non-plating defects and surface defects and have both corrosion resistance, in particular corrosion resistance, in an environment containing chlorine ion, and high ductility, and a method of producing the same.

The invention claimed is:

1. A high-strength hot-dip galvanized steel sheet having high plating adhesion after severe deformation and ductility, the hot-dip galvanized steel sheet having a plated layer containing, in mass, Al: 0.001 to 0.5%, and Mn: 0.001 to 2%, with the balance being of Zn and unavoidable impurities, on the surface of a steel sheet consisting essentially of, in mass, C: 0.0001 to 0.3%, Si: 0.01 to 2.5%, Mn: 0.01 to 3%, Al: 0.31 to 4%, and the balance being Fe and unavoidable impurities, characterized in that: Si content: X (in mass %), Mn content: Y (in mass %) and Al content: Z (in mass %) in the steel, and Al content: A (in mass %) and Mn content: B (in mass %) in the plated layer satisfy the following equation 1; and the microstructure of the steel sheet has the main phase comprising ferrite at 70 to 97% in volume and the average grain size of the main phase being not more than 20 μm, and a second phase comprising one or more austenite and martensite at 3 to 30% in volume and the average grain size of the second phase being not more than 10 μm:

$$3-(X+Y/10+Z/3)-12.5\times(A-B)\geqq 0 \quad 1.$$

2. A high-strength hot-dip galvannealed steel sheet having high plating adhesion after severe deformation and ductility according to claim 1, characterized in that the plated layer further contains Fe at 5 to 20% in mass.

3. A high-strength hot-dip galvanized steel sheet having high plating adhesion after severe deformation and ductility according to claim 1, characterized in that the average grain size of austenite and martensite which constitute(s) the second phase of the steel sheet is 0.01 to 0.7 times the average grain size of ferrite.

4. A high-strength hot-dip galvanized steel sheet having high plating adhesion after severe deformation and ductility according to claim 1, characterized in that the steel further contains Mo at 0.001 to 5% in mass.

5. A high-strength hot-dip galvanized steel sheet having high plating adhesion after severe deformation and ductility according to claim 1, characterized in that the steel further contains P at 0.0001 to 0.1% and S at 0.0001 to 0.01%, in mass.

6. A high-strength hot-dip galvanized steel sheet having high plating adhesion after severe deformation and ductility according to claim 1, characterized in that the plated layer further contains, in mass, one or more of, Ca: 0.001 to 0.1%, Mg: 0.001 to 3%, Si: 0.001 to 0.1%, Mo: 0.001 to 0.1%, W: 0.001 to 0.1%, Zr: 0.001 to 0.1%, Cs: 0.001 to 0.1%, Rb: 0.001 to 0.1%, K: 0.001 to 0.1%, Ag: 0.001 to 5%, Na: 0.001 to 0.05%, Cd: 0.001 to 3%, Cu: 0.001 to 3%, Ni: 0.001 to 0.5%, Co: 0.001 to 1%, La: 0.001 to 0.1%, Tl: 0.001 to 8%, Nd: 0.001 to 0.1%, Y: 0.001 to 0.1%, In: 0.001 to 5%, Be: 0.001 to 0.1%, Cr: 0.001 to 0.05%, Pb: 0.001 to 1%, Hf: 0.001 to 0.1%, Tc: 0.001 to 0.1%, Ti: 0.001 to 0.1%, Ge: 0.001 to 5%, Ta: 0.001 to 0.1%, V: 0.001 to 0.2%, and B: 0.001 to 0.1%.

7. A high-strength hot-dip galvanized steel sheet having superior appearance and workability according to claim 1, characterized in that the steel further contains, in mass, one or more of, Cr: 0.001 to 25%, Ni: 0.001 to 10%, Cu: 0.001 to 5%, Co: 0.001 to 5%, and W: 0.001 to 5%.

8. A high-strength hot-dip galvanized steel sheet having superior appearance and workability according to claim 7, characterized in that the steel further contains, in mass, one or more of Nb, Ti, V, Zr, Hf and Ta at 0.001 to 1% in total.

9. A high-strength hot-dip galvanized steel sheet having superior appearance and workability according to claim 8, characterized in that the steel yet further contains B at 0.0001 to 0.1% in mass.

10. A high-strength hot-dip galvanized steel sheet having superior appearance and workability according to claim 9, characterized in that the steel yet further contains one or more of Y, Rem, Ca, Mg and Ce at 0.0001 to 1% in mass in total.

11. A high-strength high-ductility hot-dip galvanized steel sheet having high fatigue resistance and corrosion resistance according to claim 1, characterized in that: the steel contains one or more of $SiO_2$, MnO and $Al_2O_3$ at 0.1 to 70% in total area percentage in the range from the interface between the plated layer and the steel sheet to the depth of 10 μm; and the following equation 5 is satisfied:

$$\{\text{MnO (in area percentage)}+Al_2O_3\text{ (in area percentage)}\}/SiO_2\text{ (in area percentage)}\geqq 0.1 \quad 5.$$

12. A high-strength high-ductility hot-dip galvanized steel sheet having high fatigue resistance and corrosion resistance according to claim 1, characterized in that the steel contains one or more of $Y_2O_3$, $ZrO_2$, $HfO_2$, $TiO_3$, $La_2O_3$, $Ce_2O_3$, $CeO_2$, CaO and MgO at 0.0001 to 10.0% in total area percentage in the range from the interface between the plated layer and the steel sheet to the depth of 10 μm.

13. A high-strength hot-dip galvannealed steel sheet having superior appearance and workability, the hot-dip galvannealed steel sheet having a plated layer containing, in mass, Mn: 0.001 to 3%, Al: 0.001 to 4%, Mo: 0.0001 to 1%, and Fe: 5 to 20%, with the balance being of Zn and unavoidable impurities, on the surface of a steel sheet consisting essentially of, in mass, C: 0.0001 to 0.3%, Si: 0.001 to less than 0.1%, Mn: 0.01 to 3%, Al: 0.31 to 4%, Mo: 0.001 to 1%, P: 0.0001 to 0.3%, S: 0.0001 to 0.1%, and the balance being of Fe and unavoidable impurities, characterized in that: Mn content: X (in mass %) and Si content: Y (in mass %) in the steel, and Al content: Z (in mass %) in the plated layer satisfy the following equation 2:

$$0.6-(X/18+Y+Z)\geqq 0 \qquad 2.$$

14. A high-strength hot-dip galvanized steel sheet having superior appearance and workability according to claim 13, characterized in that the microstructure of the steel has a main phase comprising ferrite or ferrite and bainite at 50 to 97% in volume and the balance comprising a complex structure containing either or both of martensite and retained austenite at 3 to 50% in total volume.

15. A high-strength hot-dip galvanized steel sheet having superior appearance and workability according to claim 13, characterized in that the microstructure of the steel sheet has a main phase comprising ferrite at 70 to 97% in volume and the average grain size of the main phase being not more than 20 μm, and a second phase comprising austenite and/or martensite at 3 to 30% in volume and the average grain size of the second phase being not more than 10 μm.

16. A high-strength hot-dip galvannealed steel sheet having superior appearance and workability according to claim 15, characterized in that: the second phase of the steel sheet is composed of austenite; and C content: C (in mass %) and Mn content: Mn (in mass %) in the steel, and the volume percentage of austenite: Vγ (in %) and the volume percentage of ferrite and bainite: Vα (in %) satisfy the following equation 4:

$$(V\gamma+V\alpha)/V\gamma\times C+Mn/8\geqq 2.0 \qquad 4.$$

17. A high-strength hot-dip galvannealed steel sheet having superior appearance and workability according to claim 13, characterized in that the microstructure of the steel sheet: has a main phase comprising ferrite at 50 to 95% in volume and the average grain size of the main phase being not more than 20 μm, and a second phase comprising austenite and/or martensite at 3 to 30% in volume and the average grain size of the second phase being not more than 10 μm; and further contains bainite at 2 to 47% in volume.

18. A high-strength high-ductility hot-dip galvannealed steel sheet having high corrosion resistance according to claim 17, characterized in that the average grain size of austenite and/or martensite which constitute(s) the second phase of the steel sheet is 0.01 to 0.6 times the average grain size of ferrite.

19. A high-strength hot-dip galvanized steel sheet having superior appearance and workability, the hot-dip galvanized steel sheet having a plated layer containing, in mass, Mn: 0.001 to 3%, Al: 0.001 to 4%, Mo: 0.0001 to 1%, and Fe: 0% to less than 5%, with the balance being of Zn and unavoidable impurities, on the surface of a steel sheet consisting essentially of, in mass, C: 0.0001 to 0.3%, Si: 0.001 to less than 0.1%, Mn: 0.01 to 3%, Al: 0.31 to 4%, Mo: 0.001 to 1%, P: 0.0001 to 0.3%, S: 0.0001 to 0.1%, and the balance being Fe and unavoidable impurities, characterized in that: Mn content: X (in mass %) and Si content: Y (in mass %) in the steel, and Al content: Z (in mass %) in the plated layer satisfy the following equation 2:

$$0.6-(X/18+Y+Z)\geqq 0 \qquad 2.$$

20. A high-strength high-ductility hot-dip galvannealed steel sheet having high corrosion resistance, the hot-dip galvannealed steel sheet having a plated layer containing, in mass, Al: 0.001 to 4%, and Fe: 5 to 20%, with the balance consisting of Zn and unavoidable impurities, on the surface of a steel sheet consisting essentially of, in mass, C: 0.0001 to 0.3%, Si: 0.001 to less than 0.1%, Mn: 0.001 to 3%, Al: 0.31 to 4%, Mo: 0.001 to 1%, P: 0.001 to 0.3%, S: 0.0001 to 0.1%, and the balance being Fe and unavoidable impurities, characterized in that: Al content: A (in mass %) and Mo content: B (in mass %) in the plated layer, and Mo content: C (in mass %) in the steel satisfy the following equation 3; and the microstructure of the steel has a main phase comprising ferrite or ferrite and bainite at 50 to 97% in volume and the balance comprising a complex structure containing either or both of martensite and retained austenite 3 to 50% in volume:

$$100\geqq(A/3+B/6)/(C/6)\geqq 0.01 \qquad 3.$$

21. A high-strength high-ductility hot-dip galvanized steel sheet having superior appearance and workability, the hot-dip galvanized steel sheet having a plated layer containing, in mass, Al: 0.001 to 4%, and Fe: 0% to less than 5%, Mo: an amount satisfying below equation 3, with the balance being Zn and unavoidable impurities, on the surface of a steel sheet consisting essentially of, in mass, C: 0.0001 to 0.3%,
Si: 0.001 to less than 0.1%,
Mn: 0.001 to 3%,
Al: 0.31 to 4%,
Mo: 0.001 to 1%,
P: 0.001 to 0.3%,
S: 0.0001 to 0.1%, and the balance being Fe and unavoidable impurities, characterized in that: Al content: A (in mass %) and Mo content: B (in mass %) in the plated layer, and Mo content: C (in mass %) in the steel satisfy the following equation 3; and the microstructure of the steel has a main phase comprising ferrite or ferrite and bainite 50 to 97% in volume and the balance comprising a complex structure containing either or both of martensite and retained austenite at 3 to 50% in volume:

$$100 \geqq (A/3+B/6)/(C/6) \geqq 0.01 \quad 3.$$

22. A high-strength hot-dip galvanized steel sheet having high plating adhesion after severe deformation and ductility, the hot-dip galvanized steel sheet having a plated layer containing, in mass, Al: 0.001 to 0.5%, and
Mn: 0.001 to 2%,
with the balance being Zn and unavoidable impurities, on the surface of a steel sheet consisting essentially of, in mass,
C: 0.0001 to 0.3%,
Si: 0.05 to 2.5%,
Mn: 0.01 to 3%,
Al: 0.001 to 4%, and
the balance being Fe and unavoidable impurities, characterized in that: Si content: X (in mass %), Mn content: Y (in mass %) and Al content: Z (in mass %) in the steel, and Al content: A (in mass %) and Mn content: B (in mass %) in the plated layer satisfy the following equation 1; and the microstructure of the steel sheet has a main phase comprising ferrite at 70 to 97% in volume and the average grain size of the main phase being not more than 20 μm, and a second phase comprising one or more of austenite and martensite at 3 to 30% in volume and the average grain size of the second phase being not more than 10 μm:

$$3-(X+Y/10+Z/3)-12.5\times(A-B) \geqq 0 \quad 1.$$

23. A high-strength hot-dip galvannealed steel sheet having superior appearance and workability, the hot-dip galvannealed steel sheet having a plated layer containing, in mass, Mn: 0.001 to 3%,
Al: 0.001 to 4%,
Mo: 0.0001 to 1%, and
Fe: 5 to 20%,
with the balance being Zn and unavoidable impurities, on the surface of a steel sheet consisting essentially of, in mass,
C: 0.0001 to 0.3%,
Si: 0.05 to less than 0.1%,
Mn: 0.01 to 3%,
Al: 0.001 to 4%,
Mo: 0.01 to 1%,
P: 0.0001 to 0.3%,
S: 0.0001 to 0.1%, and the balance being Fe and unavoidable impurities, characterized in that: Mn content: X (in mass %) and Si content: Y (in mass %) in the steel, and Al content: Z (in mass in the plated layer satisfy the following equation 2:

$$0.6-(X/18+Y+Z) \geqq 0 \quad 2.$$

24. A high-strength hot-dip galvanized steel sheet having superior appearance and workability, the hot-dip galvanized steel sheet having a plated layer containing, in mass, Mn: 0.001 to 3%,
Al: 0.001 to 4%,
Mo: 0.0001 to 1%, and
Fe: 0% to less than 5%,
with the balance being Zn and unavoidable impurities, on the surface of a steel sheet consisting essentially of, in mass,
C: 0.0001 to 0.3%,
Si: 0.05 to less than 0.1%,
Mn: 0.01 to 3%,
Al: 0.001 to 4%,
Mo: 0.01 to 1%,
P: 0.0001 to 0.3%,
S: 0.0001 to 0.1%, and the balance being Fe and unavoidable impurities, characterized in that: Mn content: X (in mass %) and Si content: Y (in mass %) in the steel, and Al content: Z (in mass %) in the plated layer satisfy the following equation 2:

$$0.6-(X/18+Y+Z) \geqq 0 \quad 2.$$

25. A high-strength high-ductility hot-dip galvannealed steel sheet having high corrosion resistance, the hot-dip galvannealed steel sheet having a plated layer containing, in mass, Al: 0.001 to 4%,
Fe: 5 to 20%, and
Mo: an amount satisfying below equation 3, with the balance being Zn and unavoidable impurities, on the surface of a steel sheet consisting essentially of, in mass, C: 0.0001 to 0.3%,
Si: 0.05 to less than 0.1%,
Mn: 0.01 to 3%,
Al: 0.001 to 4%,
Mo: 0.01 to 1%,
P: 0.0001 to 0.3%,
S: 0.0001 to 0.1%, and the balance being Fe and unavoidable impurities, characterized in that: Al content: A (in mass %) and Mo content: B (in mass %) in the plated layer, and Mo content: C (in mass %) in the steel satisfy the following equation 3; and the microstructure of the steel has a main phase comprising ferrite or ferrite and bainite at 50 to 97% in volume and the balance comprising a complex structure containing either or both of martensite and retained austenite at 3 to 50% in volume:

$$100 \geqq (A/3+B/6)/(C/6) \geqq 0.01 \quad 3.$$

26. A high-strength high-ductility hot-dip galvanized steel sheet having superior appearance and workability, the hot-dip galvanized steel sheet having a plated layer containing, in mass, Al: 0.001 to 4%,
Fe: 0% to less than 5%, and
Mo: an amount satisfying below equation 3, with the balance being Zn and unavoidable impurities, on the surface of a steel sheet consisting essentially of, in mass, C: 0.0001 to 0.3%,
Si: 0.05 to less than 0.1%,
Mn: 0.01 to 3%,
Al: 0.001 to 4%,
Mo: 0.01 to 1%,
P: 0.0001 to 0.3%,
S: 0.0001 to 0.1%, and the balance being Fe and unavoidable impurities, characterized in that: Al content: A (in mass %) and Mo content: B (in mass %) in the plated layer, and Mo content: C (in mass %) in the steel satisfy the following equation 3; and the microstructure of the steel has a main phase comprising ferrite or ferrite and bainite at 50 to 97% in volume and the balance comprising a complex structure containing either or both of martensite and retained austenite at 3 to 50% in volume:

$$100 \geqq (A/3+B/6)/(C/6) \geqq 0.01 \quad 3.$$

27. A high-strength hot-dip galvanized steel sheet having high plating adhesion after severe deformation and ductility, the hot-dip galvanized steel sheet having a plated layer containing, in mass, Al: 0.001 to 0.5%, and Mn: 0.001 to 2%, with the balance being Zn and unavoidable impurities, on the surface of a steel sheet consisting essentially of, in mass, C: 0.0001 to 0.3%, Si: 0.01 to 2.5%, Mn: 0.01 to 3%, Al: 0.31 to 4%, and the balance being Fe and unavoidable impurities, characterized in that: Si content: X (in mass %), Mn content: Y (in mass %) and Al content: Z (in mass %) in the steel, and Al content: A (in mass %) and Mn content: B (in mass %) in the plated layer satisfy the following equation 1; and the microstructure of the steel sheet has the main phase comprising ferrite at 50 to 95% in volume and the average grain size of the main phase being not more than 20 μm, and a second phase comprising one or more of austenite and martensite at 3 to 30% in volume and the average grain size of the second phase being not more than 10 μm; and further contains bainite at 2 to 47% in volume:

$$3-(X+Y/10+Z/3)-12.5\times(A-B) \geqq 0 \quad 1.$$

28. A high-strength hot-dip galvannealed steel sheet having high plating adhesion after severe deformation and ductility according to claim 27, characterized in that the plated layer further contains Fe at 5 to 20% in mass.

29. A high-strength hot-dip galvanized steel sheet having high plating adhesion after severe deformation and ductility according to claim 27, characterized in that the average grain size of said one or more of austenite and martensite which constitute(s) the second phase of the steel sheet is 0.01 to 0.7 times the average grain size of ferrite.

30. A high-strength hot-dip galvanized steel sheet having high plating adhesion after severe deformation and ductility, the hot-dip galvanized steel sheet having a plated layer containing, in mass, Al: 0.001 to 0.5%, and Mn: 0.001 to 2%, with the balance being Zn and unavoidable impurities, on the surface of a steel sheet consisting essentially of, in mass, C: 0.0001 to 0.3%, Si: 0.05 to 2.5%, Mn: 0.01 to 3%, Al: 0.001 to 4%, and the balance being Fe and unavoidable impurities, characterized in that: Si content: X (in mass %), Mn content: Y (in mass %) and Al content: Z (in mass %) in the steel, and Al content: A (in mass %) and Mn content: B (in mass %) in the plated layer satisfy the following equation 1; and the microstructure of the steel sheet has the main phase comprising ferrite at 50 to 95% in volume and the average grain size of the main phase being not more than 20 μm, and a second phase comprising one or more of austenite and martensite at 3 to 30% in volume and the average grain size of the second phase being not more than 10 μm; and further contains bainite at 2 to 47% in volume:

$$3-(X+Y/10+Z/3)-12.5\times(A-B) \geqq 0 \quad 1.$$

31. A high-strength hot-dip galvannealed steel sheet having high plating adhesion after severe deformation and ductility according to claim 30, characterized in that the plated layer further contains Fe at 5 to 20% in mass.

32. A high-strength hot-dip galvanized steel sheet having high plating adhesion after severe deformation and ductility according to claim 30, characterized in that the average grain size of said one or more of austenite and martensite which constitute(s) the second phase of the steel sheet is 0.01 to 0.7 times the average grain size of ferrite.

* * * * *